US009050541B2

(12) United States Patent
Mimlitch, III et al.

(10) Patent No.: US 9,050,541 B2
(45) **Date of Patent: *Jun. 9, 2015**

(54) MOVING ATTACHMENTS FOR A VIBRATION POWERED TOY

(71) Applicant: Innovation First, Inc., Greenville, TX (US)

(72) Inventors: Robert H. Mimlitch, III, Rowlett, TX (US); David Anthony Norman, Greenville, TX (US); Gregory E. Needel, III, Rockwall, TX (US); Jeffrey Russell Waegelin, Allen, TX (US); Joel Reagan Carter, Argyle, TX (US)

(73) Assignee: Innovation First, Inc., Greenville, TX (US)

( * ) Notice: Subject to any disclaimer, the term of this patent is extended or adjusted under 35 U.S.C. 154(b) by 333 days.

This patent is subject to a terminal disclaimer.

(21) Appl. No.: 13/679,031

(22) Filed: Nov. 16, 2012

(65) Prior Publication Data

US 2013/0090037 A1 Apr. 11, 2013

Related U.S. Application Data

(63) Continuation-in-part of application No. 12/860,696, filed on Aug. 20, 2010, and a continuation-in-part of application No. 13/364,992, filed on Feb. 2, 2012, now abandoned, which is a continuation of application No. 13/004,783, filed on Jan. 11, 2011, now abandoned.

(60) Provisional application No. 61/246,023, filed on Sep. 25, 2009.

(51) Int. Cl.
*A63H 13/00* (2006.01)
*A63H 11/02* (2006.01)

(Continued)

(52) U.S. Cl.
CPC ..... *A63H 29/22* (2013.01); *A63H 11/02* (2013.01); *A63H 17/26* (2013.01)

(58) Field of Classification Search
CPC ..... A63H 11/02; A63H 11/00; A63H 17/004; A63H 18/007; A63H 29/08; A63H 33/26; A63H 29/22; A63H 17/26
USPC ..... 446/3, 484, 351, 353, 238, 236
See application file for complete search history.

(56) References Cited

U.S. PATENT DOCUMENTS 1,544,568 A * 7/1925 Fehr ..... 446/460
1,793,121 A 7/1928 Muller (Continued)

FOREIGN PATENT DOCUMENTS

CN 1054896 8/1991
CN 2820261 9/2006

(Continued)

OTHER PUBLICATIONS

US Patent Office Action on co-pending U.S. Appl. No. 13/004,783; notice mailed Aug. 14, 2013.

(Continued)

*Primary Examiner* — Gene Kim
*Assistant Examiner* — Alyssa Hylinski
(74) *Attorney, Agent, or Firm* — Adam K. Sacharoff; Much Shelist

(57) ABSTRACT

An apparatus includes a housing, a rotational motor situated within the housing, an eccentric load adapted to be rotated by the rotational motor, and a plurality of legs each having a leg base and a leg tip at a distal end relative to the leg base. The legs are coupled to the housing at the leg base and include at least one driving leg constructed from a flexible material and configured to cause the apparatus to move in a direction generally defined by an offset between the leg base and the leg tip as the rotational motor rotates the eccentric load.

17 Claims, 37 Drawing Sheets

(51) Int. Cl.
*A63H 29/22* (2006.01)
*A63H 17/26* (2006.01)

(56) References Cited

U.S. PATENT DOCUMENTS

| | | | | | |
|---|---|---|---|---|---|
| 1,763,788 | A | | 6/1930 | Jobe, Sr. | |
| 2,167,985 | A | | 8/1939 | Levay | |
| 2,618,888 | A | * | 11/1952 | Hoff | 446/3 |
| 2,827,735 | A | | 3/1958 | Grimm | |
| 2,862,333 | A | | 12/1958 | Franco | |
| 2,919,921 | A | | 1/1960 | Berger | |
| 3,196,580 | A | * | 7/1965 | Rakestraw | 446/484 |
| 3,331,463 | A | | 7/1967 | Kramer | |
| 3,343,793 | A | | 9/1967 | Waser | |
| 3,452,473 | A | * | 7/1969 | Convertine | 446/353 |
| 3,530,617 | A | | 9/1970 | Halvorson et al. | |
| 3,712,541 | A | | 1/1973 | Merino et al. | |
| 3,841,636 | A | * | 10/1974 | Meyer | 273/110 |
| 3,842,532 | A | | 10/1974 | Nielsen | |
| 3,959,920 | A | | 6/1976 | Ieda | |
| 4,163,558 | A | | 8/1979 | Breslow et al. | |
| 4,183,173 | A | | 1/1980 | Ogawa | |
| 4,219,957 | A | * | 9/1980 | Kakuta | 446/230 |
| 4,291,490 | A | * | 9/1981 | Ikeda | 446/90 |
| 4,496,100 | A | | 1/1985 | Schwager et al. | |
| 4,544,094 | A | | 10/1985 | Scholey | |
| 4,550,910 | A | | 11/1985 | Goldfarb et al. | |
| 4,591,346 | A | * | 5/1986 | Ikeda | 446/437 |
| 4,605,230 | A | | 8/1986 | Halford et al. | |
| 4,674,949 | A | | 6/1987 | Kroczynski | |
| 4,708,690 | A | | 11/1987 | Kulesza et al. | |
| 4,824,415 | A | | 4/1989 | Herbstler et al. | |
| 4,941,857 | A | | 7/1990 | Jujimaki | |
| 5,088,949 | A | | 2/1992 | Atkinson et al. | |
| 5,221,226 | A | | 6/1993 | Park | |
| 5,679,047 | A | * | 10/1997 | Engel | 446/3 |
| 5,947,788 | A | | 9/1999 | Derrah | |
| 5,993,286 | A | * | 11/1999 | Tacquard et al. | 446/351 |
| 6,199,439 | B1 | | 3/2001 | Lin | |
| 6,238,264 | B1 | | 5/2001 | Kazami et al. | |
| D458,320 | S | | 6/2002 | Domingues | |
| 6,435,929 | B1 | | 8/2002 | Halford | |
| 6,450,104 | B1 | | 9/2002 | Grant et al. | |
| 6,599,048 | B2 | | 7/2003 | Kuo | |
| 6,652,352 | B1 | | 11/2003 | MacArthur et al. | |
| 6,826,449 | B1 | * | 11/2004 | Abu-Taha | 700/245 |
| 6,866,557 | B2 | | 3/2005 | Randall | |
| 6,899,589 | B1 | * | 5/2005 | Lund et al. | 446/351 |
| 6,964,572 | B2 | | 11/2005 | Cesa | |
| 7,040,951 | B2 | | 5/2006 | Hornsby et al. | |
| 7,339,340 | B2 | | 3/2008 | Summer et al. | |
| 7,803,031 | B1 | | 9/2010 | Winckler et al. | |
| 7,927,170 | B2 | * | 4/2011 | Bickerton et al. | 446/3 |
| 8,038,503 | B2 | * | 10/2011 | Norman et al. | 446/351 |
| 8,834,227 | B2 | * | 9/2014 | Norman et al. | 446/351 |
| 8,858,294 | B2 | * | 10/2014 | Mimlitch et al. | 446/351 |
| 8,905,813 | B2 | * | 12/2014 | Norman et al. | 446/351 |
| 2001/0024925 | A1 | * | 9/2001 | Domingues | 446/353 |
| 2001/0054518 | A1 | | 12/2001 | Buehler et al. | |
| 2004/0198159 | A1 | | 10/2004 | Xu et al. | |
| 2005/0112992 | A1 | | 5/2005 | Malcolm | |
| 2006/0076735 | A1 | | 4/2006 | Proch et al. | |
| 2007/0087654 | A1 | | 4/2007 | Chernick et al. | |
| 2008/0061644 | A1 | | 3/2008 | Treat | |
| 2008/0143141 | A1 | * | 6/2008 | Ruslanov et al. | 296/181.1 |
| 2009/0311941 | A1 | | 12/2009 | Bickerton et al. | |
| 2012/0100777 | A1 | * | 4/2012 | Hsu | 446/330 |

FOREIGN PATENT DOCUMENTS

| | | | | |
|---|---|---|---|---|
| CN | 201618407 | | | 11/2010 |
| DE | 916935 | | | 8/1954 |
| DE | 1120958 | | | 12/1961 |
| EP | 0008676 | | | 3/1980 |
| FR | 1564711 | | | 4/1969 |
| FR | 2348723 | | | 11/1977 |
| FR | 2358174 | | | 2/1978 |
| GB | 488042 | | | 6/1938 |
| GB | 1291592 | | | 10/1972 |
| GB | 1381326 | | | 1/1975 |
| GB | 1180384 | | | 2/1980 |
| GB | 1595007 | | | 8/1981 |
| GB | 2427529 | | | 12/2006 |
| JP | 1146570 | | | 6/1989 |
| JP | 04030883 | | | 2/1992 |
| JP | 6343767 | | | 12/1994 |
| JP | 06343767 | A | * | 12/1994 |
| JP | 2003135864 | | | 5/2001 |
| KR | 20070101487 | | | 10/2007 |
| WO | 03/015891 | | | 12/2003 |
| WO | 2006-136792 | | | 12/2006 |
| WO | 2011/038280 | | | 3/2011 |
| WO | 2011/038281 | | | 3/2011 |

OTHER PUBLICATIONS

Office Action dated Jul. 16, 2012 in Australian Application No. 2012201317, 3 pages.

EPO Office Communicated dated Jul. 23, 2012 in EP Application No. 12163857.1, 5 pages.

EPO Office Communicated dated Jul. 23, 2012 in EP Application No. 12166840.4, 3 pages.

Notification of Transmital of the ISR and the Writen Opinion of the ISA or Declaration (1 page); ISR (4 pages); and Written Opinion of the ISA (5 pages), mailed Jun. 7, 2012 for application PCT/US2012/027914.

Search Report dated Jul. 4, 2012 in EP Application No. 12163857.1, 3 pages.

Office Action dated Aug. 3, 2012 in Chinese Application No. 201080001431.X, 18 pages.

Greenberg Taurig Letter dated Aug. 10, 2012 (2 pages).

*Innovation First, Inc., and Innovation First Labs, Inc.* v. *Toy Investment, Inc. d/b/a/ Toysmith, and McManemim Companies*, Civil Action No. 3:12-CV-02091-M, Answer to Complaint, Filed Aug. 20, 2012 (7 pages).

*Innovation First, Inc., and Innovation First Labs, Inc.* v. *Toy Investment, Inc. d/b/a/ Toysmith, and McManemim Companies*, Civil Action No. 3:12-CV-02091-M, Plaintiffs' Complaint for Patent Infringement, Filed Jun. 29, 2012 (45 pages).

Davis Wright Tremaine LLP Letter dated Aug. 1, 2012 (3 pages).

http://www.klutz.com/Invasion-of-the-Bristlebots, [online] Invasion of the Bristlebots, 8 pages, retrieved Oct. 20, 2010.

http://www.streettech.com/modules, [online] Hot-To: Build BEAM Vibrobots, Street Tech, Hardware beyond the hype, 7 pages, retrieved Oct. 20, 2010.

http://www.evilmadscientist.com/article.php/bristlebot, [online] Bristlebot: A tiny directional vibrobot—Evil Mad Scientist Laboratories, 21 pages, retrieved Oct. 20, 2010.

http://themombuzz.mom/2009/12/11/stocking-stuffer-nascar-zipbot-race-set, [online] Stocking Stuffer: NASCAR Zipbot Race Set: The Mom Buzz, 10 pages, retrieved Oct. 20, 2010.

http://blog.makezine.com/archive/2008/04/rc_bristlebot.html, [online] RC Bristlebot, Aug. 30, 2010.

Publisher Klutz Lives Up to Its Name: "Bristlebots," Scholastic, and Evil Mad Scientist Lab http://boingboing.net/2009/02120/publisher-klutz-live.html, Xeni Jardin at 9:06 am, Feb. 20, 2009.

Vibrobot, "Make a Twitchy, Bug-Like Robot with a Toy Motor and a Mint Tin" http://makezine,com/10/123_vibrobot/, 2007.

Vibrobot, Hot To—Make a Bristlebot a Tiny Directional Vibrobot Made From a Toothbrush! http://blog.makezine.com/archive/2007/12/how_to_make_a_bristlebot.html, 2007.

BotJunkie, DIY Vibrobots, http://www.botjunkie.com/2007/12/20/diy-vibrobots/, 2007.

Notification of Transmittal of the ISR and the Written Opinion of the ISA, or Declaration (1 page); ISR (2 pages); and Written Opinion of the ISA (29 pages), mailed Nov. 22, 2010 for application 050238.

Office Action dated Oct. 28, 2010 in Australian Application No. 2010224405.

(56) References Cited

OTHER PUBLICATIONS http://www.evilmadscientist.com/article.php/bristlebot, OSKAY, Dec. 19, 2007.
http://www.youtube.com/watch?v=h6jowo3OxAQ, Innovation First, Sep. 18, 2009.
Notification of Transmittal of the ISR and the Written Opinion of the ISA, or Declaration (1 page); ISR (4 pages); and Written Opinion of the ISA (6 pages), mailed Feb. 14, 2011 for application PCT/US2010/050261.
Notification of Transmittal of the ISR and the Written Opinion of the ISA, or Declaration (1 page); ISR (4 pages); and Written Opinion of the ISA (6 pages), mailed Feb. 15, 2011 for application PCT/US2010/050265.
Notification of Transmittal of the ISR and the Written Opinion of the ISA, or Declaration (1 page); ISR (4 pages); and Written Opinion of the ISA (6 pages), mailed Feb. 3, 2011 for application PCT/US2010/050258.
Notification of Transmittal of the ISR and the Written Opinion of the ISA, or Declaration (1 page); ISR (4 pages); and Written Opinion of the ISA (7 pages), mailed Feb. 3, 2011 for application PCT/US2010/050281.
Notification of Transmittal of the ISR and the Written Opinion of the ISA, or Declaration (1 page); ISR (4 pages); and Written Opinion of the ISA (6 pages), mailed Feb. 3, 2011 for application PCT/US2010/050266.
Notification of Transmittal of the ISR and the Written Opinion of the ISA, or Declaration (1 page); ISR (4 pages); and Written Opinion of the ISA (5 pages), mailed Jan. 26, 2011 for application PCT/US2010/050256.
EPO Search Report dated Jan. 27, 2011 in related EP Application No. 10179680.3, 3 pages.
EPO Communication dated Feb. 10, 2011 in related EP Application No. 10179680.3, 5 pages.
EPO Search Report dated Feb. 3, 2011 in related EP Application No. 10179686.0, 3 pages.
EPO Search Report dated Feb. 3, 2011 in related EP Application No. 10179694.4, 3 pages.
EPO Search Report dated Feb. 3, 2011 in related EP Application No. 10179701.7, 3 pages.
EPO Search Report dated Feb. 3, 2011 in related EP Application No. 10179706.6, 3 pages.
EPO Search Report dated Feb. 15, 2011 in related EP Application No. 10179707.4, 3 pages.
EPO Communication dated Mar. 31, 2011 in related EP Application No. 10179686.0, 5 pages.
EPO Communication dated Mar. 31, 2011 in related EP Application No. 10179694.4, 5 pages.
EPO Communication dated Mar. 31, 2011 in related EP Application No. 10179701.7, 5 pages.
EPO Communication dated Mar. 31, 2011 in related EP Application No. 10179706.6, 4 pages.
Notification of Transmittal of the ISR and the Written Opinion of the ISA, or Declaration (1 page); ISR (7 pages); and Written Opinion of the ISA (10 pages), mailed Mar. 25, 2011 for application PCT/US2010/050257.
German Search Report dated Sep. 20, 2011 in related German Application No. 102010046513.5, 5 pages.
German Search Report dated Sep. 20, 2011 in related German Application No. 102010046511.9, 5 pages.
German Search Report dated Sep. 20, 2011 in related German Application No. 102010046509.7, 5 pages.
German Search Report dated Sep. 20, 2011 in related German Application No. 102010046440.6, 5 pages.
German Search Report dated Sep. 20, 2011 in related German Application No. 102010046510.0, 5 pages.
German Search Report dated Sep. 20, 2011 in related German Application No. 102010046441.4, 5 pages.
Shantou GoldRosita Intelligent Electronic Toys Industrial Co., Lit., Scoot Micro-Robotic Vehicles, pictures of product, product available over the Internet; manufactured in Guangdong, China.
Office Action, Dec. 13, 2013, China Patent Office on co-pending 201210018152.5.
Computer Translation of JP 2003-135864 obtained from the Japanese Patent Office.

* cited by examiner

MOVING ATTACHMENTS FOR A VIBRATION POWERED TOY

CROSS-REFERENCE TO RELATED APPLICATIONS

This application is a continuation in part of U.S. application Ser. No. 12/860,696 filed Aug. 20, 2010, which claims the benefit of U.S. Patent Application No. 61/246,023, entitled "Vibration Powered Vehicle," filed Sep. 25, 2009. This application is also a continuation in part of U.S. application Ser. No. 13/364,992 filed Feb. 2, 2012, which is a continuation application of U.S. application Ser. No. 13/004,783 filed Jan. 11, 2011. All of the above referenced applications are incorporated herein by reference in its entirety.

BACKGROUND OF THE INVENTION

This specification relates to devices that move based on oscillatory motion and/or vibration.

One example of vibration driven movement is a vibrating electric football game. A vibrating horizontal metal surface induced inanimate plastic figures to move randomly or slightly directionally. More recent examples of vibration driven motion use internal power sources and a vibrating mechanism located on a vehicle.

One method of creating movement-inducing vibrations is to use rotational motors that spin a shaft attached to a counterweight. The rotation of the counterweight induces an oscillatory motion. Power sources include wind up springs that are manually powered or DC electric motors. The most recent trend is to use pager motors designed to vibrate a pager or cell phone in silent mode. Vibrobots and Bristlebots are two modern examples of vehicles that use vibration to induce movement. For example, small, robotic devices, such as Vibrobots and Bristlebots, can use motors with counterweights to create vibrations. The robots' legs are generally metal wires or stiff plastic bristles. The vibration causes the entire robot to vibrate up and down as well as rotate. These robotic devices tend to drift and rotate because no significant directional control is achieved.

Vibrobots tend to use long metal wire legs. The shape and size of these vehicles vary widely and typically range from short 2" devices to tall 10" devices. Rubber feet are often added to the legs to avoid damaging tabletops and to alter the friction coefficient. Vibrobots typically have 3 or 4 legs, although designs with 10-20 exist. The vibration of the body and legs creates a motion pattern that is mostly random in direction and in rotation. Collision with walls does not result in a new direction and the result is that the wall only limits motion in that direction. The appearance of lifelike motion is very low due to the highly random motion.

Bristlebots are sometimes described in the literature as tiny directional Vibrobots. Bristlebots use hundreds of short nylon bristles for legs. The most common source of the bristles, and the vehicle body, is to use the entire head of a toothbrush. A pager motor and battery complete the typical design. Motion can be random and directionless depending on the motor and body orientation and bristle direction. Designs that use bristles angled to the rear with an attached rotating motor can achieve a general forward direction with varying amounts of turning and sideways drifting. Collisions with objects such as walls cause the vehicle to stop, then turn left or right and continue on in a general forward direction. The appearance of lifelike motion is minimal due to a gliding movement and a zombie-like reaction to hitting a wall.

SUMMARY OF THE INVENTION

In general, one innovative aspect of the subject matter described in this specification can be embodied in apparatus that include a frame adapted to releasably attach to a body of a device that is configured to move based on internally induced vibration of the device and an appendage rotatably coupled to the frame. The appendage is adapted to rotate about an axis of rotation when the frame is attached to the body of the device as vibration induces motion of the device.

These and other embodiments can each optionally include one or more of the following features. The frame includes a plurality of tabs adapted for releasably attaching the frame to the body of the device. The frame further includes a surface opposing the plurality of tabs, and the surface and the plurality of tabs are adapted to engage a portion of the body of the device. The frame includes an interior concave portion shaped to substantially conform to an exterior portion of the body of the device. The axis of rotation is defined by an axle that rotatably couples the appendage to the frame. The axis of rotation is situated at least substantially parallel to a direction of movement of the device as vibration induces motion of the device when the frame is attached to the body of the device. The axis of rotation is situated at least substantially perpendicular to a direction of movement of the device as vibration induces motion of the device when the frame is attached to the body of the device. The appendage is adapted to rotate in a particular direction based on the vibration of the device when the frame is attached to the body of the device. The appendage is adapted to rotate back and forth as the device vibrates when the frame is attached to the body of the device. A plurality of appendages rotatably coupled to the frame, and each appendage is adapted to rotate about a respective axis of rotation when the frame is attached to the body of the device as vibration induces motion of the device. The frame is substantially rigid. The internally induced vibration of the device is induced using a rotational motor coupled to the body of the device and an eccentric load, and the rotational motor is adapted to rotate the eccentric load. The axis of rotation is situated at least substantially parallel to a rotational axis of the rotational motor as the rotational motor rotates the eccentric load when the frame is attached to the body of the device. The axis of rotation is situated at least substantially perpendicular to a rotational axis of the rotational motor as the rotational motor rotates the eccentric load when the frame is attached to the body of the device. The appendage is configured to resemble one of a saw blade, a swinging blade, a rocking wing, a steammoller drum, or a drill bit. The motion of the device includes vibration-induced motion across a support surface for the device.

In general, another innovative aspect of the subject matter described in this specification can be embodied in methods that include the acts of attaching a frame to a body of a device adapted to move based on vibration of the device, inducing vibration of the device using a vibrating mechanism attached to the device, and inducing movement of an appendage rotatably coupled to the frame. The movement of the appendage includes rotation about an axis of rotation and is based on vibration of the device induced by the vibrating mechanism when the frame is attached to the body of the device.

These and other embodiments can each optionally include one or more of the following features. At least a first frame and a second frame are attached to different sections of the body of the device, and each frame is rotatably coupled to at least one appendage adapted to rotate about a respective axis of rotation. The frame is attached to the body of the device by engaging the body of the device with a plurality of tabs attached to the frame and a surface of the frame opposing the plurality of tabs. The plurality of tabs can be disengaged to remove the frame from the body of the device. The frame is attached to the body of the device by engaging an interior concave portion shaped to substantially conform to an exterior portion of the body of the device. The axis of rotation is defined by an axle that rotatably couples the appendage to the frame. Substantially forward motion of the device is induced based on the induced vibration, and the axis of rotation is situated at least substantially parallel to a direction of forward motion of the device. Substantially forward motion of the device is induced based on the induced vibration, and the axis of rotation is situated at least substantially perpendicular to a direction of forward motion of the device. The appendage repeatedly and substantially continuously rotates in a particular direction based on the vibration of the device when the frame is attached to the body of the device. The appendage rotates back and forth as the device vibrates when the frame is attached to the body of the device. The vibration of the device is induced using a rotational motor coupled to the body of the device and an eccentric load, and the rotational motor is adapted to rotate the eccentric load. The vibration of the device induces motion across a support surface for the device.

In general, another innovative aspect of the subject matter described in this specification can be embodied in apparatus that include a body, an appendage rotatably coupled to the body, a rotational motor coupled to the body, an eccentric load, and a plurality of legs. The rotational motor is adapted to rotate the eccentric load, and the appendage is adapted to rotate about an axis of rotation due to forces induced when the rotational motor rotates the eccentric load. The plurality of legs each have a leg base and a leg tip at a distal end relative to the leg base, and the plurality of legs include at least one driving leg configured to cause the apparatus to move in a direction generally defined by an offset between the leg base and the leg tip as the rotational motor rotates the eccentric load.

These and other embodiments can each optionally include one or more of the following features. At least a portion of the plurality of legs are constructed from a flexible material, are injection molded, and are integrally coupled to the body at the leg base. The legs are arranged in two rows, with the leg base of the legs in each row coupled to the body substantially along a lateral edge of the body. The body includes a housing, the rotational motor is situated within the housing, and at least a portion of the housing is situated between the two rows of legs. The rotational motor has an axis of rotation that passes within about 20% of the center of gravity of the apparatus as a percentage of the height of the apparatus. The plurality of legs are arranged in two rows and the rows are substantially parallel to the axis of rotation of the rotational motor, and at least some of the leg tips tend to substantially prevent rolling of the apparatus based on a spacing of the two rows of legs when the legs are oriented such that a leg tip of at least one leg on each lateral side of the body contacts a substantially flat surface. Forces from rotation of the eccentric load interact with a resilient characteristic of the at least one driving leg to cause the at least one driving leg to leave a support surface as the apparatus translates in the forward direction. A coefficient of friction of a portion of at least a subset of the legs that contact a support surface is sufficient to substantially eliminate drifting in a lateral direction. The legs are sufficiently stiff that four or fewer legs are capable of supporting the apparatus without substantial deformation when the apparatus is in an upright position. The eccentric load is configured to be located toward a front end of the apparatus relative to the driving legs, wherein the front end of the apparatus is defined by an end in a direction that the apparatus primarily tends to move as the rotational motor rotates the eccentric load. The plurality of legs are integrally molded with at least a portion of the body. The plurality of legs are co-molded with at least a portion of the body constructed from a different material. At least a subset of the plurality of legs, including the at least one driving leg, are curved, and a ratio of a radius of curvature of the curved legs to leg length of the curved legs is in a range of 2.5 to 20. The flexible material includes an elastomer. Each of the plurality of legs has a diameter of at least five percent of a length of the leg between the leg base and the leg tip.

The details of one or more embodiments of the subject matter described in this specification are set forth in the accompanying drawings and the description below. Other features, aspects, and advantages of the subject matter will become apparent from the description, the drawings, and the claims.

The details of one or more embodiments of the subject matter described in this specification are set forth in the accompanying drawings and the description below. Other features, aspects, and advantages of the subject matter will become apparent from the description, the drawings, and the claims.

BRIEF DESCRIPTION OF THE DRAWINGS

Like reference numbers and designations in the various drawings indicate like elements.

DETAILED DESCRIPTION OF THE INVENTION

Figure 1:
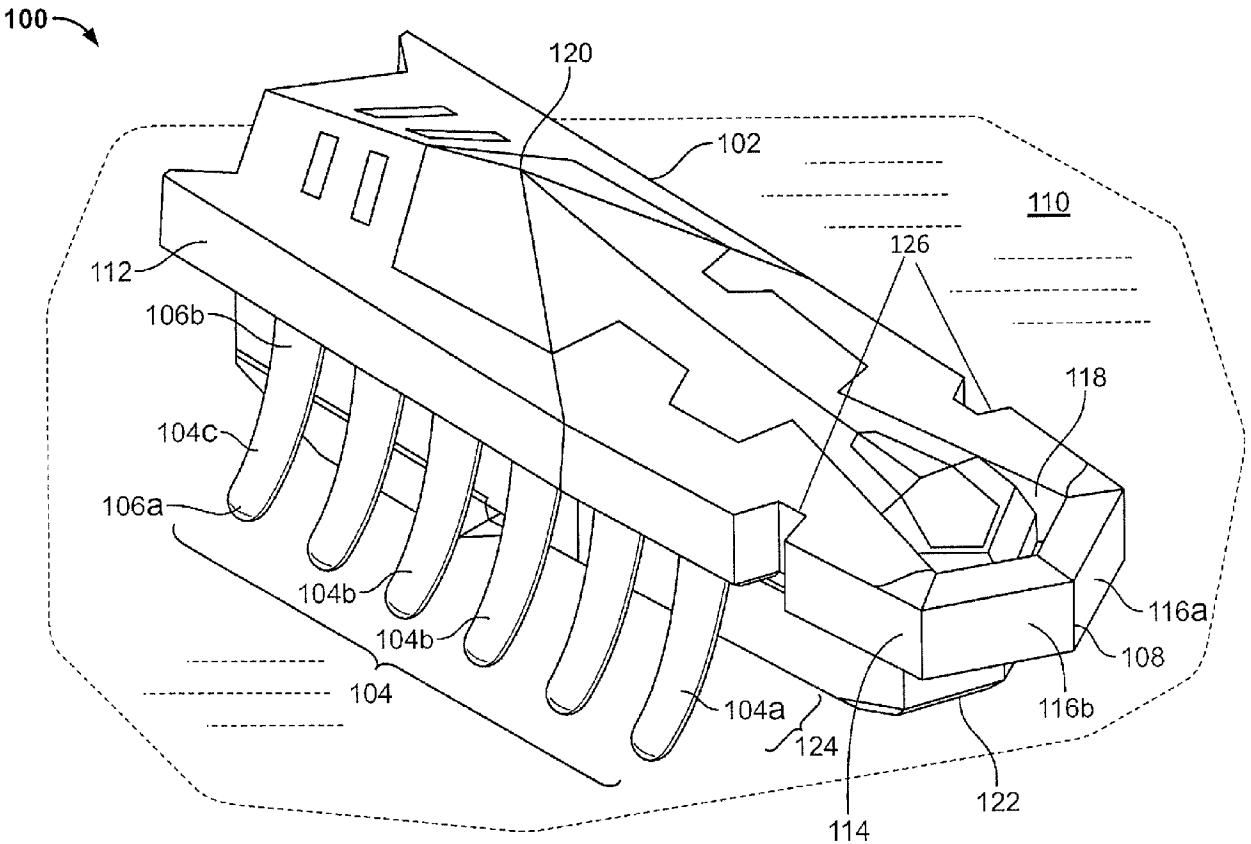
FIG. 1 is a diagram that illustrates an example vibration powered device.

Small robotic devices, or vibration-powered vehicles, can be designed to move across a surface, e.g., a floor, table, or other relatively flat surface. The robotic device is adapted to move autonomously and, in some implementations, turn in seemingly random directions. In general, the robotic devices include a housing, multiple legs, and a vibrating mechanism (e.g., a motor or spring-loaded mechanical winding mechanism rotating an eccentric load, a motor or other mechanism adapted to induce oscillation of a counterweight, or other arrangement of components adapted to rapidly alter the center of mass of the device). As a result, the miniature robotic devices, when in motion, can resemble organic life, such as bugs or insects.

Movement of the robotic device can be induced by the motion of a rotational motor inside of, or attached to, the device, in combination with a rotating weight with a center of mass that is offset relative to the rotational axis of the motor. The rotational movement of the weight causes the motor and the robotic device to which it is attached to vibrate. In some implementations, the rotation is approximately in the range of 6000-9000 revolutions per minute (rpm's), although higher or lower rpm values can be used. As an example, the device can use the type of vibration mechanism that exists in many pagers and cell phones that, when in vibrate mode, cause the pager or cell phone to vibrate. The vibration induced by the vibration mechanism can cause the device to move across the surface (e.g., the floor) using legs that are configured to alternately flex (in a particular direction) and return to the original position as the vibration causes the device to move up and down.

Various features can be incorporated into the robotic devices. For example, various implementations of the devices can include features (e.g., shape of the legs, number of legs, frictional characteristics of the leg tips, relative stiffness or flexibility of the legs, resiliency of the legs, relative location of the rotating counterweight with respect to the legs, etc.) for facilitating efficient transfer of vibrations to forward motion. The speed and direction of the robotic device's movement can depend on many factors, including the rotational speed of the motor, the size of the offset weight attached to the motor, the power supply, the characteristics (e.g., size, orientation, shape, material, resiliency, frictional characteristics, etc.) of the "legs" attached to the housing of the device, the properties of the surface on which the device operates, the overall weight of the device, and so on.

In some implementations, the devices include features that are designed to compensate for a tendency of the device to turn as a result of the rotation of the counterweight and/or to alter the tendency for, and direction of, turning between different robotic devices. The components of the device can be positioned to maintain a relatively low center of gravity (or center of mass) to discourage tipping (e.g., based on the lateral distance between the leg tips) and to align the components with the rotational axis of the rotating motor to encourage rolling (e.g., when the device is not upright). Likewise, the device can be designed to encourage self-righting based on features that tend to encourage rolling when the device is on its back or side in combination with the relative flatness of the device when it is upright (e.g., when the device is "standing" on its leg tips). Features of the device can also be used to increase the appearance of random motion and to make the device appear to respond intelligently to obstacles. Different leg configurations and placements can also induce different types of motion and/or different responses to vibration, obstacles, or other forces. Moreover, adjustable leg lengths can be used to provide some degree of steering capability. In some implementations, the robotic devices can simulate real-life objects, such as crawling bugs, rodents, or other animals and insects.

FIG. 1 is a diagram that illustrates an example device 100 that is shaped like a bug. The device 100 includes a housing 102 (e.g., resembling the body of the bug) and legs 104. Inside (or attached to) the housing 102 are the components that control and provide movement for the device 100, including a rotational motor, power supply (e.g., a battery), and an on/off switch. Each of the legs 104 includes a leg tip 106*a* and a leg base 106*b*. The properties of the legs 104, including the position of the leg base 106*b* relative to the leg tip 106*a*, can contribute to the direction and speed in which the device 100 tends to move. The device 100 is depicted in an upright position (i.e., standing on legs 104) on a supporting surface 110 (e.g., a substantially planar floor, table top, etc. that counteracts gravitational forces).

Overview of Legs

Legs 104 can include front legs 104*a*, middle legs 104*b*, and rear legs 104*c*. For example, the device 100 can include a pair of front legs 104*a* that may be designed to perform differently from middle legs 104*b* and rear legs 104*c*. For example, the front legs 104*a* may be configured to provide a driving force for the device 100 by contacting an underlying surface 110 and causing the device to hop forward as the device vibrates. Middle legs 104*b* can help provide support to counteract material fatigue (e.g., after the device 100 rests on the legs 104 for long periods of time) that may eventually cause the front legs 104*a* to deform and/or lose resiliency. In some implementations, device 100 can exclude middle legs 104*b* and include only front legs 104*a* and rear legs 104*c*. In some implementations, front legs 104*a* and one or more rear legs 104*c* can be designed to be in contact with a surface, while middle legs 104*b* can be slightly off the surface so that the middle legs 104*b* do not introduce significant additional drag forces and/or hopping forces that may make it more difficult to achieve desired movements (e.g., tendency to move in a relatively straight line and/or a desired amount of randomness of motion).

In some implementations, the device 100 can be configured such that only two front legs 104*a* and one rear leg 104*c* are in contact with a substantially flat surface 110, even if the device includes more than one rear leg 104*c* and several middle legs 104*b*. In other implementations, the device 100 can be configured such that only one front leg 104*a* and two rear legs 104*c* are in contact with a flat surface 110. Throughout this specification, descriptions of being in contact with the surface can include a relative degree of contact. For example, when one or more of the front legs 104*a* and one or more of the back legs 104*c* are described as being in contact with a substantially flat surface 110 and the middle legs 104*b* are described as not being in contact with the surface 110, it is also possible that the front and back legs 104*a* and 104*c* can simply be sufficiently longer than the middle legs 104*b* (and sufficiently stiff) that the front and back legs 104*a* and 104*c* provide more support for the weight of the device 100 than do the middle legs 104*b*, even though the middle legs 104*b* are technically actually in contact with the surface 110. In some implementations, even legs that have a lesser contribution to support of the device may nonetheless be in contact when the device 100 is in an upright position, especially when vibration of the device causes an up and down movement that compresses and bends the driving legs and allows additional legs to contact the surface 110. Greater predictability and control of movement (e.g., in a straight direction) can be obtained by constructing the device so that a sufficiently small number of legs (e.g., fewer than twenty or fewer than thirty) contact the support surface 110 and/or contribute to the support of the device in the upright position when the device is either at rest or as the rotating eccentric load induces movement. In this respect, it is possible for some legs to provide support even without contacting the support surface 110 (e.g., one or more short legs can provide stability by contacting an adjacent longer leg to increase overall stiffness of the adjacent longer leg). Typically, however, each leg is sufficiently stiff that four or fewer legs are capable of supporting the weight of the device without substantial deformation (e.g., less than 5% as a percentage of the height of the leg base 106*b* from the support surface 110 when the device 100 is in an upright position).

Different leg lengths can be used to introduce different movement characteristics, as further discussed below. The various legs can also include different properties, e.g., different stiffnesses or coefficients of friction, as further described below. Generally, the legs can be arranged in substantially parallel rows along each lateral side of the device 100 (e.g., FIG. 1 depicts one row of legs on the right lateral side of the device 100; a corresponding row of legs (not shown in FIG. 1) can be situated along the left lateral side of the device 100).

In general, the number of legs 104 that provide meaningful or any support for the device can be relatively limited. For example, the use of less than twenty legs that contact the support surface 110 and/or that provide support for the device 100 when the device 100 is in an upright position (i.e., an orientation in which the one or more driving legs 104*a* are in contact with a support surface) can provide more predictability in the directional movement tendencies of the device 100 (e.g., a tendency to move in a relatively straight and forward direction), or can enhance a tendency to move relatively fast by increasing the potential deflection of a smaller number of legs, or can minimize the number of legs that may need to be altered to achieve the desired directional control, or can improve the manufacturability of fewer legs with sufficient spacing to allow room for tooling. In addition to providing support by contacting the support surface 110, legs 104 can provide support by, for example, providing increased stability for legs that contact the surface 110. In some implementations, each of the legs that provides independent support for the device 100 is capable of supporting a substantial portion of the weight of the device 100. For example, the legs 104 can be sufficiently stiff that four or fewer legs are capable of statically (e.g., when the device is at rest) supporting the device without substantial deformation of the legs 104 (e.g., without causing the legs to deform such that the body of the device 100 moves more than 5% as a percentage of the height of the leg base 106*b* from the support surface).

Figure 4:
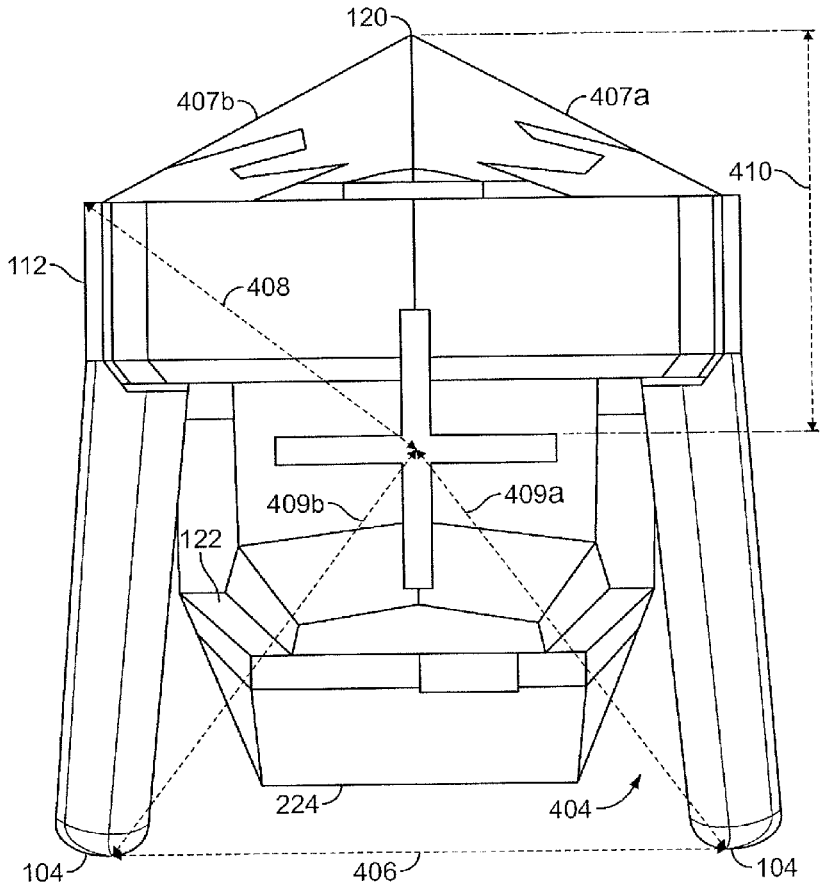
FIG. 4 shows an example front view indicating a center of gravity for the device.

As described here at a high level, many factors or features can contribute to the movement and control of the device 100. For example, the device's center of gravity (CG), and whether it is more forward or towards the rear of the device, can influence the tendency of the device 100 to turn. Moreover, a lower CG can help to prevent the device 100 from tipping over. The location and distribution of the legs 104 relative to the CG can also prevent tipping. For example, if pairs or rows of legs 104 on each side of the device 100 are too close together and the device 100 has a relatively high CG (e.g., relative to the lateral distance between the rows or pairs of legs), then the device 100 may have a tendency to tip over on its side. Thus, in some implementations, the device includes rows or pairs of legs 104 that provide a wider lateral stance (e.g., pairs of front legs 104*a*, middle legs 104*b*, and rear legs 104*c* are spaced apart by a distance that defines an approximate width of the lateral stance) than a distance between the CG and a flat supporting surface on which the device 100 rests in an upright position. For example, the distance between the CG and the supporting surface can be in the range of 50-80% of the value of the lateral stance (e.g., if the lateral stance is 0.5 inches, the CG may be in the range of 0.25-0.4 inches from the surface 110). Moreover, the vertical location of the CG of the device 100 can be within a range of 40-60% of the distance between a plane that passes through the leg tips 106*a* and the highest protruding surface on the top side of the housing 102. In some implementations, a distance 409*a* and 409*b* (as shown in FIG. 4) between each row of the tips of legs 104 and a longitudinal axis of the device 100 that runs through the CG can be roughly the same or less than the distance 406 (as shown in FIG. 4) between the tips 106*a* of two rows of legs 104 to help facilitate stability when the device is resting on both rows of legs.

The device 100 can also include features that generally compensate for the device's tendency to turn. Driving legs (e.g., front legs 104*a*) can be configured such that one or more legs on one lateral side of the device 100 can provide a greater driving force than one or more corresponding legs on the other lateral side of the device 100 (e.g., through relative leg lengths, relative stiffness or resiliency, relative fore/aft location in the longitudinal direction, or relative lateral distance from the CG). Similarly, dragging legs (e.g., back legs 104*c*) can be configured such that one or more legs on one lateral side of the device 100 can provide a greater drag force than one or more corresponding legs on the other lateral side of the device 100 (e.g., through relative leg lengths, relative stiffness or resiliency, relative fore/aft location in the longitudinal direction, or relative lateral distance from the CG). In some implementations, the leg lengths can be tuned either during manufacturing or subsequently to modify (e.g., increase or reduce) a tendency of the device to turn.

Movement of the device can also be influenced by the leg geometry of the legs 104. For example, a longitudinal offset between the leg tip (i.e., the end of the leg that touches the surface 110) and the leg base (i.e., the end of the leg that attaches to the device housing) of any driving legs induces movement in a forward direction as the device vibrates. Including some curvature, at least in the driving legs, further facilitates forward motion as the legs tend to bend, moving the device forward, when vibrations force the device downward and then spring back to a straighter configuration as the vibrations force the device upward (e.g., resulting in hopping completely or partially off the surface, such that the leg tips move forward above or slide forward across the surface 110).

The ability of the legs to induce forward motion results in part from the ability of the device to vibrate vertically on the resilient legs. As shown in FIG. 1, the device 100 includes an underside 122. The power supply and motor for the device 100 can be contained in a chamber that is formed between the underside 122 and the upper body of the device, for example. The length of the legs 104 creates a space 124 (at least in the vicinity of the driving legs) between the underside 122 and the surface 110 on which the device 100 operates. The size of the space 124 depends on how far the legs 104 extend below the device relative to the underside 122. The space 124 provides room for the device 100 (at least in the vicinity of the driving legs) to move downward as the periodic downward force resulting from the rotation of the eccentric load causes the legs to bend. This downward movement can facilitate forward motion induced by the bending of the legs 104.

The device can also include the ability to self-right itself, for example, if the device 100 tips over or is placed on its side or back. For example, constructing the device 100 such that the rotational axis of the motor and the eccentric load are approximately aligned with the longitudinal CG of the device 100 tends to enhance the tendency of the device 100 to roll (i.e., in a direction opposite the rotation of the motor and the eccentric load). Moreover, construction of the device housing to prevent the device from resting on its top or side (e.g., using one or more protrusions on the top and/or sides of the device housing) and to increase the tendency of the device to bounce when on its top or side can enhance the tendency to roll. Furthermore, constructing the legs of a sufficiently flexible material and providing clearance on the housing undercarriage that the leg tips to bend inward can help facilitate rolling of the device from its side to an upright position.

FIG. 1 shows a body shoulder 112 and a head side surface 114, which can be constructed from rubber, elastomer, or other resilient material, contributing to the device's ability to self-right after tipping. The bounce from the shoulder 112 and the head side surface 114 can be significantly more than the lateral bounce achieved from the legs, which can be made of rubber or some other elastomeric material, but which can be less resilient than the shoulder 112 and the head side surface 114 (e.g., due to the relative lateral stiffness of the shoulder 112 and the head side surface 114 compared to the legs 104). Rubber legs 104, which can bend inward toward the body 102 as the device 100 rolls, increase the self-righting tendency, especially when combined with the angular/rolling forces induced by rotation of the eccentric load. The bounce from the shoulder 112 and the head side surface 114 can also allow the device 100 to become sufficiently airborne that the angular forces induced by rotation of the eccentric load can cause the device to roll, thereby facilitating self-righting.

The device can also be configured to include a degree of randomness of motion, which can make the device 100 appear to behave like an insect or other animate object. For example, vibration induced by rotation of the eccentric load can further induce hopping as a result of the curvature and "tilt" of the legs. The hopping can further induce a vertical acceleration (e.g., away from the surface 110) and a forward acceleration (e.g., generally toward the direction of forward movement of the device 100). During each hop, the rotation of the eccentric load can further cause the device to turn toward one side or the other depending on the location and direction of movement of the eccentric load. The degree of random motion can be increased if relatively stiffer legs are used to increase the amplitude of hopping. The degree of random motion can be influenced by the degree to which the rotation of the eccentric load tends to be either in phase or out of phase with the hopping of the device (e.g., out of phase rotation relative to hopping may increase the randomness of motion). The degree of random motion can also be influenced by the degree to which the back legs 104*c* tend to drag. For example, dragging of back legs 104*c* on both lateral sides of the device 100 may tend to keep the device 100 traveling in a more straight line, while back legs 104*c* that tend to not drag (e.g., if the legs bounce completely off the ground) or dragging of back legs 104*c* more on one side of the device 100 than the other can tend to increase turning.

Another feature is "intelligence" of the device 100, which can allow the device to interact in an apparently intelligent manner with obstacles, including, for example, bouncing off any obstacles (e.g., walls, etc.) that the device 100 encounters during movement. For example, the shape of the nose 108 and the materials from which the nose 108 is constructed can enhance a tendency of the device to bounce off of obstacles and to turn away from the obstacle. Each of these features can contribute to how the device 100 moves, and will be described below in more detail.

FIG. 1 illustrates a nose 108 that can contribute to the ability of the device 100 to deflect off of obstacles. Nose left side 116*a* and nose right side 116*b* can form the nose 108. The nose sides 116*a* and 116*b* can form a shallow point or another shape that helps to cause the device 100 to deflect off obstacles (e.g., walls) encountered as the device 100 moves in a generally forward direction. The device 100 can includes a space within the head 118 that increases bounce by making the head more elastically deformable (i.e., reducing the stiffness). For example, when the device 100 crashes nose-first into an obstacle, the space within the head 118 allows the head of the device 100 to compress, which provides greater control over the bounce of the device 100 away from the obstacle than if the head 118 is constructed as a more solid block of material. The space within the head 118 can also better absorb impact if the device falls from some height (e.g., a table). The body shoulder 112 and head side surface 114, especially when constructed from rubber or other resilient material, can also contribute to the device's tendency to deflect or bounce off of obstacles encountered at a relatively high angle of incidence.

Wireless/Remote Control Embodiments

In some implementations, the device 100 includes a receiver that can, for example, receive commands from a remote control unit. Commands can be used, for example, to control the device's speed and direction, and whether the device is in motion or in a motionless state, to name a few examples. In some implementations, controls in the remote control unit can engage and disengage the circuit that connects the power unit (e.g., battery) to the device's motor, allowing the operator of the remote control to start and stop the device 100 at any time. Other controls (e.g., a joy stick, sliding bar, etc.) in the remote control unit can cause the motor in the device 100 to spin faster or slower, affecting the speed of the device 100. The controls can send the receiver on the device 100 different signals, depending on the commands that correspond to the movement of the controls. Controls can also turn on and off a second motor attached to a second eccentric load in the device 100 to alter lateral forces for the device 100, thereby changing a tendency of the device to turn and thus providing steering control. Controls in a remote control unit can also cause mechanisms in the device 100 to lengthen or shorten one or more of the legs and/or deflecting one or more of the legs forward, backward, or laterally to provide steering control.

Leg Motion and Hop

FIGS. 2A through 2D are diagrams that illustrate example forces that induce movement of the device 100 of FIG. 1. Some forces are provided by a rotational motor 202, which enable the device 100 to move autonomously across the surface 110. For example, the motor 202 can rotate an eccentric load 210 that generates moment and force vectors 205-215 as shown in FIGS. 2A-2D. Motion of the device 100 can also depend in part on the position of the legs 104 with respect to the counterweight 210 attached to the rotational motor 202. For example, placing the counterweight 210 in front of the front legs 104*a* will increase the tendency of the front legs 104*a* to provide the primary forward driving force (i.e., by focusing more of the up and down forces on the front legs). For example, the distance between the counterweight 210 and the tips of the driving legs can be within a range of 20-100% of an average length of the driving legs. Moving the counterweight 210 back relative to the front legs 104*a* can cause other legs to contribute more to the driving forces.

Figure 2B:
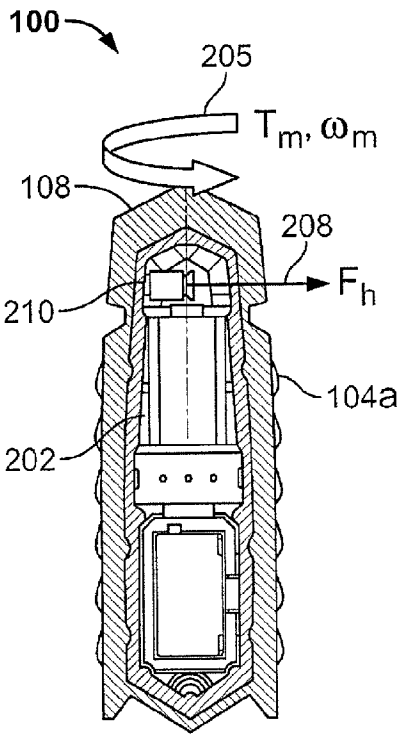
FIGS. 2A through 2D are diagrams that illustrate example forces that are involved with movement of the vibration powered device of FIG. 1.
Figure 2A:
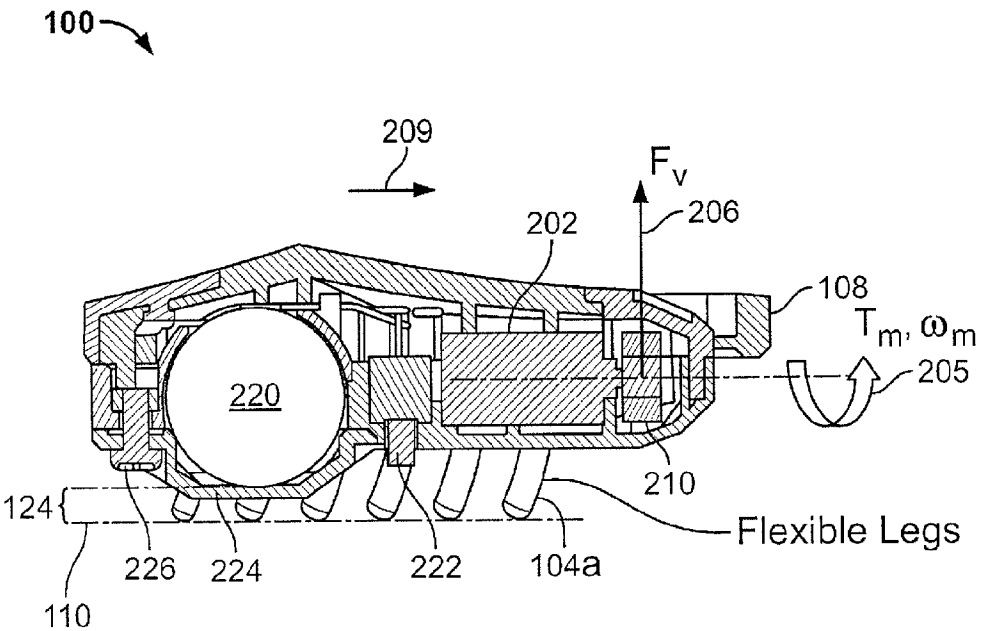

FIG. 2A shows a side view of the example device 100 shown in FIG. 1 and further depicts a rotational moment 205 (represented by the rotational velocity $\omega_m$ and motor torque $T_m$) and a vertical force 206 represented by $F_v$. FIG. 2B shows a top view of the example device 100 shown in FIG. 1 and further shows a horizontal force 208 represented by $F_h$. Generally, a negative $F_v$ is caused by upward movement of the eccentric load as it rotates, while a positive $F_v$ can be caused by the downward movement of the eccentric load and/or the resiliency of the legs (e.g., as they spring back from a deflected position).

The forces $F_v$ and $F_h$ cause the device 100 to move in a direction that is consistent with the configuration in which the leg base 106*b* is positioned in front of the leg tip 106*a*. The direction and speed in which the device 100 moves can depend, at least in part, on the direction and magnitude of $F_v$ and $F_h$. When the vertical force 206, $F_v$, is negative, the device 100 body is forced down. This negative $F_v$ causes at least the front legs 104*a* to bend and compress. The legs generally compress along a line in space from the leg tip to the leg base. As a result, the body will lean so that the leg bends (e.g., the leg base 106*b* flexes (or deflects) about the leg tip 106*a* towards the surface 110) and causes the body to move forward (e.g., in a direction from the leg tip 106*a* towards the leg base 106*b*). $F_v$, when positive, provides an upward force on the device 100 allowing the energy stored in the compressed legs to release (lifting the device), and at the same time allowing the legs to drag or hop forward to their original position. The lifting force $F_v$ on the device resulting from the rotation of the eccentric load combined with the spring-like leg forces are both involved in allowing the vehicle to hop vertically off the surface (or at least reducing the load on the front legs 104*a*) and allowing the legs 104 to return to their normal geometry (i.e., as a result of the resiliency of the legs). The release of the spring-like leg forces, along with the forward momentum created as the legs bend, propels the vehicle forward and upward, based on the angle of the line connecting the leg tip to the leg base, lifting the front legs 104*a* off the surface 110 (or at least reducing the load on the front legs 104*a*) and allowing the legs 104 to return to their normal geometry (i.e., as a result of the resiliency of the legs).

Generally, two "driving" legs (e.g., the front legs 104*a*, one on each side) are used, although some implementations may include only one driving leg or more than two driving legs. Which legs constitute driving legs can, in some implementations, be relative. For example, even when only one driving leg is used, other legs may provide a small amount of forward driving forces. During the forward motion, some legs 104 may tend to drag rather than hop. Hop refers to the result of the motion of the legs as they bend and compress and then return to their normal configuration—depending on the magnitude of $F_v$, the legs can either stay in contact with the surface or lift off the surface for a short period of time as the nose is elevated. For example, if the eccentric load is located toward the front of the device 100, then the front of the device 100 can hop slightly, while the rear of the device 100 tends to drag. In some cases, however, even with the eccentric load located toward the front of the device 100, even the back legs 104*c* may sometimes hop off the surface, albeit to a lesser extent than the front legs 104*a*. Depending on the stiffness or resiliency of the legs, the speed of rotation of the rotational motor, and the degree to which a particular hop is in phase or out of phase with the rotation of the motor, a hop can range in duration from less than the time required for a full rotation of the motor to the time required for multiple rotations of the motor. During a hop, rotation of the eccentric load can cause the device to move laterally in one direction or the other (or both at different times during the rotation) depending on the lateral direction of rotation at any particular time and to move up or down (or both at different times during the rotation) depending on the vertical direction of rotation at any particular time.

Increasing hop time can be a factor in increasing speed. The more time that the vehicle spends with some of the leg off the surface 110 (or lightly touching the surface), the less time some of the legs are dragging (i.e., creating a force opposite the direction of forward motion) as the vehicle translates forward. Minimizing the time that the legs drag forward (as opposed to hop forward) can reduce drag caused by friction of the legs sliding along the surface 110. In addition, adjusting the CG of the device fore and aft can effect whether the vehicle hops with the front legs only, or whether the vehicle hops with most, if not all, of the legs off the ground. This balancing of the hop can take into account the CG, the mass of the offset weight and its rotational frequency, $F_v$ and its location, and hop forces and their location(s).

Turning of Device

The motor rotation also causes a lateral force 208, $F_h$, which generally shifts back and forth as the eccentric load rotates. In general, as the eccentric load rotates (e.g., due to the motor 202), the left and right horizontal forces 208 are equal. The turning that results from the lateral force 208 on average typically tends to be greater in one direction (right or left) while the device's nose 108 is elevated, and greater in the opposite direction when the device's nose 108 and the legs 104 are compressed down. During the time that the center of the eccentric load 210 is traveling upward (away from the surface 110), increased downward forces are applied to the legs 104, causing the legs 104 to grip the surface 110, minimizing lateral turning of the device 100, although the legs may slightly bend laterally depending on the stiffness of the legs 104. During the time when the eccentric load 210 is traveling downward, the downward force on the legs 104 decreases, and downward force of the legs 104 on the surface 110 can be reduced, which can allow the device to turn laterally during the time the downward force is reduced. The direction of turning generally depends on the direction of the average lateral forces caused by the rotation of the eccentric load 210 during the time when the vertical forces are positive relative to when the vertical forces are negative. Thus, the horizontal force 208, $F_h$, can cause the device 100 to turn slightly more when the nose 108 is elevated. When the nose 108 is elevated, the leg tips are either off the surface 110 or less downward force is on the front legs 104*a* which precludes or reduces the ability of the leg tips (e.g., leg tip 106*a*) to "grip" the surface 110 and to provide lateral resistance to turning. Features can be implemented to manipulate several motion characteristics to either counteract or enhance this tendency to turn.

The location of the CG can also influence a tendency to turn. While some amount of turning by the device 100 can be a desired feature (e.g., to make the device's movement appear random), excessive turning can be undesirable. Several design considerations can be made to compensate for (or in some cases to take advantage of) the device's tendency to turn. For example, the weight distribution of the device 100, or more specifically, the device's CG, can affect the tendency of the device 100 to turn. In some implementations, having CG relatively near the center of the device 100 and roughly centered about the legs 104 can increase a tendency for the device 100 to travel in a relatively straight direction (e.g., not spinning around).

Tuning the drag forces for different legs 104 is another way to compensate for the device's tendency to turn. For example, the drag forces for a particular leg 104 can depend on the leg's length, thickness, stiffness and the type of material from which the leg is made. In some implementations, the stiffness of different legs 104 can be tuned differently, such as having different stiffness characteristics for the front legs 104*a*, rear legs 104*c* and middle legs 104*b*. For example, the stiffness characteristics of the legs can be altered or tuned based on the thickness of the leg or the material used for the leg. Increasing the drag (e.g., by increasing a leg length, thickness, stiffness, and/or frictional characteristic) on one side of the device (e.g., the right side) can help compensate for a tendency of the device to turn (e.g., to the left) based on the force $F_h$ induced by the rotational motor and eccentric load.

Altering the position of the rear legs 104*c* is another way to compensate for the device's tendency to turn. For example, placing the legs 104 further toward the rear of the device 100 can help the device 100 travel in a more straight direction. Generally, a longer device 100 that has a relatively longer distance between the front and rear legs 104*c* may tend to travel in more of a straight direction than a device 100 that is shorter in length (i.e., the front legs 104*a* and rear legs 104*c* are closer together), at least when the rotating eccentric load is located in a relatively forward position on the device 100. The relative position of the rearmost legs 104 (e.g., by placing the rearmost leg on one side of the device farther forward or backward on the device than the rearmost leg on the other side of the device) can also help compensate for (or alter) the tendency to turn.

Various techniques can also be used to control the direction of travel of the device 100, including altering the load on specific legs, adjusting the number of legs, leg lengths, leg positions, leg stiffness, and drag coefficients. As illustrated in FIG. 2B, the lateral horizontal force 208, $F_h$, causes the device 100 to have a tendency to turn as the lateral horizontal force 208 generally tends to be greater in one direction than the other during hops. The horizontal force 208, $F_h$ can be countered to make the device 100 move in an approximately straight direction. This result can be accomplished with adjustments to leg geometry and leg material selection, among other things.

Figure 2D:
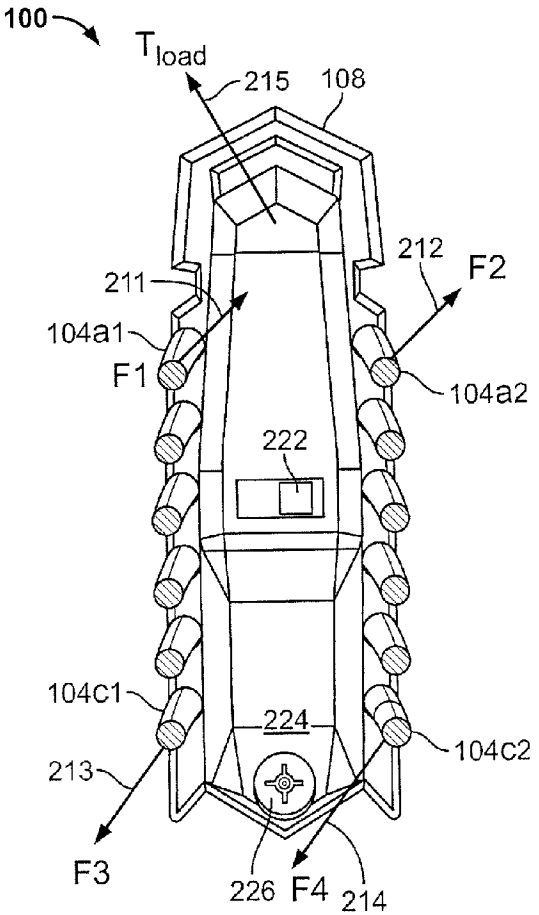
Figure 2C:
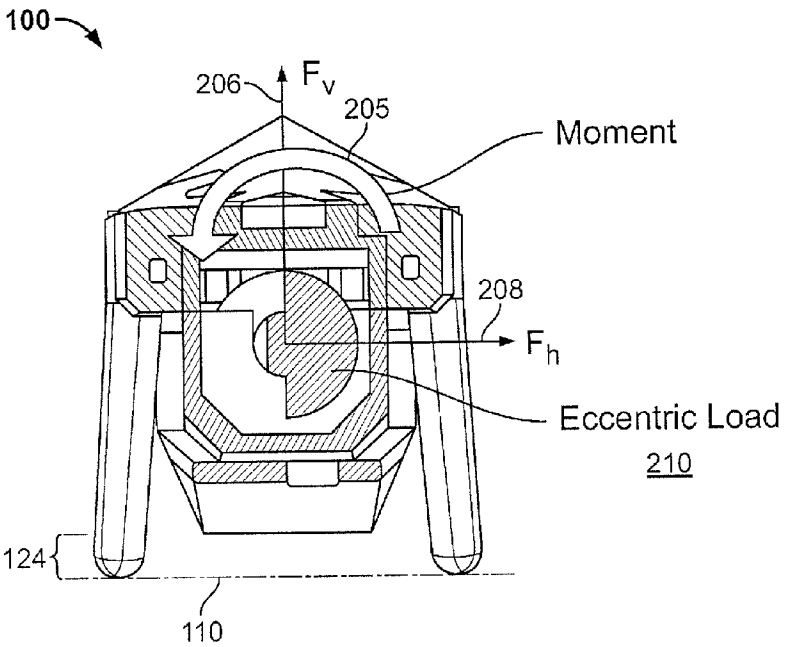

FIG. 2C is a diagram that shows a rear view of the device 100 and further illustrates the relationship of the vertical force 206 $F_v$ and the horizontal force 208 $F_h$ in relation to each other. This rear view also shows the eccentric load 210 that is rotated by the rotational motor 202 to generate vibration, as indicated by the rotational moment 205.

Drag Forces

FIG. 2D is a diagram that shows a bottom view of the device 100 and further illustrates example leg forces 211-214 that are involved with direction of travel of the device 100. In combination, the leg forces 211-214 can induce velocity vectors that impact the predominant direction of travel of the device 100. The velocity vector 215, represented by $T_{load}$, represents the velocity vector that is induced by the motor/eccentricity rotational velocity (e.g., induced by the offset load attached to the motor) as it forces the driving legs 104 to bend, causing the device to lunge forward, and as it generates greater lateral forces in one direction than the other during hopping. The leg forces 211-214, represented by $F_1$-$F_4$, represent the reactionary forces of the legs 104*a*1-104*c*2, respectively, that can be oriented so the legs 104*a*1-104*c*2, in combination, induce an opposite velocity vector relative to $T_{load}$. As depicted in FIG. 2D, $T_{load}$ is a velocity vector that tends to steer the device 100 to the left (as shown) due to the tendency for there to be greater lateral forces in one direction than the other when the device is hopping off the surface 110. At the same time, the forces $F_1$-$F_2$ for the front legs 104*a*1 and 104*a*2 (e.g., as a result of the legs tending to drive the device forward and slightly laterally in the direction of the eccentric load 210 when the driving legs are compressed) and the forces $F_3$-$F_4$ for the rear legs 104*c*1 and 104*c*2 (as a result of drag) each contribute to steering the device 100 to the right (as shown). (As a matter of clarification, because FIG. 2D shows the bottom view of the device 100, the left-right directions when the device 100 is placed upright are reversed.) In general, if the combined forces $F_1$-$F_4$ approximately offset the side component of $T_{load}$, then the device 100 will tend to travel in a relatively straight direction.

Controlling the forces $F_1$-$F_4$ can be accomplished in a number of ways. For example, the "push vector" created by the front legs 104*a*1 and 104*a*2 can be used to counter the lateral component of the motor-induced velocity. In some implementations, this can be accomplished by placing more weight on the front leg 104*a*2 to increase the leg force 212, represented by $F_2$, as shown in FIG. 2D. Furthermore, a "drag vector" can also be used to counter the motor-induced velocity. In some implementations, this can be accomplished by increasing the length of the rear leg 104*c*2 or increasing the drag coefficient on the rear leg 104*c*2 for the force vector 804, represented by $F_4$, in FIG. 2D. As shown, the legs 104*a*1 and 104*a*2 are the device's front right and left legs, respectively, and the legs 104*c*1 and 104*c*2 are the device's rear right and left legs, respectively.

Another technique for compensating for the device's tendency to turn is increasing the stiffness of the legs 104 in various combinations (e.g., by making one leg thicker than another or constructing one leg using a material having a naturally greater stiffness). For example, a stiffer leg will have a tendency to bounce more than a more flexible leg. Left and right legs 104 in any leg pair can have different stiffnesses to compensate for the turning of the device 100 induced by the vibration of the motor 202. Stiffer front legs 104*a* can also produce more bounce.

Another technique for compensating for the device's tendency to turn is to change the relative position of the rear legs 104*c*1 and 104*c*2 so that the drag vectors tend to compensate for turning induced by the motor velocity. For example, the rear leg 104*c*2 can be placed farther forward (e.g., closer to the nose 108) than the rear leg 104*c*1.

Leg Shape

Leg geometry contributes significantly to the way in which the device 100 moves. Aspects of leg geometry include: locating the leg base in front of the leg tip, curvature of the legs, deflection properties of the legs, configurations that result in different drag forces for different legs, including legs that do not necessarily touch the surface, and having only three legs that touch the surface, to name a few examples.

Generally, depending on the position of the leg tip 106*a* relative to the leg base 106*b*, the device 100 can experience different behaviors, including the speed and stability of the device 100. For example, if the leg tip 106*a* is nearly directly below the leg base 106*b* when the device 100 is positioned on a surface, movement of the device 100 that is caused by the motor 202 can be limited or precluded. This is because there is little or no slope to the line in space that connects the leg tip 106*a* and the leg base 106*b*. In other words, there is no "lean" in the leg 104 between the leg tip 106*a* and the leg base 106*b*. However, if the leg tip 106*a* is positioned behind the leg base 106*b* (e.g., farther from the nose 108), then the device 100 can move faster, as the slope or lean of the legs 104 is increased, providing the motor 202 with a leg geometry that is more conducive to movement. In some implementations, different legs 104 (e.g., including different pairs, or left legs versus right legs) can have different distances between leg tips 106*a* and leg bases 106*b*.

In some implementations, the legs 104 are curved (e.g., leg 104*a* shown in FIG. 2A, and legs 104 shown in FIG. 1). For example, because the legs 104 are typically made from a flexible material, the curvature of the legs 104 can contribute to the forward motion of the device 100. Curving the leg can accentuate the forward motion of the device 100 by increasing the amount that the leg compresses relative to a straight leg. This increased compression can also increase vehicle hopping, which can also increase the tendency for random motion, giving the device an appearance of intelligence and/or a more life-like operation. The legs can also have at least some degree of taper from the leg base 106*b* to the leg tip 106*a*, which can facilitate easier removal from a mold during the manufacturing process.

The number of legs can vary in different implementations. In general, increasing the number of legs 104 can have the effect of making the device more stable and can help reduce fatigue on the legs that are in contact with the surface 110. Increasing the number of legs can also affect the location of drag on the device 100 if additional leg tips 106*a* are in contact with the surface 110. In some implementations, however, some of the legs (e.g., middle legs 104*b*) can be at least slightly shorter than others so that they tend not to touch the surface 110 or contribute less to overall friction that results from the leg tips 106*a* touching the surface 110. For example, in some implementations, the two front legs 104*a* (e.g., the "driving" legs) and at least one of the rear legs 104*c* are at least slightly longer than the other legs. This configuration helps increase speed by increasing the forward driving force of the driving legs. In general, the remaining legs 104 can help prevent the device 100 from tipping over by providing additional resiliency should the device 100 start to lean toward one side or the other.

In some implementations, one or more of the "legs" can include any portion of the device that touches the ground. For example, the device 100 can include a single rear leg (or multiple rear legs) constructed from a relatively inflexible material (e.g., rigid plastic), which can resemble the front legs or can form a skid plate designed to simply drag as the front legs 104*a* provide a forward driving force. The oscillating eccentric load can repeat tens to several hundred times per second, which causes the device 100 to move in a generally forward motion as a result of the forward momentum generated when $F_v$ is negative.

Leg geometry can be defined and implemented based on ratios of various leg measurements, including leg length, diameter, and radius of curvature. One ratio that can be used is the ratio of the radius of curvature of the leg 104 to the leg's length. As just one example, if the leg's radius of curvature is 49.14 mm and the leg's length is 10.276 mm, then the ratio is 4.78. In another example, if the leg's radius of curvature is 2.0 inches and the leg's length is 0.4 inches, then the ratio is 5.0. Other leg 104 lengths and radii of curvature can be used, such as to produce a ratio of the radius of curvature to the leg's length that leads to suitable movement of the device 100. In general, the ratio of the radius of curvature to the leg's length can be in the range of 2.5 to 20.0. The radius of curvature can be approximately consistent from the leg base to the leg tip. This approximate consistent curvature can include some variation, however. For example, some taper angle in the legs may be required during manufacturing of the device (e.g., to allow removal from a mold). Such a taper angle may introduce slight variations in the overall curvature that generally do not prevent the radius of curvature from being approximately consistent from the leg base to the leg tip.

Another ratio that can be used to characterize the device 100 is a ratio that relates leg 104 length to leg diameter or thickness (e.g., as measured in the center of the leg or as measured based on an average leg diameter throughout the length of the leg and/or about the circumference of the leg). For example, the length of the legs 104 can be in the range of 0.2 inches to 0.8 inches (e.g., 0.405 inches) and can be proportional to (e.g., 5.25 times) the leg's thickness in the range of 0.03 to 0.15 inch (e.g., 0.077 inch). Stated another way, legs 104 can be about 15% to 25% as thick as they are long, although greater or lesser thicknesses (e.g., in the range of 5% to 60% of leg length) can be used. Leg 104 lengths and thicknesses can further depend on the overall size of the device 100. In general, at least one driving leg can have a ratio of the leg length to the leg diameter in the range of 2.0 to 20.0 (i.e., in the range of 5% to 50% of leg length). In some implementations, a diameter of at least 10% of the leg length may be desirable to provide sufficient stiffness to support the weight of the device and/or to provide desired movement characteristics.

Leg Material

The legs are generally constructed of rubber or other flexible but resilient material (e.g., polystyrene-butadiene-styrene with a durometer near 65, based on the Shore A scale, or in the range of 55-75, based on the Shore A scale). Thus, the legs tend to deflect when a force is applied. Generally, the legs include a sufficient stiffness and resiliency to facilitate consistent forward movement as the device vibrates (e.g., as the eccentric load 210 rotates). The legs 104 are also sufficiently stiff to maintain a relatively wide stance when the device 100 is upright yet allow sufficient lateral deflection when the device 100 is on its side to facilitate self-righting, as further discussed below.

The selection of leg materials can have an effect on how the device 100 moves. For example, the type of material used and its degree of resiliency can affect the amount of bounce in the legs 104 that is caused by the vibration of the motor 202 and the counterweight 210. As a result, depending on the material's stiffness (among other factors, including positions of leg tips 106*b* relative to leg bases 106*a*), the speed of the device 100 can change. In general, the use of stiffer materials in the legs 104 can result in more bounce, while more flexible materials can absorb some of the energy caused by the vibration of the motor 202, which can tend to decrease the speed of the device 100.

Frictional Characteristics

Friction (or drag) force equals the coefficient of friction multiplied by normal force. Different coefficients of friction and the resulting friction forces can be used for different legs. As an example, to control the speed and direction (e.g., tendency to turn, etc.), the leg tips 106*a* can have varying coefficients of friction (e.g., by using different materials) or drag forces (e.g., by varying the coefficients of friction and/or the average normal force for a particular leg). These differences can be accomplished, for example, by the shape (e.g., pointedness or flatness, etc.) of the leg tips 106*a* as well as the material of which they are made. Front legs 104*a*, for example, can have a higher friction than the rear legs 104*c*. Middle legs 104*b* can have yet different friction or can be configured such that they are shorter and do not touch the surface 110, and thus do not tend to contribute to overall drag. Generally, because the rear legs 104*c* (and the middle legs 104*b* to the extent they touch the ground) tend to drag more than they tend to create a forward driving force, lower coefficients of friction and lower drag forces for these legs can help increase the speed of the device 100. Moreover, to offset the motor force 215, which can tend to pull the device in a left or right direction, left and right legs 104 can have different friction forces. Overall, coefficients of friction and the resulting friction force of all of the legs 104 can influence the overall speed of the device 100. The number of legs 104 in the device 100 can also be used to determine coefficients of friction to have in (or design into) each of the individual legs 104. As discussed above, the middle legs 104*b* do not necessarily need to touch the surface 110. For example, middle (or front or back) legs 104 can be built into the device 100 for aesthetic reasons, e.g., to make the device 100 appear more life-like, and/or to increase device stability. In some implementations, devices 100 can be made in which only three (or a small number of) legs 104 touch the ground, such as two front legs 104*a* and one or two rear legs 104*c*.

The motor 202 is coupled to and rotates a counterweight 210, or eccentric load, that has a CG that is off axis relative to the rotational axis of the motor 202. The rotational motor 202 and counterweight 210, in addition to being adapted to propel the device 100, can also cause the device 100 to tend to roll, e.g., about the axis of rotation of the rotational motor 200. The rotational axis of the motor 202 can have an axis that is approximately aligned with a longitudinal CG of the device 100, which is also generally aligned with a direction of movement of the device 100.

FIG. 2A also shows a battery 220 and a switch 222. The battery 220 can provide power to the motor 202, for example, when the switch 222 is in the "ON" position, thus connecting an electrical circuit that delivers electric current to the motor 202. In the "OFF" position of the switch 222, the circuit is broken, and no power reaches the motor 202. The battery 220 can be located within or above a battery compartment cover 224, accessible, for example, by removing a screw 226, as shown in FIGS. 2A and 2D. The placement of the battery 220 and the switch 222 partially between the legs of the device 100 can lower the device's CG and help to prevent tipping. Locating the motor 202 lower within the device 100 also reduces tipping. Having legs 104 on the sides of a vehicle 100 provides a space (e.g., between the legs 104) to house the battery 220, the motor 204 and the switch 222. Positioning these components 204, 220 and 222 along the underside of the device 100 (e.g., rather than on top of the device housing) effectively lowers the CG of the device 100 and reduces its likelihood of tipping.

The device 100 can be configured such that the CG is selectively positioned to influence the behavior of the device 100. For example, a lower CG can help to prevent tipping of the device 100 during its operation. As an example, tipping can occur as a result of the device 100 moving at a high rate of speed and crashing into an obstacle. In another example, tipping can occur if the device 100 encounters a sufficiently irregular area of the surface on which it is operating. The CG of the device 100 can be selectively manipulated by positioning the motor, switch, and battery in locations that provide a desired CG, e.g., one that reduces the likelihood of inadvertent tipping. In some implementations, the legs can be configured so that they extend from the leg tip 106*a* below the CG to a leg base 106*b* that is above the CG, allowing the device 100 to be more stable during its operation. The components of the device 100 (e.g., motor, switch, battery, and housing) can be located at least partially between the legs to maintain a lower CG. In some implementations, the components of the device (e.g., motor, switch and battery) can be arranged or aligned close to the CG to maximize forces caused by the motor 202 and the counterweight 210.

Self-Righting

Self-righting, or the ability to return to an upright position (e.g., standing on legs 104), is another feature of the device 100. For example, the device 100 can occasionally tip over or fall (e.g., falling off a table or a step). As a result, the device 100 can end up on its top or its side. In some implementations, self-righting can be accomplished using the forces caused by the motor 202 and the counterweight 210 to cause the device 100 to roll over back onto its legs 104. Achieving this result can be helped by locating the device's CG proximal to the motor's rotational axis to increase the tendency for the entire device 100 to roll. This self-righting generally provides for rolling in the direction that is opposite to the rotation of the motor 202 and the counterweight 210.

Provided that a sufficient level of roll tendency is produced based on the rotational forces resulting from the rotation of the motor 202 and the counterweight 210, the outer shape of the device 100 can be designed such that rolling tends to occur only when the device 100 is on its right side, top side, or left side. For example, the lateral spacing between the legs 104 can be made wide enough to discourage rolling when the device 100 is already in the upright position. Thus, the shape and position of the legs 104 can be designed such that, when self-righting occurs and the device 100 again reaches its upright position after tipping or falling, the device 100 tends to remain upright. In particular, by maintaining a flat and relatively wide stance in the upright position, upright stability can be increased, and, by introducing features that reduce flatness when not in an upright position, the self-righting capability can be increased.

To assist rolling from the top of the device 100, a high point 120 or a protrusion can be included on the top of the device 100. The high point 120 can prevent the device from resting flat on its top. In addition, the high point 120 can prevent $F_h$ from becoming parallel to the force of gravity, and as a result, $F_h$ can provide enough moment to cause the device to roll, enabling the device 100 to roll to an upright position or at least to the side of the device 100. In some implementations, the high point 120 can be relatively stiff (e.g., a relatively hard plastic), while the top surface of the head 118 can be constructed of a more resilient material that encourages bouncing. Bouncing of the head 118 of the device when the device is on its back can facilitate self-righting by allowing the device 100 to roll due to the forces caused by the motor 202 and the counterweight 210 as the head 118 bounces off the surface 110.

Rolling from the side of the device 100 to an upright position can be facilitated by using legs 104 that are sufficiently flexible in combination with the space 124 (e.g., underneath the device 100) for lateral leg deflection to allow the device 100 to roll to an upright position. This space can allow the legs 104 to bend during the roll, facilitating a smooth transition from side to bottom. The shoulders 112 on the device 100 can also decrease the tendency for the device 100 to roll from its side onto its back, at least when the forces caused by the motor 202 and the counterweight 210 are in a direction that opposes rolling from the side to the back. At the same time, the shoulder on the other side of the device 100 (even with the same configuration) can be designed to avoid preventing the device 100 from rolling onto its back when the forces caused by the motor 202 and the counterweight 210 are in a direction that encourages rolling in that direction. Furthermore, use of a resilient material for the shoulder can increase bounce, which can also increase the tendency for self-righting (e.g., by allowing the device 100 to bounce off the surface 110 and allowing the counterweight forces to roll the device while airborne). Self-righting from the side can further be facilitated by adding appendages along the side(s) of the device 100 that further separate the rotational axis from the surface and increase the forces caused by the motor 202 and the counterweight 210.

The position of the battery on the device 100 can affect the device's ability to roll and right itself. For example, the battery can be oriented on its side, positioned in a plane that is both parallel to the device's direction of movement and perpendicular to the surface 110 when the device 100 is upright. This positioning of the battery in this manner can facilitate reducing the overall width of the device 100, including the lateral distance between the legs 104, making the device 100 more likely to be able to roll.

FIG. 4 shows an example front view indicating a center of gravity (CG) 402, as indicated by a large plus sign, for the device 100. This view illustrates a longitudinal CG 402 (i.e., a location of a longitudinal axis of the device 100 that runs through the device CG). In some implementations, the vehicle's components are aligned to place the longitudinal CG close to (e.g., within 5-10% as a percentage of the height of the vehicle) the physical longitudinal centerline of the vehicle, which can reduce the rotational moment of inertia of the vehicle, thereby increasing or maximizing the forces on the vehicle as the rotational motor rotates the eccentric load. As discussed above, this effect increases the tendency of the device 100 to roll, which can enhance the self-righting capability of the device. FIG. 4 also shows a space 404 between the legs 104 and the underside 122 of the vehicle 100 (including the battery compartment cover 224), which can allow the legs 104 to bend inward when the device is on its side, thereby facilitating self-righting of the device 100. FIG. 4 also illustrates a distance 406 between the pairs or rows of legs 104. Increasing the distance 406 can help prevent the vehicle 100 from tipping. However, keeping the distance 406 sufficiently low, combined with flexibility of the legs 104, can improve the vehicle's ability to self-right after tipping. In general, to prevent tipping, the distance 406 between pairs of legs needs to be increased proportionally as the CG 402 is raised.

The vehicle high point 120 is also shown in FIG. 4. The size or height of the high point 120 can be sufficiently large enough to prevent the device 100 from simply lying flat on its back after tipping, yet sufficiently small enough to help facilitate the device's roll and to force the device 100 off its back after tipping. A larger or higher high point 120 can be better tolerated if combined with "pectoral fins" or other side protrusions to increase the "roundness" of the device.

The tendency to roll of the device 100 can depend on the general shape of the device 100. For example, a device 100 that is generally cylindrical, particularly along the top of the device 100, can roll relatively easily. Even if the top of the device is not round, as is the case for the device shown in FIG. 4 that includes straight top sides 407*a* and 407*b*, the geometry of the top of the device 100 can still facilitate rolling. This is especially true if distances 408 and 410 are relatively equal and each approximately defines the radius of the generally cylindrical shape of the device 100. Distance 408, for example, is the distance from the device's longitudinal CG 402 to the top of the shoulder 112. Distance 410 is the distance from the device's longitudinal CG 402 to the high point 120. Further, having a length of surface 407*b* (i.e., between the top of the shoulder 112 and the high point 120) that is less than the distances 408 and 410 can also increase the tendency of the device 100 to roll. Moreover, if the device's longitudinal CG 402 is positioned relatively close to the center of the cylinder that approximates the general shape of the device 100, then roll of the device 100 is further enhanced, as the forces caused by the motor 202 and the counterweight 210 are generally more centered. The device 100 can stop rolling once the rolling action places the device 100 on its legs 104, which provide a wide stance and serve to interrupt the generally cylindrical shape of the device 100.

Figure 5:
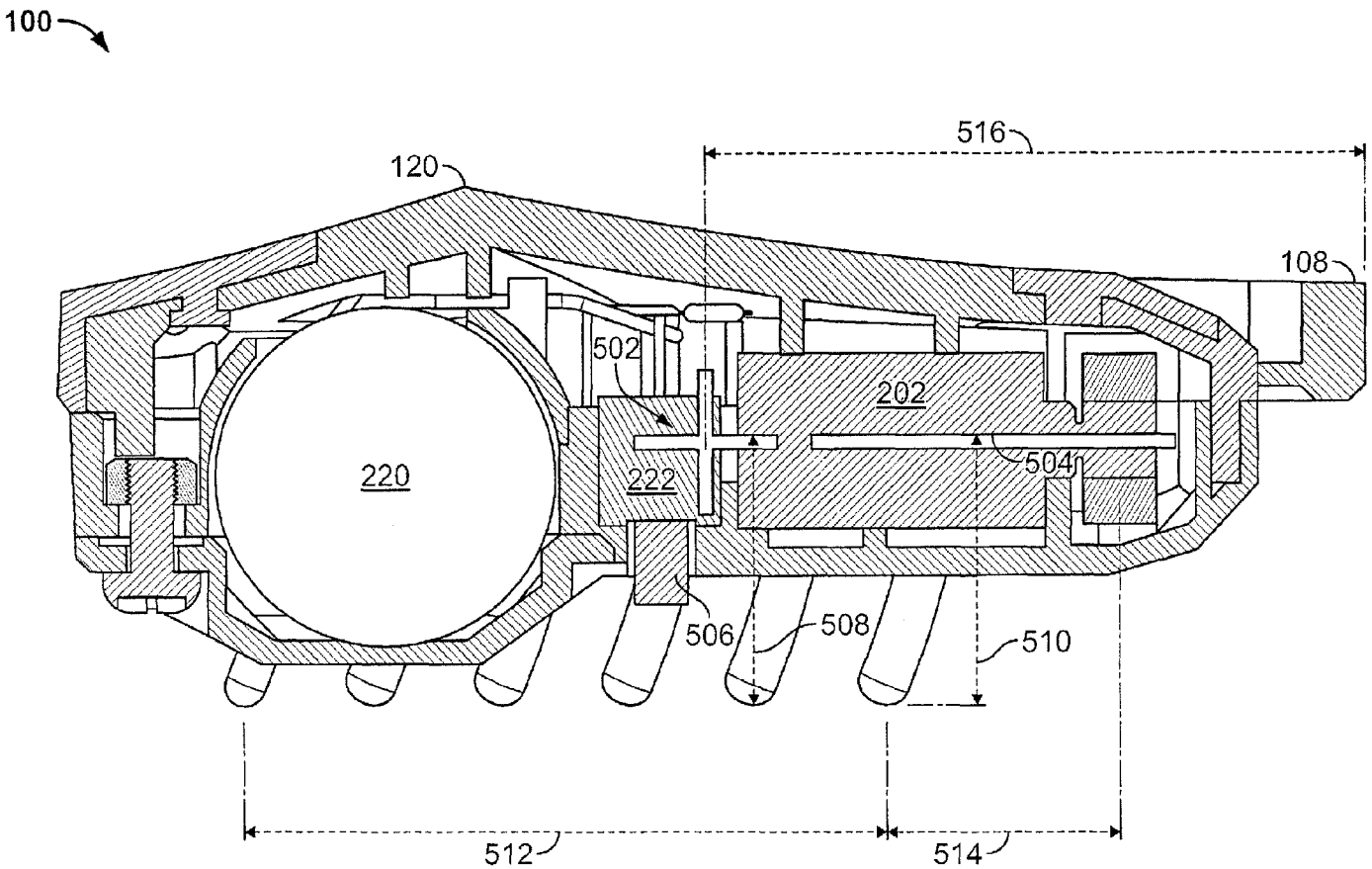
FIG. 5 shows an example side view indicating a center of gravity for the device.

FIG. 5 shows an example side view indicating a center of gravity (CG) 502, as indicated by a large plus sign, for the device 100. This view also shows a motor axis 504 which, in this example, closely aligns with the longitudinal component of the CG 502. The location of the CG 502 depends on, e.g., the mass, thickness, and distribution of the materials and components included in the device 100. In some implementations, the CG 502 can be farther forward or farther back from the location shown in FIG. 5. For example, the CG 502 can be located toward the rear end of the switch 222 rather than toward the front end of the switch 222 as illustrated in FIG. 5. In general, the CG 502 of the device 100 can be sufficiently far behind the front driving legs 104*a* and the rotating eccentric load (and sufficiently far in front of the rear legs 104*c*) to facilitate front hopping and rear drag, which can increase forward drive and provide a controlled tendency to go straight (or turn if desired) during hops. For example, the CG 502 can be positioned roughly halfway (e.g., in the range of roughly 40-60% of the distance) between the front driving legs 104*a* and the rear dragging legs 104*c*. Also, aligning the motor axis with the longitudinal CG can enhance forces caused by the motor 202 and the counterweight. In some implementations, the longitudinal component of the CG 502 can be near to the center of the height of the device (e.g., within about 3% of the CG as a proportion of the height of the device). Generally, configuring the device 100 such that the CG 502 is closer to the center of the height of the device will enhance the rolling tendency, although greater distances (e.g., within about 5% or within about 20% of the CG as a proportion of the height of the device) are acceptable in some implementations. Similarly, configuring the device 100 such that the CG 502 is within about 3-6% of the motor axis 504 as a percentage of the height of the device can also enhance the rolling tendency.

FIG. 5 also shows an approximate alignment of the battery 220, the switch 222 and the motor 202 with the longitudinal component of the CG 502. Although a sliding switch mechanism 506 that operates the on/off switch 222 hangs below the underside of the device 100, the overall approximate alignment of the CG of the individual components 220, 222 and 202 (with each other and with the CG 502 of the overall device 100) contributes to the ability of the device 100 to roll, and thus right itself. In particular, the motor 202 is centered primarily along the longitudinal component of the CG 502.

In some implementations, the high point 120 can be located behind the CG 502, which can facilitate self-righting in combination with the eccentric load attached to the motor 202 being positioned near the nose 108. As a result, if the device 100 is on its side or back, the nose end of the device 100 tends to vibrate and bounce (more so than the tail end of the device 100), which facilitates self-righting as the forces of the motor and eccentric load tend to cause the device to roll.

FIG. 5 also shows some of the sample dimensions of the device 100. For example, a distance 508 between the CG 502 and a plane that passes through the leg tips 106*a* on which the device 100 rests when upright on a flat surface 110 can be approximately 0.36 inches. In some implementations, this distance 508 is approximately 50% of the total height of the device (see FIGS. 7A & 7B), although other distances 508 may be used in various implementations (e.g., from about 40-60%). A distance 510 between the rotational axis 504 of the motor 202 and the same plane that passes through the leg tips 106*a* is approximately the same as the distance 508, although variations (e.g., 0.34 inches for distance 510 vs. 0.36 inches for distance 508) may be used without materially impacting desired functionality. Greater variations (e.g., 0.05 inches or even 0.1 inches) may be used in some implementations.

A distance 512 between the leg tip 106*a* of the front driving legs 104*a* and the leg tip 106*a* of the rearmost leg 104*c* can be approximately 0.85 inches, although various implementations can include other values of the distance 512 (e.g., between about 40% and about 75% of the length of the device 100). In some implementations, locating the front driving legs 104*a* behind the eccentric load 210 can facilitate forward driving motion and randomness of motion. For example, a distance 514 between a longitudinal centerline of the eccentric load 210 and the tip 106*a* of the front leg 104*a* can be approximately 0.36 inches. Again, other distances 514 can be used (e.g., between about 5% and about 30% of the length of the device 100 or between about 10% and about 60% of the distance 512). A distance 516 between the front of the device 100 and the CG 502 can be about 0.95 inches. In various implementations, the distance 516 may range from about 40-60% of the length of the device 100, although some implementations may include front or rear protrusions with a low mass that add to the length of the device but do not significantly impact the location of the CG 502 (i.e., therefore causing the CG 502 to be outside of the 40-60% range).

Figure 9A:
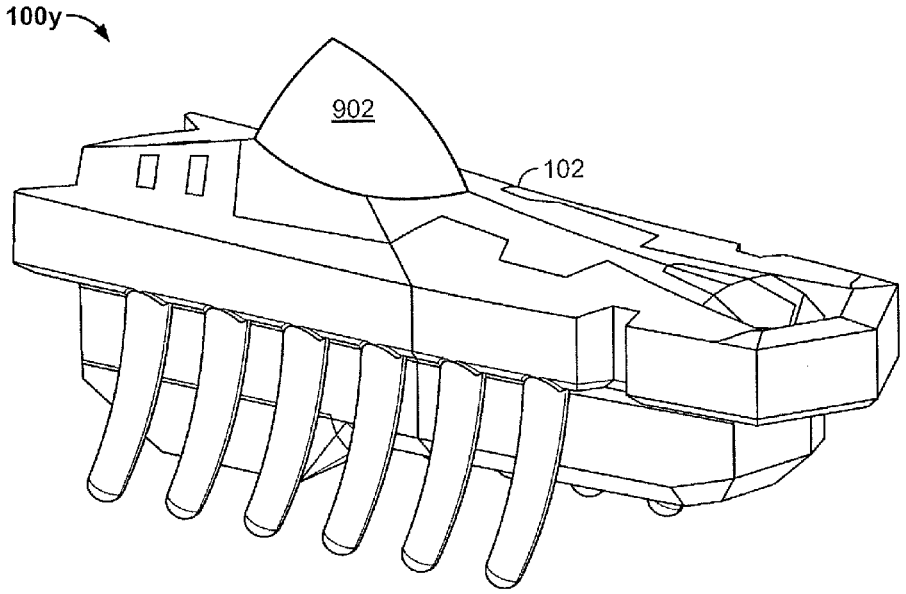
FIGS. 9A and 9B show example devices that include a shark/dorsal fin and a pair of side/pectoral fins, respectively.
Figure 9B:
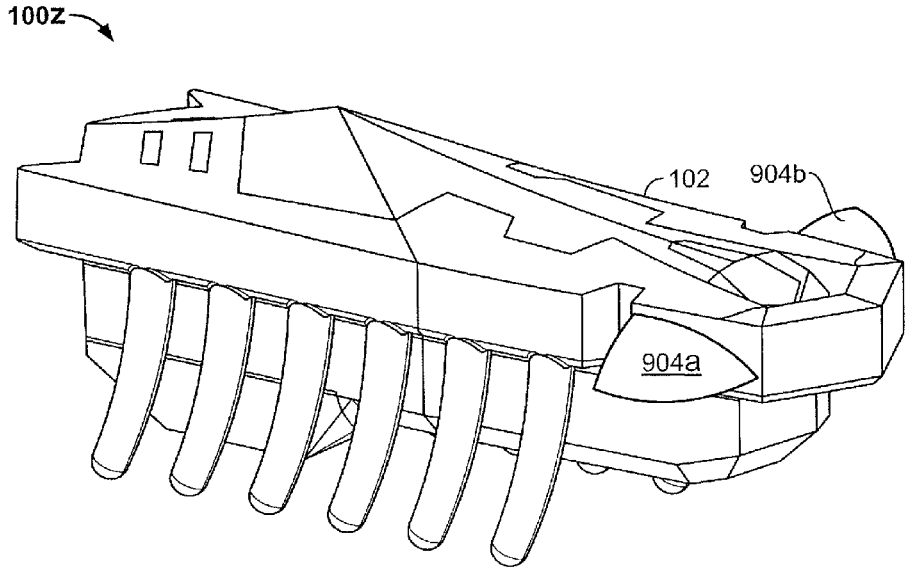

FIGS. 9A and 9B show example devices 100*y* and 100*z* that include, respectively, a shark/dorsal fin 902 and side/pectoral fins 904*a* and 904*b*. As shown in FIG. 9A, the shark/dorsal fin 902 can extend upward from the body 102 so that, if the device 100*y* tips, then the device 100*y* will not end up on its back and can right itself. The side/pectoral fins 904*a* and 904*b* shown in FIG. 9B extend partially outward from the body 102. As a result, if the device 100*z* begins to tip to the device's left or right, then the fin on that side (e.g., fin 904*a* or fin 904*b*) can stop and reverse the tipping action, returning the device 100*z* to its upright position. In addition, the fins 904*a* and 904*b* can facilitate self-righting by increasing the distance between the CG and the surface when the device is on its side. This effect can be enhanced when the fins 904*a* and 904*b* are combined with a dorsal fin 902 on a single device. In this way, fins 902, 904*a* and 904*b* can enhance the self-righting of the devices 100*y* and 100*z*. Constructing the fins 902, 904*a* and 904*b* from a resilient material that increases bounce when the fins are in contact with a surface can also facilitate self-righting (e.g., to help overcome the wider separation between the tips of the fins 902, 904*a* and 904*b*). Fins 902, 904*a* and 904*b* can be constructed of light-weight rubber or plastic so as not to significantly change the device's CG.

Random Motion

By introducing features that increase randomness of motion of the device 100, the device 100 can appear to behave in an animate way, such as like a crawling bug or other organic life-form. The random motion can include inconsistent movements, for example, rather than movements that tend to be in straight lines or continuous circles. As a result, the device 100 can appear to roam about its surroundings (e.g. in an erratic or serpentine pattern) instead of moving in predictable patterns. Random motion can occur, for example, even while the device 100 is moving in one general direction.

In some implementations, randomness can be achieved by changing the stiffness of the legs 104, the material used to make the legs 104, and/or by adjusting the inertial load on various legs 104. For example, as leg stiffness is reduced, the amount of device hopping can be reduced, thus reducing the appearance of random motion. When the legs 104 are relatively stiff, the legs 104 tend to induce hopping, and the device 100 can move in a more inconsistent and random motion.

While the material that is selected for the legs 104 can influence leg stiffness, it can also have other effects. For example, the leg material can be manipulated to attract dust and debris at or near the leg tips 106*a*, where the legs 104 contact the surface 110. This dust and debris can cause the device 100 to turn randomly and change its pattern of motion. This can occur because the dust and debris can alter the typical frictional characteristics of the legs 104.

The inertial load on each leg 104 can also influence randomness of motion of the device 100. As an example, as the inertial load on a particular leg 104 is increased, that portion of the device 100 can hop at higher amplitude, causing the device 100 to land in different locations.

In some implementations, during a hop and while at least some legs 104 of the device 100 are airborne (or at least applying less force to the surface 110), the motor 202 and the counterweight 210 can cause some level of mid-air turning and/or rotating of the device 100. This can provide the effect of the device landing or bouncing in unpredictable ways, which can further lead to random movement.

In some implementations, additional random movement can result from locating front driving legs 104*a* (i.e., the legs that primarily propel the device 100 forward) behind the motor's counterweight. This can cause the front of the device 100 to tend to move in a less straight direction because the counterweight is farther from legs 104 that would otherwise tend to absorb and control its energy. An example lateral distance from the center of the counterweight to the tip of the first leg of 0.36 inches compared to an example leg length of 0.40 inches. Generally, the distance 514 from the longitudinal centerline of the counterweight to the tip 106*a* of the front leg 104*a* may be approximately the same as the length of the leg but the distance 514 can vary in the range of 50-150% of the leg length.

In some implementations, additional appendages can be added to the legs 104 (and to the housing 102) to provide resonance. For example, flexible protrusions that are constantly in motion in this way can contribute to the overall randomness of motion of the device 100 and/or to the lifelike appearance of the device 100. Using appendages of different sizes and flexibilities can magnify the effect.

In some implementations, the battery 220 can be positioned near the rear of the device 100 to increase hop. Doing so positions the weight of the battery 220 over the rearmost legs 104, reducing load on the front legs 104*a*, which can allow for more hop at the front legs 104*a*. In general, the battery 220 can tend to be heavier than the switch 222 and motor 202, thus placement of the battery 220 nearer the rear of the device 100 can elevate the nose 108, allowing the device 100 to move faster.

In some implementations, the on/off switch 222 can be oriented along the bottom side of the device 100 between the battery 220 and the motor 204 such that the switch 222 can be moved back and forth laterally. Such a configuration, for example, helps to facilitate reducing the overall length of the device 100. Having a shorter device can enhance the tendency for random motion.

Speed of Movement

In addition to random motion, the speed of the device 100 can contribute to the life-like appearance of the device 100. Factors that affect speed include the vibration frequency and amplitude that are produced by the motor 202 and counterweight 210, the materials used to make the legs 104, leg length and deflection properties, differences in leg geometry, and the number of legs.

Vibration frequency (e.g., based on motor rotation speed) and device speed are generally directly proportional. That is, when the oscillating frequency of the motor 202 is increased and all other factors are held constant, the device 100 will tend to move faster. An example oscillating frequency of the motor is in the range of 7000 to 9000 rpm.

Leg material has several properties that contribute to speed. Leg material friction properties influence the magnitude of drag force on the device. As the coefficient of friction of the legs increases, the device's overall drag will increase, causing the device 100 to slow down. As such, the use of leg material having properties promoting low friction can increase the speed of the device 100. In some implementations, polystyrene-butadiene-styrene with a durometer near 65 (e.g., based on the Shore A scale) can be used for the legs 104. Leg material properties also contribute to leg stiffness which, when combined with leg thickness and leg length, determines how much hop a device 100 will develop. As the overall leg stiffness increases, the device speed will increase. Longer and thinner legs will reduce leg stiffness, thus slowing the device's speed.

Appearance of Intelligence

"Intelligent" response to obstacles is another feature of the device 100. For example, "intelligence" can prevent a device 100 that comes in contact with an immovable object (e.g., a wall) from futilely pushing against the object. The "intelligence" can be implemented using mechanical design considerations alone, which can obviate the need to add electronic sensors, for example. For example, turns (e.g., left or right) can be induced using a nose 108 that introduces a deflection or bounce in which a device 100 that encounters an obstacle immediately turns to a near incident angle.

In some implementations, adding a "bounce" to the device 100 can be accomplished through design considerations of the nose and the legs 104, and the speed of the device 100. For example, the nose 108 can include a spring-like feature. In some implementations, the nose 108 can be manufactured using rubber, plastic, or other materials (e.g., polystyrene-butadiene-styrene with a durometer near 65, or in the range of 55-75, based on the Shore A scale). The nose 108 can have a pointed, flexible shape that deflects inward under pressure. Design and configuration of the legs 104 can allow for a low resistance to turning during a nose bounce. Bounce achieved by the nose can be increased, for example, when the device 100 has a higher speed and momentum.

In some implementations, the resiliency of the nose 108 can be such that it has an added benefit of dampening a fall should the device 100 fall off a surface 110 (e.g., a table) and land on its nose 108.

Figure 6:
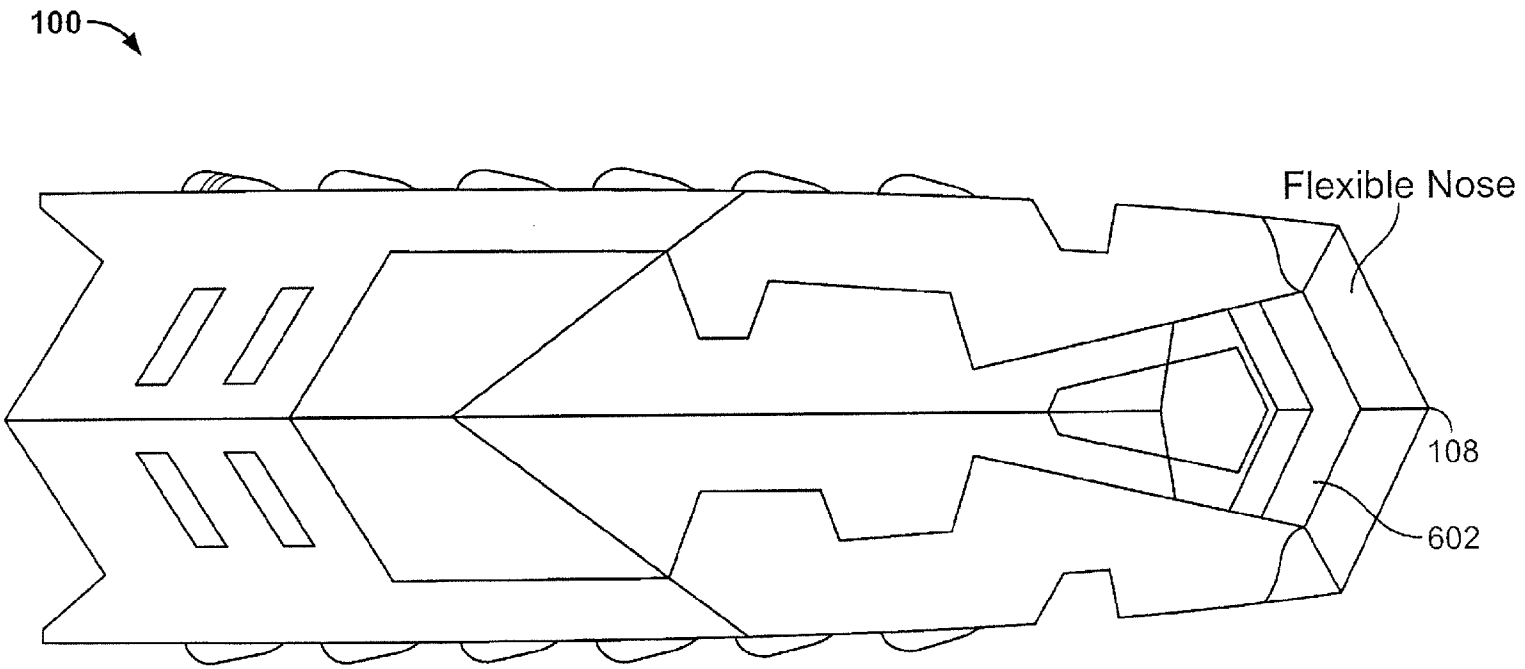
FIG. 6 shows a top view of the device and its flexible nose.

FIG. 6 shows a top view of the vehicle 100 and further shows the flexible nose 108. Depending on the shape and resiliency of the nose 108, the vehicle 100 can more easily deflect off obstacles and remain upright, instead of tipping. The nose 108 can be constructed from rubber or some other relatively resilient material that allows the device to bounce off obstacles. Further, a spring or other device can be placed behind the surface of the nose 108 that can provide an extra bounce. A void or hollow space 602 behind the nose 108 can also contribute to the device's ability to deflect off of obstacles that are encountered nose-first.

Alternative Leg Configurations

Figure 3A:
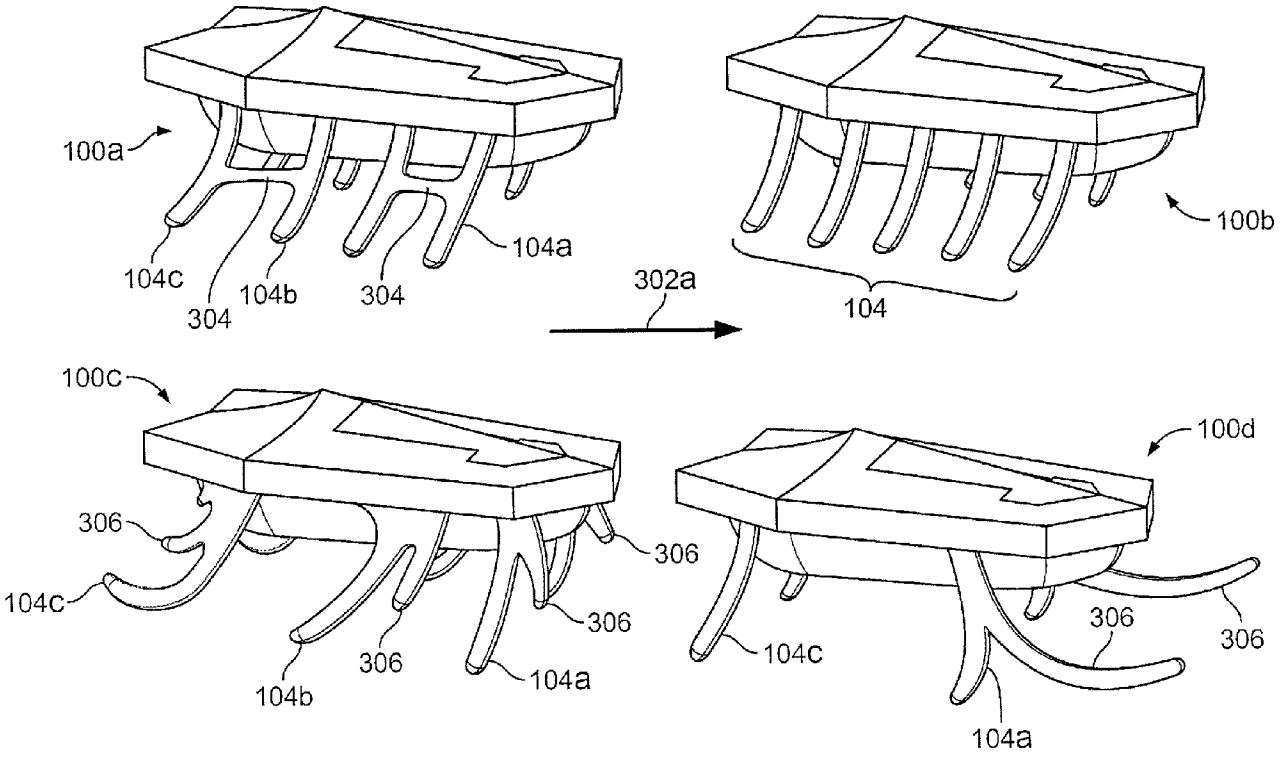
FIGS. 3A through 3C are diagrams that show various examples of alternative leg configurations for vibration powered devices.
Figure 3B:
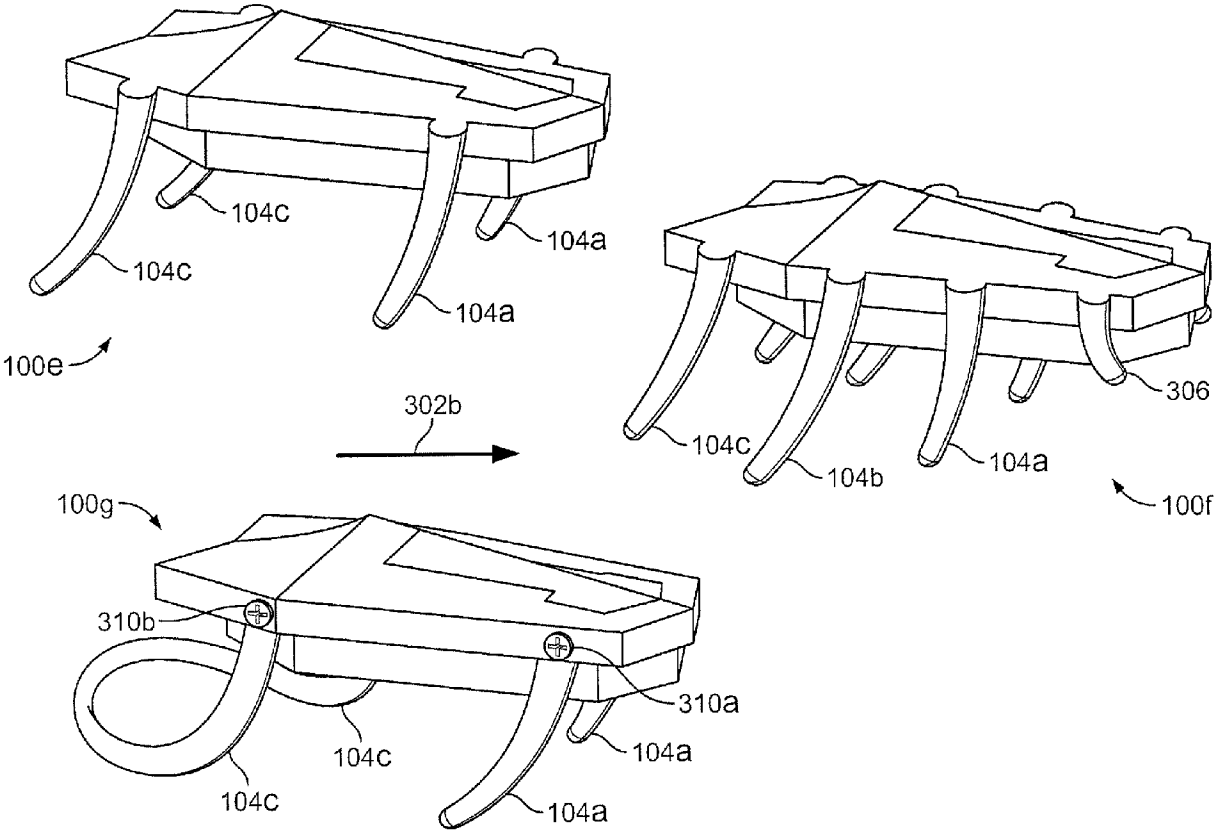
Figure 3C:
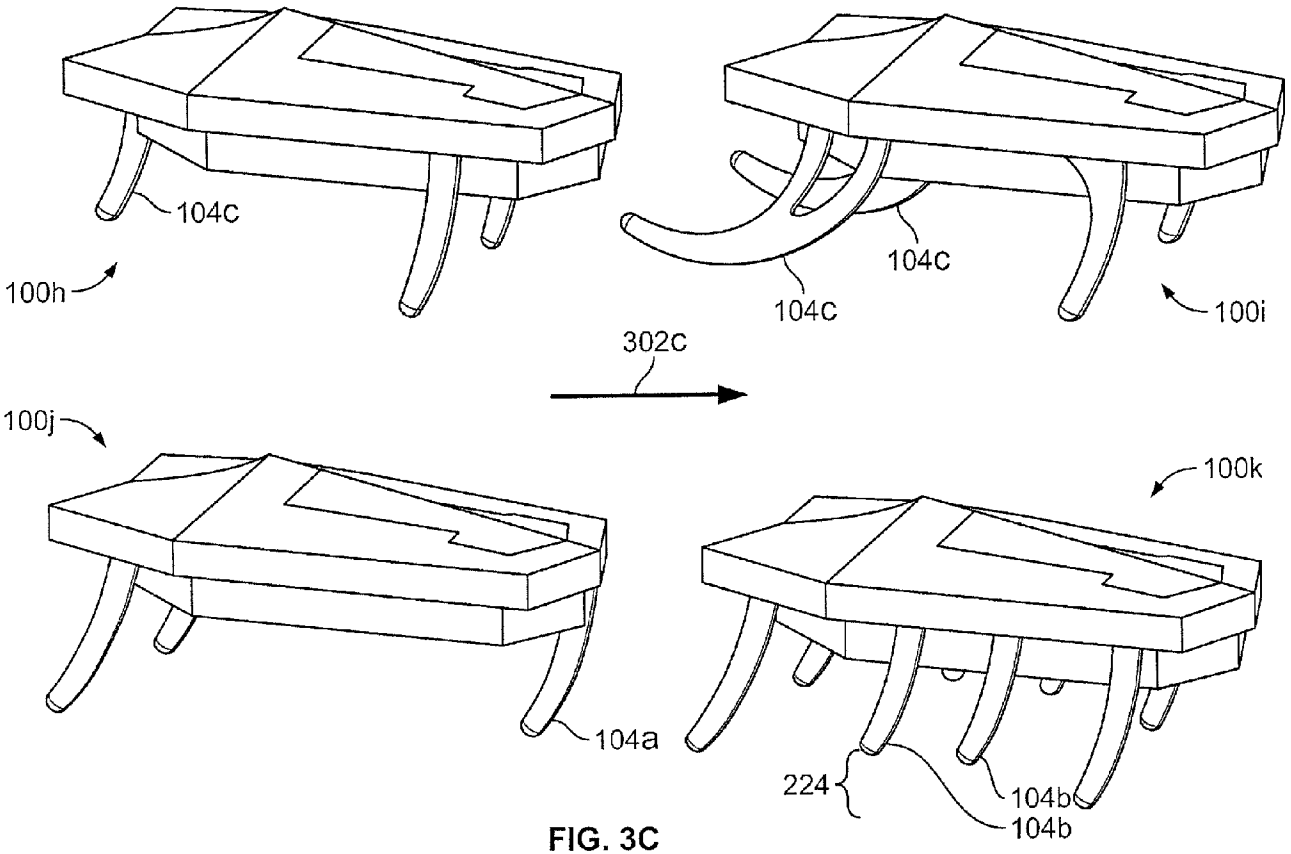

FIGS. 3A-3C show various examples of alternative leg configurations for devices 100*a*-100*k*. The devices 100*a*-100*k* primarily show leg 104 variations but can also include the components and features described above for the device 100. As depicted in FIGS. 3A-3C, the forward direction of movement is left-to-right for all of the devices 100*a*-100*k*, as indicated by direction arrows 302*a*-302*c*. The device 100*a* shows legs connected with webs 304. The webs 304 can serve to increase the stiffness of the legs 104 while maintaining legs 104 that appear long. The webs 304 can be anywhere along the legs 104 from the top (or base) to the bottom (or tip). Adjusting these webs 304 differently or on the device's right versus the left can serve to change leg characteristics without adjusting leg length and provide an alternate method of correcting steering. The device 100*b* shows a common configuration with multiple curved legs 104. In this implementation, the middle legs 104*b* may not touch the ground, which can make production tuning of the legs easier by eliminating unneeded legs from consideration. Devices 100*c* and 100*d* show additional appendages 306 that can add an additional life-like appearance to the devices 100*c* and 100*d*. The appendages 306 on the front legs can resonate as the devices 100*c* and 100*d* move. As described above, adjusting these appendages 306 to create a desired resonance can serve to increase randomness in motion.

Additional leg configurations are shown in FIG. 3B. The devices 100*e* and 100*f* show leg connections to the body that can be at various locations compared to the devices 100*a*-100*d* in FIG. 3A. Aside from aesthetic differences, connecting the legs 104 higher on the device's body can serve to make the legs 104 appear to be longer without raising the CG. Longer legs 104 generally have a reduced stiffness that can reduce hopping, among other characteristics. The device 100*f* also includes front appendages 306. The device 100*g* shows an alternate rear leg configuration where the two rear legs 104 are connected, forming a loop.

Additional leg configurations are shown in FIG. 3C. The device 100*h* shows the minimum number of (e.g., three) legs 104. Positioning the rear leg 104 right or left acts as a rudder changing the steering of the device 100*h*. Using a rear leg 104 made of a low friction material can increase the device's speed as previously described. The device 100*j* is three-legged device with the single leg 104 at the front. Steering can be adjusted on the rear legs by moving one forward of the other. The device 100*i* includes significantly altered rear legs 104 that make the device 100*i* appear more like a grasshopper. These legs 104 can function similar to legs 104 on the device 100*k*, where the middle legs 104*b* are raised and function only aesthetically until they work in self-righting the device 100*k* during a rollover situation.

In some implementations, devices 100 can include adjustment features, such as adjustable legs 104. For example, if a consumer purchases a set of devices 100 that all have the same style (e.g., an ant), the consumer may want to make some or all of the devices 100 move in varying ways. In some implementations, the consumer can lengthen or shorten individual leg 104 by first loosening a screw (or clip) that holds the leg 104 in place. The consumer can then slide the leg 104 up or down and retighten the screw (or clip). For example, referring for FIG. 3B, screws 310*a* and 310*b* can be loosened for repositioning legs 104*a* and 104*c*, and then tightened again when the legs are in the desired place.

In some implementations, screw-like threaded ends on leg bases 106*b* along with corresponding threaded holes in the device housing 102 can provide an adjustment mechanism for making the legs 104 longer or shorter. For example, by turning the front legs 104*a* to change the vertical position of the legs bases 106*b* (i.e., in the same way that turning a screw in a threaded hole changes the position of the screw), the consumer can change the length of the front legs 104*a*, thus altering the behavior of the device 100.

In some implementations, the leg base 106*b* ends of adjustable legs 104 can be mounted within holes in housing 102 of the device 100. The material (e.g., rubber) from which the legs are constructed along with the size and material of the holes in the housing 102 can provide sufficient friction to hold the legs 104 in position, while still allowing the legs to be pushed or pulled through the holes to new adjusted positions.

In some implementations, in addition to using adjustable legs 104, variations in movement can be achieved by slightly changing the CG, which can serve to alter the effect of the vibration of the motor 202. This can have the effect of making the device move slower or faster, as well as changing the device's tendency to turn. Providing the consumer with adjustment options can allow different devices 100 to move differently.

Device Dimensions

Figure 7A:
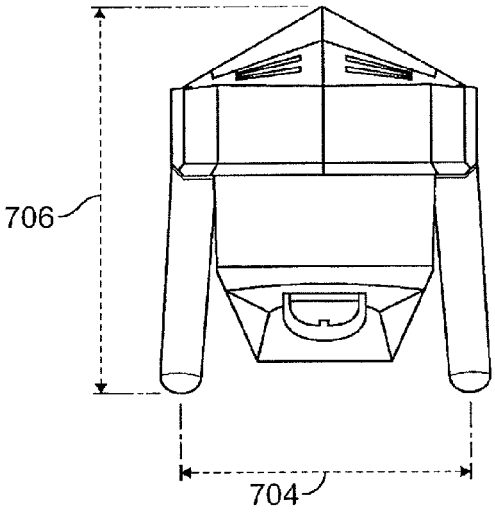
FIGS. 7A and 7B show example dimensions of the device.
Figure 7B:
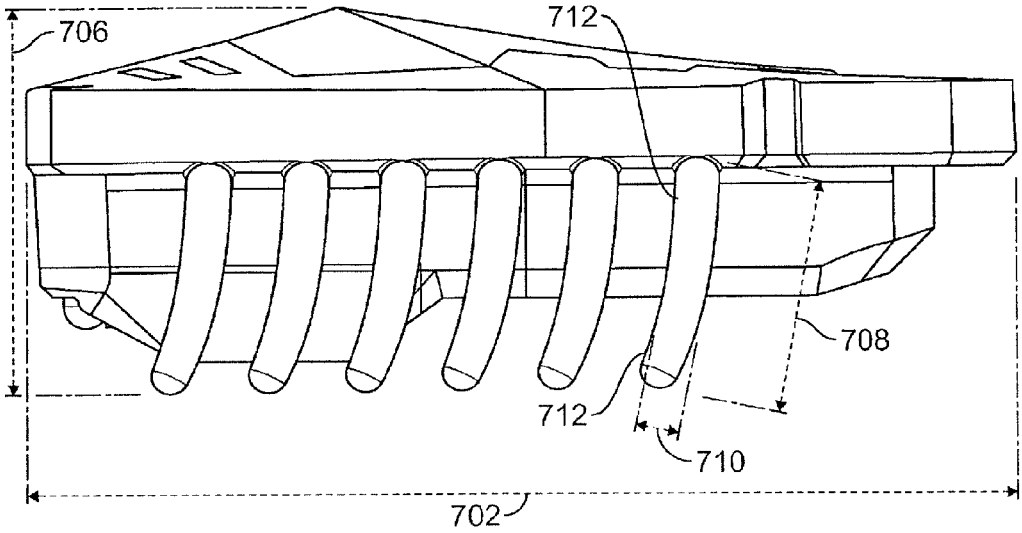

FIGS. 7A and 7B show example dimensions of the device 100. For example, a length 702 is approximately 1.73 inches, a width 704 from leg tip to leg tip is approximately 0.5 inches, and a height 706 is approximately 0.681 inches. A leg length 708 can be approximately 0.4 inches, and a leg diameter 710 can be approximately 0.077 inches. A radius of curvature (shown generally at 712) can be approximately 1.94 inches. Other dimensions can also be used. In general, the device length 702 can be in the range from two to five times the width 704 and the height 706 can be in the approximate range from one to two times the width 704. The leg length 708 can be in the range of three to ten times the leg diameter 710. There is no physical limit to the overall size that the device 100 can be scaled to, as long as motor and counterweight forces are scaled appropriately. In general, it may be beneficial to use dimensions substantially proportional to the illustrated dimensions. Such proportions may provide various benefits, including enhancing the ability of the device 100 to right itself after tipping and facilitating desirable movement characteristics (e.g., tendency to travel in a straight line, etc.).

Construction Materials

Material selection for the legs is based on several factors that affect performance. The materials main parameters are coefficient of friction (COF), flexibility and resilience. These parameters in combination with the shape and length of the leg affect speed and the ability to control the direction of the device.

COF can be significant in controlling the direction and movement of the device. The COF is generally high enough to provide resistance to sideways movement (e.g., drifting or floating) while the apparatus is moving forward. In particular, the COF of the leg tips (i.e., the portion of the legs that contact a support surface) can be sufficient to substantially eliminate drifting in a lateral direction (i.e., substantially perpendicular to the direction of movement) that might otherwise result from the vibration induced by the rotating eccentric load. The COF can also be high enough to avoid significant slipping to provide forward movement when $F_v$ is down and the legs provide a forward push. For example, as the legs bend toward the back of the device 100 (e.g., away from the direction of movement) due to the net downward force on the one or more driving legs (or other legs) induced by the rotation of the eccentric load, the COF is sufficient to prevent substantial slipping between the leg tip and the support surface. In another situation, the COF can be low enough to allow the legs to slide (if contacting the ground) back to their normal position when $F_v$ is positive. For example, the COF is sufficient low that, as the net forces on the device 100 tend to cause the device to hop, the resiliency of the legs 104 cause the legs to tend to return to a neutral position without inducing a sufficient force opposite the direction of movement to overcome either or both of a frictional force between one or more of the other legs (e.g., back legs 104*c*) in contact with the support surface or momentum of the device 100 resulting from the forward movement of the device 100. In some instances, the one or more driving legs 104*a* can leave (i.e., hop completely off) the support surface, which allows the driving legs to return to a neutral position without generating a backward frictional force. Nonetheless, the driving legs 104*a* may not leave the support surface every time the device 100 hops and/or the legs 104 may begin to slide forward before the legs leave the surface. In such cases, the legs 104 may move forward without causing a significant backward force that overcomes the forward momentum of the device 100.

Flexibility and resilience are generally selected to provide desired leg movement and hop. Flexibility of the leg can allow the legs to bend and compress when $F_v$ is down and the nose moves down. Resilience of the material can provide an ability to release the energy absorbed by bending and compression, increasing the forward movement speed. The material can also avoid plastic deformation while flexing.

Rubber is an example of one type of material that can meet these criteria, however, other materials (e.g., other elastomers) may a have similar properties.

Figure 8:
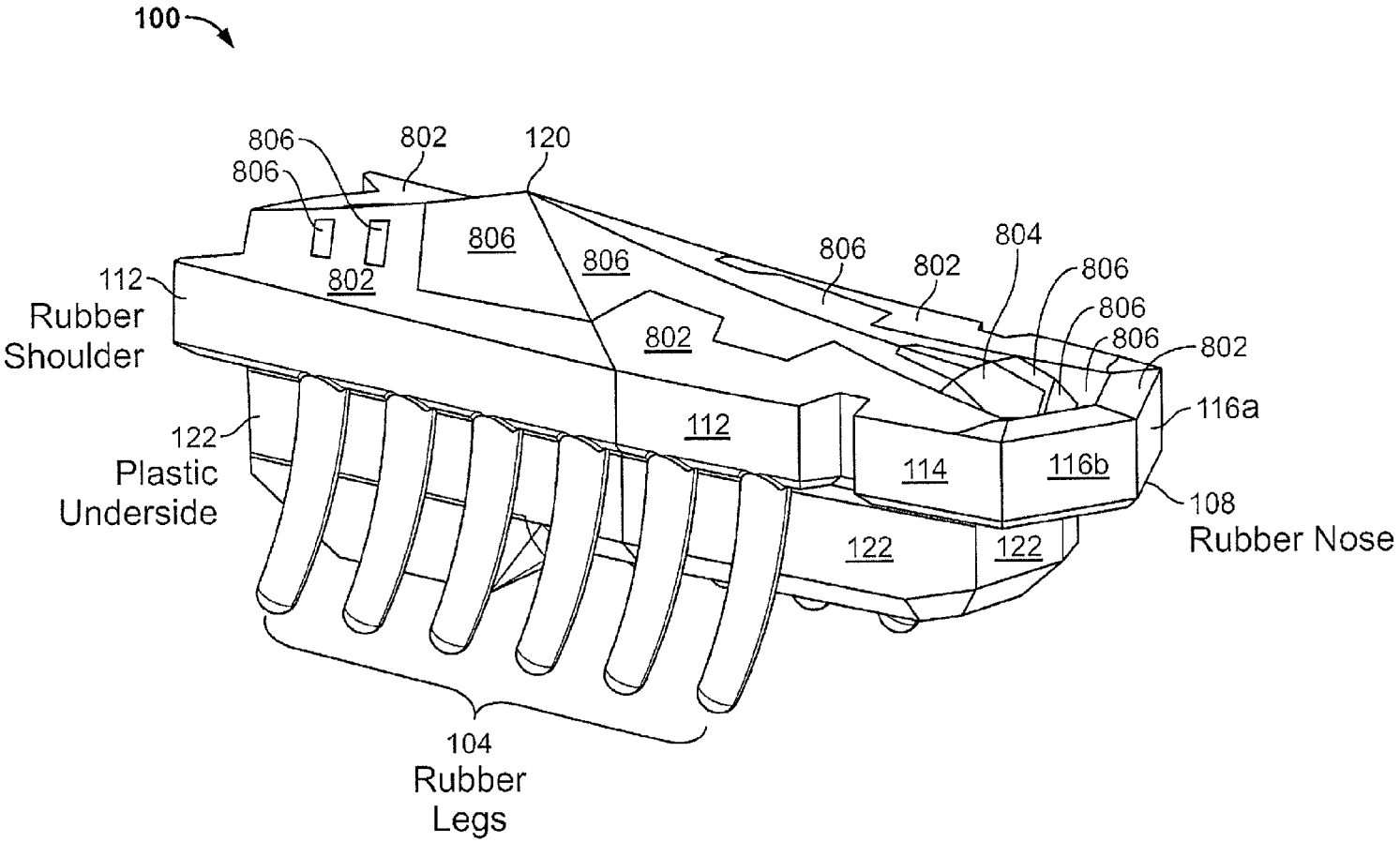
FIG. 8 shows one example configuration of example materials from which the device can be constructed.

FIG. 8 shows example materials that can be used for the device 100. In the example implementation of the device 100 shown in FIG. 8, the legs 104 are molded from rubber or another elastomer. The legs 104 can be injection molded such that multiple legs are integrally molded substantially simultaneously (e.g., as part of the same mold). The legs 104 can be part of a continuous or integral piece of rubber that also forms the nose 108 (including nose sides 116*a* and 116*b*), the body shoulder 112, and the head side surface 114. As shown, the integral piece of rubber extends above the body shoulder 112 and the head side surface 114 to regions 802, partially covering the top surface of the device 100. For example, the integral rubber portion of the device 100 can be formed and attached (i.e., co-molded during the manufacturing process) over a plastic top of the device 100, exposing areas of the top that are indicated by plastic regions 806, such that the body forms an integrally co-molded piece. The high point 120 is formed by the uppermost plastic regions 806. One or more rubber regions 804, separate from the continuous rubber piece that includes the legs 104, can cover portions of the plastic regions 806. In general, the rubber regions 802 and 804 can be a different color than plastic regions 806, which can provide a visually distinct look to the device 100. In some implementations, the patterns formed by the various regions 802-806 can form patterns that make the device look like a bug or other animate object. In some implementations, different patterns of materials and colors can be used to make the device 100 resemble different types of bugs or other objects. In some implementations, a tail (e.g., made of string) can be attached to the back end of the device 100 to make the device appear to be a small rodent.

The selection of materials used (e.g., elastomer, rubber, plastic, etc.) can have a significant effect on the vehicle's ability to self-right. For example, rubber legs 104 can bend inward when the device 100 is rolling during the time it is self-righting. Moreover, rubber legs 104 can have sufficient resiliency to bend during operation of the vehicle 100, including flexing in response to the motion of (and forces created by) the eccentric load rotated by the motor 202. Furthermore, the tips of the legs 104, also being made of rubber, can have a coefficient of friction that allows the driving legs (e.g., the front legs 104) to push against the surface 110 without significantly slipping.

Using rubber for the nose 108 and shoulder 112 can also help the device 100 to self-right. For example, a material such as rubber, having higher elasticity and resiliency than hard plastic, for example, can help the nose 108 and shoulder 112 bounce, which facilitates self righting, by reducing resistance to rolling while the device 100 is airborne. In one example, if the device 100 is placed on its side while the motor 202 is running, and if the motor 202 and eccentric load are positioned near the nose 108, the rubber surfaces of the nose 108 and shoulder 112 can cause at least the nose of the device 100 to bounce and lead to self-righting of the device 100.

In some implementations, the one or more rear legs 104*c* can have a different coefficient of friction than that of the front legs 104*a*. For example, the legs 104 in general can be made of different materials and can be attached to the device 100 as different pieces. In some implementations, the rear legs 104*c* can be part of a single molded rubber piece that includes all of the legs 104, and the rear legs 104*c* can be altered (e.g., dipped in a coating) to change their coefficient of friction.

Referring back to FIG. 1 and to FIGS. 10A-35D, small robotic devices, or vibration-powered vehicles, can be designed to move across a surface, e.g., a floor, table, or other relatively flat surface. The robotic device is adapted to move autonomously and, in some implementations, turn in seemingly random directions. In general, the robotic devices include a housing, multiple legs, and a vibrating mechanism (e.g., a motor or spring-loaded mechanical winding mechanism rotating an eccentric load, a motor or other mechanism adapted to induce oscillation of a counterweight, or other arrangement of components adapted to rapidly alter the center of mass of the device). As a result, the miniature robotic devices, when in motion, can resemble organic life, such as bugs or insects.

Movement of the robotic device can be induced by the motion of a rotational motor inside of, or attached to, the device, in combination with a rotating weight with a center of mass that is offset relative to the rotational axis of the motor. The rotational movement of the weight causes the motor and the robotic device to which it is attached to vibrate. In some implementations, the rotation is approximately in the range of 6000-9000 revolutions per minute (rpm's), although higher or lower rpm values can be used. As an example, the device can use the type of vibration mechanism that exists in many pagers and cell phones that, when in vibrate mode, cause the pager or cell phone to vibrate. The vibration induced by the vibration mechanism can cause the device to move across the surface (e.g., the floor) using legs that are configured to alternately flex (in a particular direction) and return to the original position as the vibration causes the device to move up and down.

Various features can be incorporated into the robotic devices. For example, various implementations of the devices can include features (e.g., shape of the legs, number of legs, frictional characteristics of the leg tips, relative stiffness or flexibility of the legs, resiliency of the legs, relative location of the rotating counterweight with respect to the legs, etc.) for facilitating efficient transfer of vibrations to forward motion. The speed and direction of the robotic device's movement can depend on many factors, including the rotational speed of the motor, the size of the offset weight attached to the motor, the power supply, the characteristics (e.g., size, orientation, shape, material, resiliency, frictional characteristics, etc.) of the "legs" attached to the housing of the device, the properties of the surface on which the device operates, the overall weight of the device, and so on.

As provided herein, an example device 100 or 1000 (FIG. 10A) includes a housing 102 (e.g., resembling the body of the insect) and legs 104. Inside (or attached to) the housing 102 are the components that control and provide movement for the device 100, including a rotational motor, power supply (e.g., a battery), and an on/off switch. Each of the legs 104 includes a leg tip 106*a* and a leg base 106*b*. The properties of the legs 104, including the position of the leg base 106*b* relative to the leg tip 106*a*, can contribute to the direction and speed in which the device 100 tends to move. The device 100 is depicted in an upright position (i.e., standing on legs 104) on a supporting surface 110 (e.g., a substantially planar floor, table top, etc. that counteracts gravitational forces).

Legs 104 can include front legs 104*a*, middle legs 104*b*, and rear legs 104*c*. For example, the device 100 can include a pair of front legs 104*a* that may be designed to perform differently from middle legs 104*b* and rear legs 104*c*. For example, the front legs 104*a* may be configured to provide a driving force for the device 100 by contacting an underlying surface 110 and causing the device to hop forward as the device vibrates. Middle legs 104*b* can help provide support to counteract material fatigue (e.g., after the device 100 rests on the legs 104 for long periods of time) that may eventually cause the front legs 104*a* to deform and/or lose resiliency. In some implementations, device 100 can exclude middle legs 104*b* and include only front legs 104*a* and rear legs 104*c*. In some implementations, front legs 104*a* and one or more rear legs 104*c* can be designed to be in contact with a surface, while middle legs 104*b* can be slightly off the surface so that the middle legs 104*b* do not introduce significant additional drag forces and/or hopping forces that may make it more difficult to achieve desired movements (e.g., tendency to move in a relatively straight line and/or a desired amount of randomness of motion).

As described here at a high level, many factors or features can contribute to the movement and control of the device 100. For example, the device's center of gravity (CG), and whether it is more forward or towards the rear of the device, can influence the tendency of the device 100 to turn. Moreover, a lower CG can help to prevent the device 100 from tipping over. The location and distribution of the legs 104 relative to the CG can also prevent tipping. For example, if pairs or rows of legs 104 on each side of the device 100 are too close together and the device 100 has a relatively high CG (e.g., relative to the lateral distance between the rows or pairs of legs), then the device 100 may have a tendency to tip over on its side. Thus, in some implementations, the device includes rows or pairs of legs 104 that provide a wider lateral stance (e.g., pairs of front legs 104*a*, middle legs 104*b*, and rear legs 104*c* are spaced apart by a distance that defines an approximate width of the lateral stance) than a distance between the CG and a flat supporting surface on which the device 100 rests in an upright position. In some implementations, a high point 120 can be used to help facilitate self-righting of the device 100 in the event that the device 100 tips over onto its back.

Movement of the device can also be influenced by the leg geometry of the legs 104. For example, a longitudinal offset between the leg tip (i.e., the end of the leg that touches the surface 110) and the leg base (i.e., the end of the leg that attaches to the device housing) of any driving legs induces movement in a forward direction as the device vibrates. Including some curvature, at least in the driving legs, further facilitates forward motion as the legs tend to bend, moving the device forward, when vibrations force the device downward and then spring back to a straighter configuration as the vibrations force the device upward (e.g., resulting in hopping completely or partially off the surface, such that the leg tips move forward above or slide forward across the surface 110).

The ability of the legs to induce forward motion results in part from the ability of the device to vibrate vertically on the resilient legs. As shown in FIG. 1, the device 100 includes an underside 122. The power supply and motor for the device 100 can be contained in a chamber that is formed between the underside 122 and the upper body of the device, for example. The length of the legs 104 creates a space 124 (at least in the vicinity of the driving legs) between the underside 122 and the surface 110 on which the device 100 operates. The size of the space 124 depends on how far the legs 104 extend below the device relative to the underside 122. The space 124 provides room for the device 100 (at least in the vicinity of the driving legs) to move downward as the periodic downward force resulting from the rotation of the eccentric load causes the legs to bend. This downward movement can facilitate forward motion induced by the bending of the legs 104.

The device also includes a body shoulder 112 and a head side surface 114, which can be constructed from rubber, elastomer, or other resilient material, or from a hard plastic, metal, or other material. A notch 126 can separate the body shoulder 112 the head side surface 114. A nose 108 can contribute to the ability of the device 100 to deflect off of obstacles. Nose left side 116*a* and nose right side 116*b* can form the nose 108. The nose sides 116*a* and 116*b* can form a shallow point or another shape that helps to cause the device 100 to deflect off obstacles (e.g., walls) encountered as the device 100 moves in a generally forward direction. The device 100 can includes a space within the head 118 that increases bounce by making the head more elastically deformable (i.e., reducing the stiffness). For example, when the device 100 crashes nose-first into an obstacle, the space within the head 118 allows the head of the device 100 to compress, which provides greater control over the bounce of the device 100 away from the obstacle than if the head 118 is constructed as a more solid block of material. The space within the head 118 can also better absorb impact if the device falls from some height (e.g., a table). The body shoulder 112 and head side surface 114, especially when constructed from rubber or other resilient material, can also contribute to the device's tendency to deflect or bounce off of obstacles encountered at a relatively high angle of incidence.

Attachments can be designed to fit on the device 100 to add functionality and/or change the appearance of the device 100. In some embodiments, the attachments can resemble weapons and/or armor, although other types of attachments are also possible (e.g., attachments that tend to alter the movement or other behavior of the device 100). The attachments can include static or moving parts. In some embodiments, an attachment can include a frame that can be conveniently attached to and removed from (i.e., releasably attached to) the housing 102 (i.e., the body) of the device 100. The frame can be designed to attach to different portions of the body (e.g., head, center, or tail end of the device 100, or a combination thereof). The frame can be shaped to mate with a particular portion of the housing 102 to facilitate positioning of the attachment in a particular location and to secure the attachment to the housing 102 in a relatively reliable configuration. The frame can be constructed from a resilient material (e.g., rubber or other elastomer) or a stiff material (e.g., hard plastic or metal). Moreover, in some embodiments, the frame may be integrally attached to (e.g., co-molded with at least a portion of the housing 102) or otherwise connected to the device 100 in a manner that is not removable.

The attachment can also include one or more appendages that are rotatably coupled to the frame (e.g., using an axle). The appendage can have any suitable shape and can rotate about a corresponding axis of rotation as the device vibrates. For example, as vibration induces motion of the device, the vibration (or other forces induced by rotation of the eccentric load) can further induce rotation of the appendage about its axis of rotation. Thus, the appendage can rotate without any direct torque transfer from the motor of the device (i.e., there are no gears or other mechanisms for the rotational motion of the motor in the device to drive the rotation of the appendage). Rotation of the appendage may be induced, at least in part, by lateral oscillation of the device or by vibration that results from rotation of an eccentric load by a rotational motor. The speed and direction of rotation of the appendage may be related to the speed and amplitude of vibration of the device; to the direction of rotation of and degree of eccentricity induced by the eccentric load; the amount of rotational momentum; to the orientation of the axis of rotation of the appendage. The axis of rotation of the appendage can be parallel to the direction of motion of the device, can be perpendicular to the direction of motion, or can have some other orientation. Moreover, the axis of rotation can be parallel to the supporting surface of the device (i.e., when the device is upright), perpendicular to the supporting surface, or some other orientation. Depending on the configuration of the appendage, the appendage can, in various embodiments, increase erratic or random motion tendencies of the device, increase or decrease stability of the device, or alter interactive tendencies with obstacles or other devices.

A variety of example embodiments of attachments are described in the following paragraphs. Although the figures illustrate attachments designed to fit the device 100 of FIG. 1, attachments can also be shaped to fit devices having alternative shapes. In addition to the utility of the various embodiments, each set of figures (e.g., FIGS. 10A-10F, FIGS. 11A-11F, FIGS. 12A-12F, etc.) also illustrate inventive ornamental designs for the device 100 in combination with various attachments and for the attachments themselves. Inventive design features may include portions of the illustrated structures.

Figure 10A:
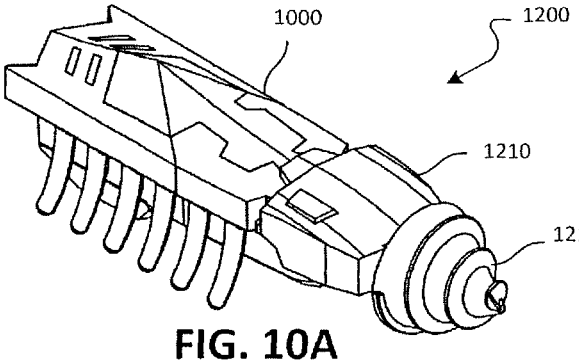
FIGS. 10A through 10F illustrate a vehicle that includes a device of FIG. 1 fitted with a spinning drill head attachment.
Figure 10B:
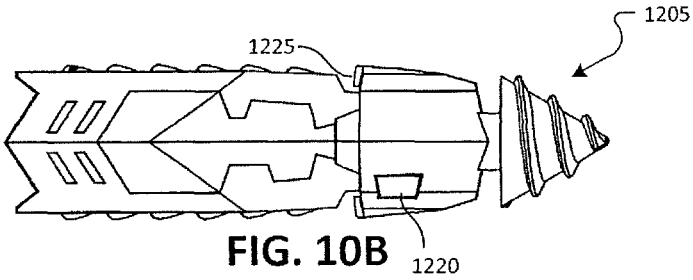
Figure 10C:
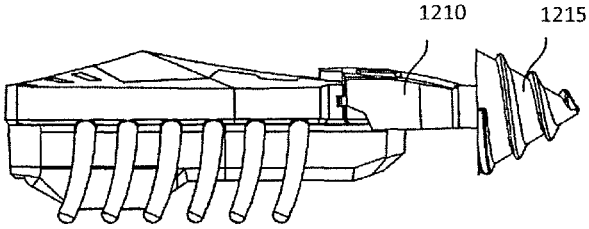
Figure 10D:
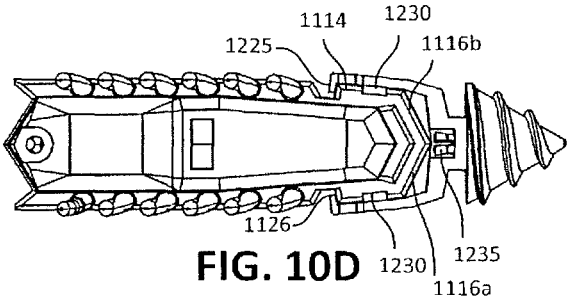
Figure 10E:
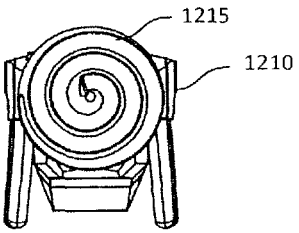
Figure 10F:
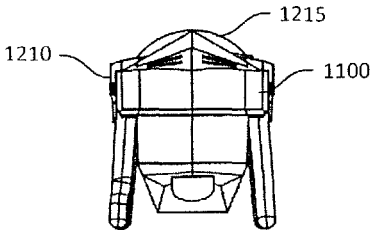

FIGS. 10A through 10F illustrate a vehicle 1200 that includes a device 1000, similar to the device of FIG. 1 fitted with a spinning drill head attachment 1205. FIG. 10A is a perspective view of the vehicle 1200, FIG. 10B is a top view of the vehicle 1200, FIG. 10C is a side view of the vehicle 1200, FIG. 10D is a bottom view of the vehicle 1200, FIG. 10E is a front view of the vehicle 1200, and FIG. 101 is a back view of the vehicle 1200. The spinning drill head attachment 1205 includes a frame 1210 and a drill bit appendage 1215. The frame 1210 can include surface or three-dimensional ornamentation 1220. Such ornamentation 1220, in addition to providing aesthetic features, can provide an altered weight distribution of the vehicle 1200 relative to the device 1000 or relative to a vehicle similar to vehicle 1200 that does not include the ornamentation 1220. The altered weight distribution can counteract or otherwise alter motion tendencies induced by rotation of the appendage or can simply impact motion tendencies of the combined vehicle 1200 as the device 1100 vibrates.

The frame 1210 can include features adapted to secure the attachment 1205 to the device 1100. For example, the frame 1210 can include vertical tabs 1225 adapted to engage a surface of the notch 1126 that separates the head from the body of the device 1100 to prevent unwanted movement of the attachment 1205 in a forward direction (i.e., in a direction toward the nose 108 of the device 100). The frame 1210 can also include horizontal tabs 1230 adapted to engage the device 1100 just under the head side surface 1114 to prevent unwanted movement of the attachment 1205 in an upward direction (i.e., in a direction away from a support surface 1110 when the device 1100 is upright). Essentially, the vertical tabs 1225 and horizontal tabs 1230 can allow the attachment 1205 to snap into place on the device 1100 and to be removed from the device 1100 (e.g., using an amount of force greater than the device 1100 experiences as a result of vibration during operation). The tabs 1225 and 1230, the frame 1210, and/or the body 1102 of the device 1100 can be sufficiently flexible to deflect and/or deform, thereby allowing the attachment 1205 to be fitted onto the device 1100 and removed from the device 1100 by a user. The frame 1210 may be configured to have at least a somewhat different internal shape than the shape of the device body 1102 (e.g., the front portion of the frame 1210 need not conform to the shape of nose sides 116*a*, 116*b*, although, in some embodiments, frame 210 can be configured to conform to the shape of the nose sides 1116*a*, 1116*b*). As noted above, in some embodiments the frame can be connected (integrally or otherwise) to the device body 1102 instead of being a separate and/or removable component.

The drill bit appendage 1215 is rotatably coupled to the frame 1210 of the spinning drill head attachment 1205 by a screw 1235 that serves as an axle and defines an axis of rotation for the spinning drill bit appendage 1215. Although the attachment 1205 is illustrated as using a screw 1235, other types of axles (e.g., a rod that projects from the frame that mates with a hollow cylinder of the appendage 1215) can also be used. Moreover, the axle can be fixedly attached to either the frame 1210 or the appendage 1215, or neither.

Figure 11A:
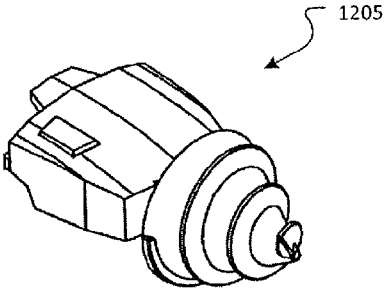
FIGS. 11A through 11F illustrate the spinning drill head attachment of FIGS. 10A-10F separate from the device of FIG. 1.
Figure 11B:
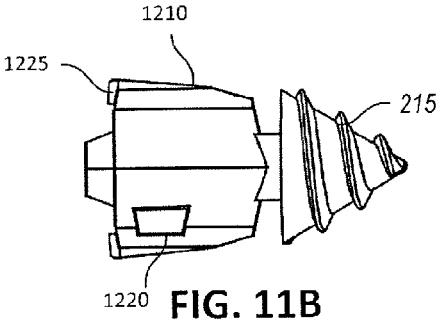
Figure 11C:
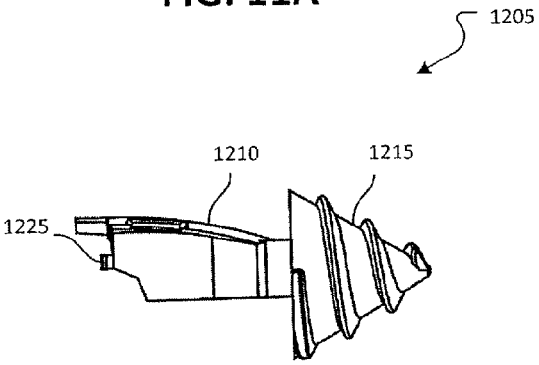
Figure 11D:
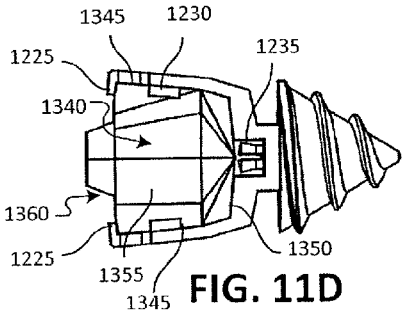
Figure 11E:
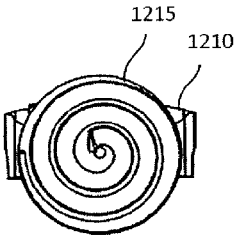
Figure 11F:
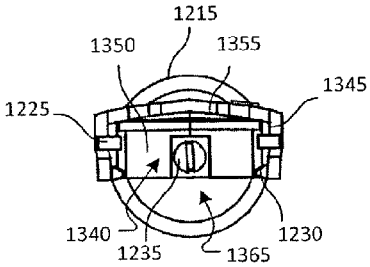

FIGS. 11A through 11F illustrate the spinning drill head attachment 1205 of FIGS. 10A-10F separate from the device 1100. FIG. 11A is a perspective view of the spinning drill head attachment 1205, FIG. 11B is a top view of the spinning drill head attachment 1205, FIG. 11C is a side view of the spinning drill head attachment 1205, FIG. 11D is a bottom view of the spinning drill head attachment 1205, FIG. 11E is a front view of the spinning drill head attachment 1205, and FIG. 11F is a back view of the spinning drill head attachment 1205. FIGS. 11A-11F illustrate many of the same features as shown in FIGS. 10A-10F. In addition, FIGS. 11D and 11F illustrate additional details of a concave portion 1340 of the spinning drill head attachment 1205 that fits onto the device 1100. In this case, for example, the concave portion 1340 is designed to substantially mate with a head portion of the device 1100.

As shown in FIGS. 11D and 11F, the concave portion 1340 is defined by sidewalls 1345, a front wall 1350, and a top wall 1355. The sidewalls 1345 of the concave portion 1340 terminate at the rear of the frame 1210 to define a rear opening 1360 and at the bottom of the frame 1210 to define a bottom opening 1365. Using these openings, the device 1100 can be inserted into the attachment 1205 from the rear opening 1360 or the bottom opening 1365 (or a combination). The sidewalls 1345 and top wall 1355 are illustrated as having a shape that generally conforms to the shape of the corresponding portion of the device 1100. The front wall 1350 is illustrated as have a shape that does not conform to the nose portion 1108, 1116*a*, 1116*b* of the device 1100, although the front wall 1350 may be designed to contact at least a portion of the nose 1108 to provide a surface that opposes the vertical tabs 1225. Thus, although the internal dimensions of the concave portion 1340 may not conform precisely to the shape of a corresponding portion of the device 1100, the internal dimensions may include surfaces that contact the corresponding portion of the device 1100 sufficiently to secure the attachment 1205 in place.

Figure 12A:
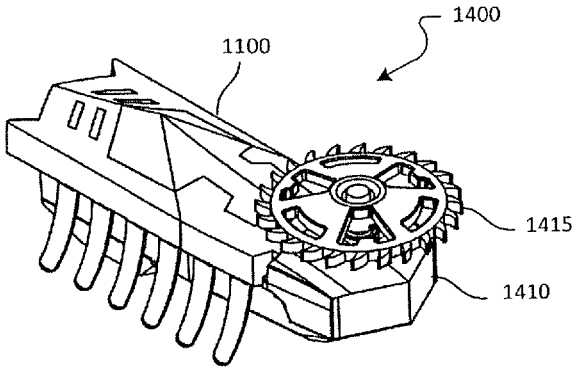
FIGS. 12A through 12F illustrate a vehicle that includes a device of FIG. 1 fitted with a top spinning saw blade head attachment.
Figure 12B:
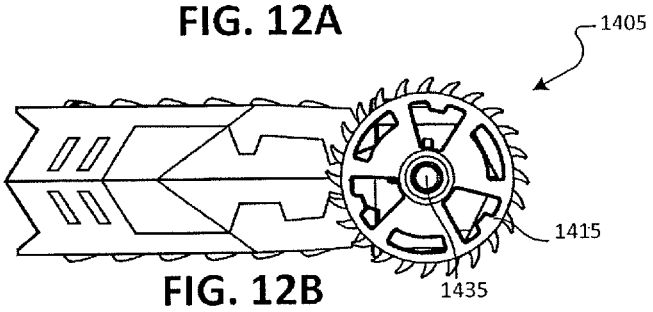
Figure 12C:
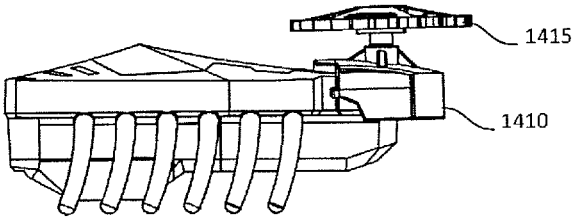
Figure 12D:
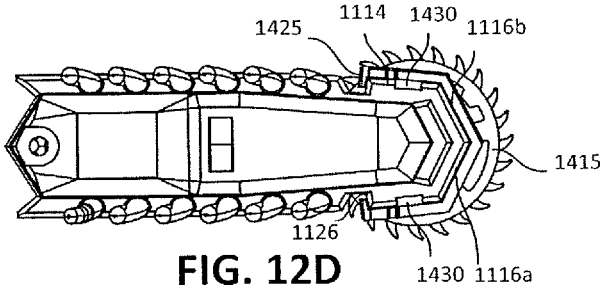
Figure 12E:
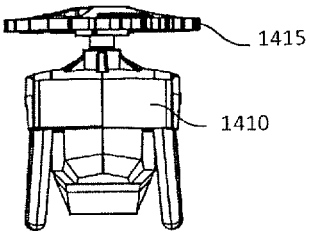
Figure 12F:
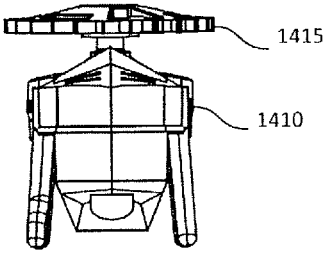

FIGS. 12A through 12F illustrate a vehicle 1400 that includes a device 1100 fitted with a top spinning saw blade head attachment 1405. FIG. 12A is a perspective view of the vehicle 1400, FIG. 12B is a top view of the vehicle 1400, FIG. 12C is a side view of the vehicle 1400, FIG. 12D is a bottom view of the vehicle 1400, FIG. 12E is a front view of the vehicle 1400, and FIG. 12F is a back view of the vehicle 1400. The top spinning saw blade head attachment 1405 includes a frame 1410 and a saw blade appendage 1415.

The frame 1410 can include features adapted to secure the attachment 1405 to the device 1100. For example, the frame 1410 can include vertical tabs 1425 adapted to engage a surface of the notch 1126 that separates the head from the body of the device 1100 to prevent unwanted movement of the attachment 1405 in a forward direction (i.e., in a direction toward the nose 1108 of the device 1100). The frame 1410 can also include horizontal tabs 1430 adapted to engage the device 1100 just under the head side surface 1114 to prevent unwanted movement of the attachment 1405 in an upward direction (i.e., in a direction away from a support surface 1110 when the device 1100 is upright). Essentially, the vertical tabs 1425 and horizontal tabs 1430 can allow the attachment 1405 to snap into place on the device 1100 and to be removed from the device 1100 (e.g., using an amount of force greater than the device 1100 experiences as a result of vibration during operation). The tabs 1425 and 1430, the frame 1410, and/or the body of the device 1100 can be sufficiently flexible to deflect and/or deform, thereby allowing the attachment 1405 to be fitted onto the device 1100 and removed from the device 1100 by a user. The frame 1410 may be configured to conform to the shape of the nose sides 1116*a*, 1116*b*. As noted above, in some embodiments the frame can be connected (integrally or otherwise) to the device body instead of being a separate and/or removable component.

The saw blade appendage 1415 is rotatably coupled to the frame 1410 of the top spinning saw blade head attachment 1405 by an axle 1435 that defines an axis of rotation for the spinning saw blade appendage 1415.

Figure 13A:
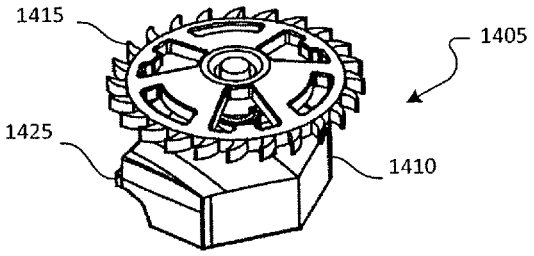
FIGS. 13A through 13F illustrate the top spinning saw blade head attachment of FIGS. 12A-12F separate from the device of FIG. 1.
Figure 13B:
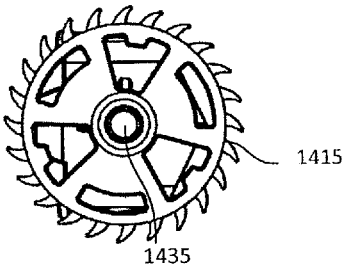
Figure 13C:
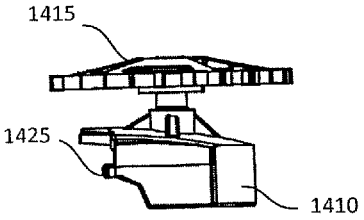
Figure 13D:
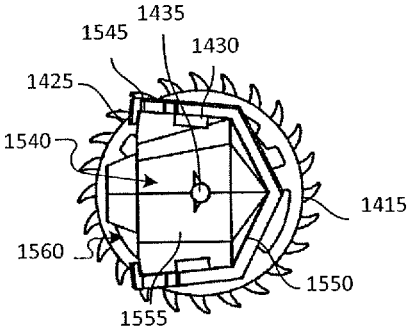
Figure 13E:
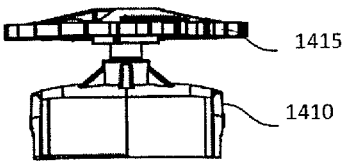
Figure 13F:
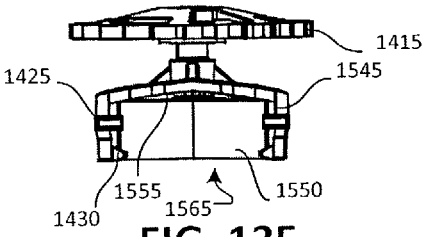

FIGS. 13A through 13F illustrate the top spinning saw blade head attachment 1405 of FIGS. 13A-13F separate from the device 1100. FIG. 13A is a perspective view of the top spinning saw blade head attachment 1405, FIG. 13B is a top view of the top spinning saw blade head attachment 1405, FIG. 13C is a side view of the top spinning saw blade head attachment 1405, FIG. 13D is a bottom view of the top spinning saw blade head attachment 1405, FIG. 13E is a front view of the top spinning saw blade head attachment 1405, and FIG. 13F is a back view of the top spinning saw blade head attachment 1405. FIGS. 13A-13F illustrate many of the same features as shown in FIGS. 12A-12F. In addition, FIGS. 13D and 13F illustrate additional details of a concave portion 1540 of the top spinning saw blade head attachment 1405 that fits onto the device 1100. In this case, for example, the concave portion 1540 is designed to substantially mate with a head portion of the device of FIG. 1.

As shown in FIGS. 13D and 13F, the concave portion 1540 is defined by sidewalls 1545, a front wall 1550, and a top wall 1555. The sidewalls 1545 of the concave portion 1540 terminate at the rear of the frame 1410 to define a rear opening 1560 and at the bottom of the frame 1410 to define a bottom opening 1565. Using these openings, the device 1100 can be inserted into the attachment 1405 from the rear opening 1560 or the bottom opening 1565 (or a combination by inserting the device 1100 at an angle). The sidewalls 1545, front wall 1550, and top wall 1555 are illustrated as having a shape that generally conforms to the shape of the corresponding portion of the device 1100. Thus, the internal dimensions may include surfaces that contact the corresponding portion of the device 1100 sufficiently to secure the attachment 1405 in place.

Figure 14A:
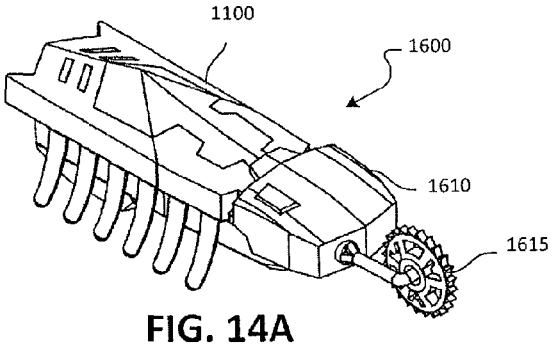
FIGS. 14A through 14F illustrate a vehicle that includes a device of FIG. 1 fitted with a front sideways spinning saw blade head attachment.
Figure 14B:
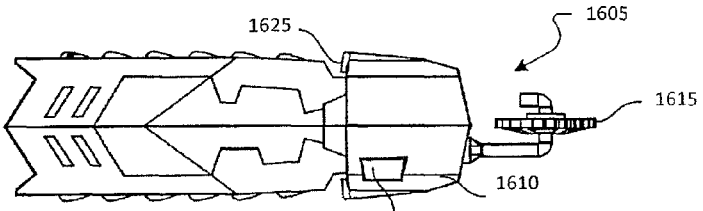
Figure 14C:
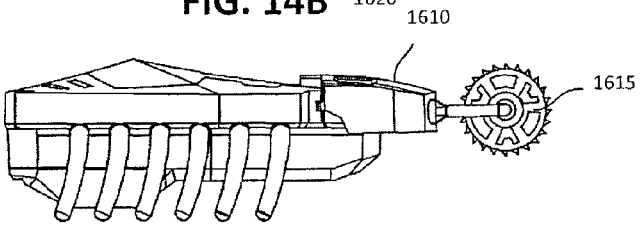
Figure 14D:
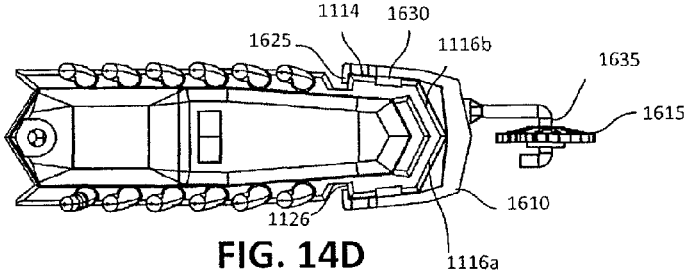
Figure 14E:
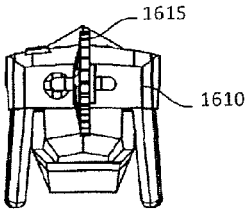
Figure 14F:
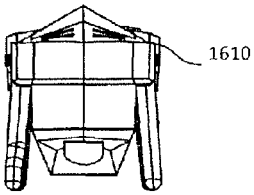

FIGS. 14A through 14F illustrate a vehicle 1600 that includes a device 1100 fitted with a front sideways spinning saw blade head attachment 1605. FIG. 14A is a perspective view of the vehicle 1600, FIG. 14B is a top view of the vehicle 1600, FIG. 14C is a side view of the vehicle 1600, FIG. 14D is a bottom view of the vehicle 1600, FIG. 14E is a front view of the vehicle 1600, and FIG. 14F is a back view of the vehicle 1600. The front sideways spinning saw blade head attachment 1605 includes a frame 1610 and a sideways saw blade appendage 1615. The frame 1610 can include surface or three-dimensional ornamentation 1620. Such ornamentation 1620, in addition to providing aesthetic features, can provide an altered weight distribution of the vehicle 1600 relative to the device 1100 or relative to a vehicle similar to vehicle 1600 that does not include the ornamentation 1620. The altered weight distribution can counteract or otherwise alter motion tendencies induced by rotation of the appendage or can simply impact motion tendencies of the combined vehicle 1600 as the device 1100 vibrates.

The frame 1610 can include features adapted to secure the attachment 1605 to the device 1100. For example, the frame 1610 can include vertical tabs 1625 adapted to engage a surface of the notch 1126 that separates the head from the body of the device 1100 to prevent unwanted movement of the attachment 1605 in a forward direction (i.e., in a direction toward the nose of the device). The frame 1610 can also include horizontal tabs 1630 adapted to engage the device 1100 just under the head side surface 1114 to prevent unwanted movement of the attachment 1605 in an upward direction (i.e., in a direction away from a support surface 1110 when the device 1100 is upright). Essentially, the vertical tabs 1625 and horizontal tabs 1630 can allow the attachment 1605 to snap into place on the device 1100 and to be removed from the device 1100 (e.g., using an amount of force greater than the device 1100 experiences as a result of vibration during operation). The tabs 1625 and 1630, the frame 1610, and/or the body of the device 1100 can be sufficiently flexible to deflect and/or deform, thereby allowing the attachment 1605 to be fitted onto the device 1100 and removed from the device 1100 by a user. The frame 1610 may be configured to have at least a somewhat different internal shape than the shape of the device body (e.g., the front portion of the frame 1610 need not conform to the shape of nose sides 1116*a*, 1116*b*, although, in some embodiments, frame 1610 can be configured to conform to the shape of the nose sides 1116*a*, 1116*b*). As noted above, in some embodiments the frame can be connected (integrally or otherwise) to the device body instead of being a separate and/or removable component.

The sideways saw blade appendage 1615 is rotatably coupled to the frame 1610 of the front sideways spinning saw blade head attachment 1605 by an axle 1635 that defines an axis of rotation for the sideways spinning saw blade appendage 1615. Other types of axles can also be used.

Figure 15A:
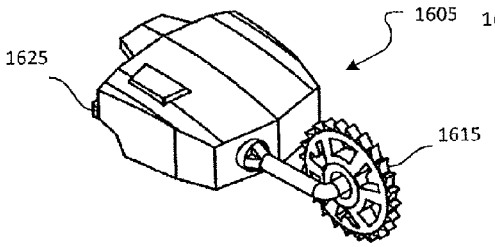
FIGS. 15A through 15F illustrate the front sideways spinning saw blade head attachment of FIGS. 14A-14F separate from the device of FIG. 1.
Figure 15B:
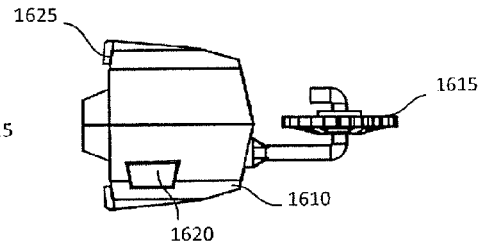
Figure 15C:
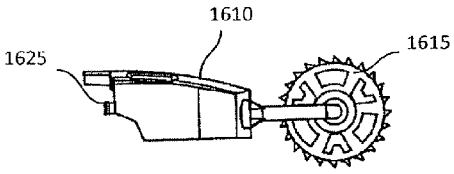
Figure 15D:
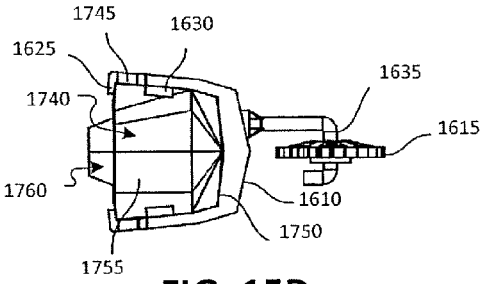
Figure 15E:
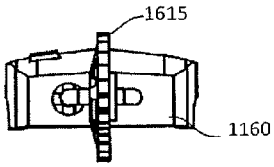
Figure 15F:
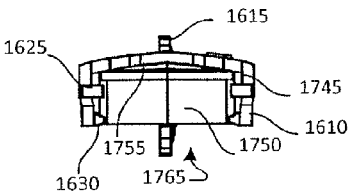

FIGS. 15A through 15F illustrate the front sideways spinning saw blade head attachment 1605 of FIGS. 14A-14F separate from the device 1100. FIG. 15A is a perspective view of the front sideways spinning saw blade head attachment 1605, FIG. 15B is a top view of the front sideways spinning saw blade head attachment 1605, FIG. 15C is a side view of the front sideways spinning saw blade head attachment 1605, FIG. 15D is a bottom view of the front sideways spinning saw blade head attachment 1605, FIG. 15E is a front view of the front sideways spinning saw blade head attachment 1605, and FIG. 15F is a back view of the front sideways spinning saw blade head attachment 1605. FIGS. 15A-15F illustrate many of the same features as shown in FIGS. 14A-14F. In addition, FIGS. 15D and 15F illustrate additional details of a concave portion 1740 of the front sideways spinning saw blade head attachment 1605 that fits onto the device 1100. In this case, for example, the concave portion 1740 is designed to substantially mate with a head portion of the device 1100.

As shown in FIGS. 15D and 15F, the concave portion 1740 is defined by sidewalls 1745, a front wall 1750, and a top wall 1755. The sidewalls 1745 of the concave portion 1740 terminate at the rear of the frame 1610 to define a rear opening 1760 and at the bottom of the frame 1610 to define a bottom opening 1765. Using these openings, the device 1100 can be inserted into the attachment 1605 from the rear opening 1760 or the bottom opening 1765 (or a combination). The sidewalls 1745 and top wall 1755 are illustrated as having a shape that generally conforms to the shape of the corresponding portion of the device 100. The front wall 750 is illustrated as have a shape that does not conform to the nose portion 1108, 1116*a*, 1116*b* of the device 1100, although the front wall 1750 may be designed to contact at least a portion of the nose 1108 to provide a surface that opposes the vertical tabs 1625. Thus, although the internal dimensions of the concave portion 1740 may not conform precisely to the shape of a corresponding portion of the device 1100, the internal dimensions may include surfaces that contact the corresponding portion of the device 1100 sufficiently to secure the attachment 1605 in place.

Figure 16A:
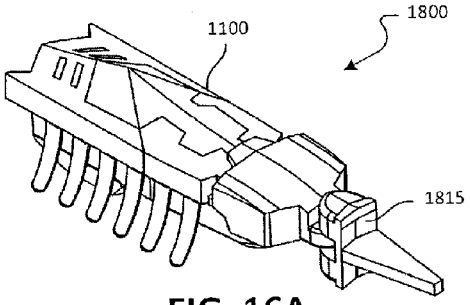
FIGS. 16A through 16F illustrate a vehicle that includes a device of FIG. 1 fitted with a front waving side-to-side blade attachment.
Figure 16B:
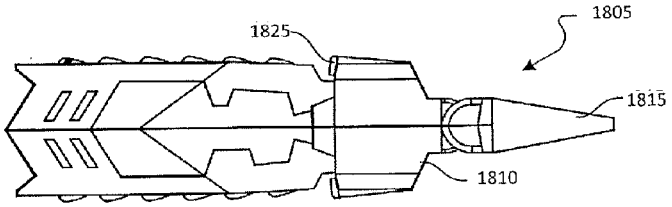
Figure 16C:
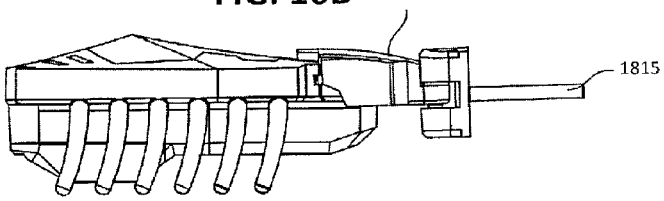
Figure 16D:
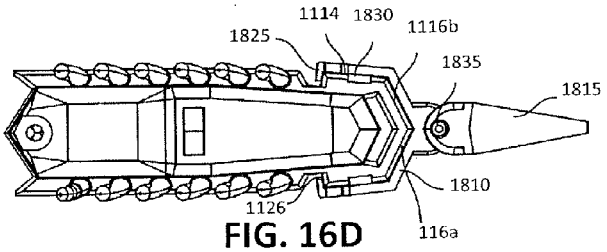
Figure 16E:
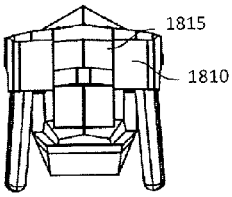
Figure 16F:
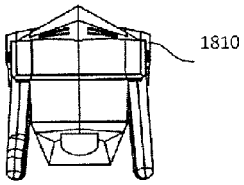

FIGS. 16A through 16F illustrate a vehicle 1800 that includes a device 1100 fitted with a front waving side-to-side blade attachment 1805. FIG. 16A is a perspective view of the vehicle 1800, FIG. 16B is a top view of the vehicle 1800, FIG. 16C is a side view of the vehicle 1800, FIG. 16D is a bottom view of the vehicle 1800, FIG. 16E is a front view of the vehicle 1800, and FIG. 16F is a back view of the vehicle 1800. The front waving side-to-side blade attachment 1805 includes a frame 1610 and a waving blade appendage 1815.

The frame 1810 can include features adapted to secure the attachment 1805 to the device 1100. For example, the frame 1810 can include vertical tabs 1825 adapted to engage a surface of the notch 1126 that separates the head from the body of the device 1100 to prevent unwanted movement of the attachment 1805 in a forward direction (i.e., in a direction toward the nose of the device). The frame 1810 can also include horizontal tabs 1830 adapted to engage the device 1100 just under the head side surface 1114 to prevent unwanted movement of the attachment 1805 in an upward direction (i.e., in a direction away from a support surface 1110 when the device 1100 is upright). Essentially, the vertical tabs 1825 and horizontal tabs 1830 can allow the attachment 1805 to snap into place on the device 1100 and to be removed from the device 100 (e.g., using an amount of force greater than the device 1100 experiences as a result of vibration during operation). The tabs 1825 and 1830, the frame 1810, and/or the body of the device 1100 can be sufficiently flexible to deflect and/or deform, thereby allowing the attachment 1805 to be fitted onto the device 1100 and removed from the device 1100 by a user. The frame 1810 may be configured to conform to the shape of the nose sides 1116*a*, 1116*b*. As noted above, in some embodiments the frame can be connected (integrally or otherwise) to the device body instead of being a separate and/or removable component.

The waving blade appendage 1815 is rotatably coupled to the frame 1810 of the front waving side-to-side blade attachment 1805 by an axle 1835 (e.g., a pin or screw) that defines an axis of rotation for the waving blade appendage 1815.

Figure 17A:
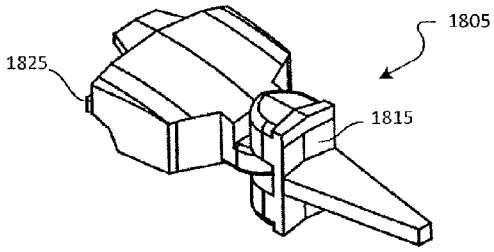
FIGS. 17A through 17F illustrate the front waving side-to-side blade attachment of FIGS. 16A-16F separate from the device of FIG. 1.
Figure 17B:
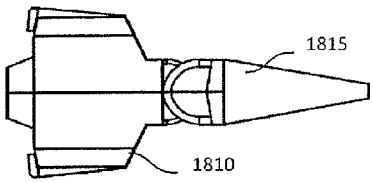
Figure 17C:
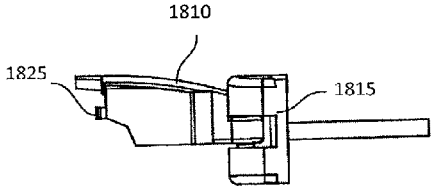
Figure 17D:
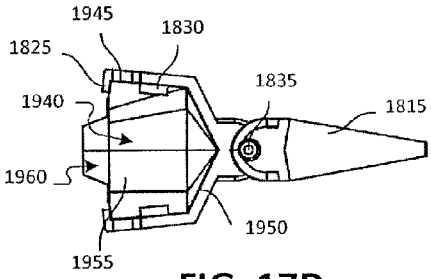
Figure 17E:
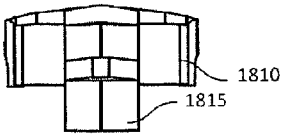
Figure 17F:
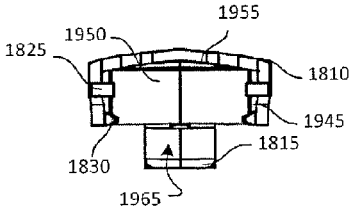

FIGS. 17A through 17F illustrate the front waving side-to-side blade attachment 1805 of FIGS. 17A-17F separate from the device 1100. FIG. 17A is a perspective view of the front waving side-to-side blade attachment 1805, FIG. 17B is a top view of the front waving side-to-side blade attachment 1805, FIG. 17C is a side view of the front waving side-to-side blade attachment 1805, FIG. 17D is a bottom view of the front waving side-to-side blade attachment 1805, FIG. 17E is a front view of the front waving side-to-side blade attachment 1805, and FIG. 17F is a back view of the front waving side-to-side blade attachment 1805. FIGS. 17A-17F illustrate many of the same features as shown in FIGS. 16A-16F. In addition, FIGS. 17D and 17F illustrate additional details of a concave portion 1940 of the front waving side-to-side blade attachment 1805 that fits onto the device 1100. In this case, for example, the concave portion 1940 is designed to substantially mate with a head portion of the device 1100.

As shown in FIGS. 17D and 17F, the concave portion 1940 is defined by sidewalls 1945, a front wall 1950, and a top wall 1955. The sidewalls 1945 of the concave portion 1940 terminate at the rear of the frame 1810 to define a rear opening 1960 and at the bottom of the frame 1810 to define a bottom opening 1965. Using these openings, the device 1100 can be inserted into the attachment 1805 from the rear opening 1960 or the bottom opening 1965 (or a combination by inserting the device 1100 at an angle). The sidewalls 1945, front wall 1950, and top wall 1955 are illustrated as having a shape that generally conforms to the shape of the corresponding portion of the device 1100. Thus, the internal dimensions may include surfaces that contact the corresponding portion of the device 1100 sufficiently to secure the attachment 1805 in place.

Figure 18A:
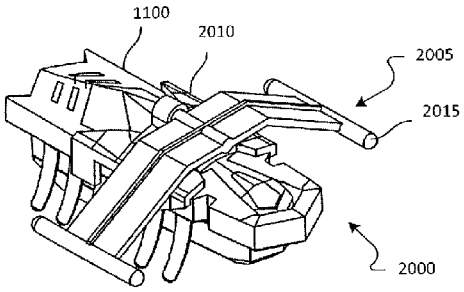
FIGS. 18A through 18F illustrate a vehicle that includes a device of FIG. 1 fitted with a rocking wing body attachment.
Figure 18B:
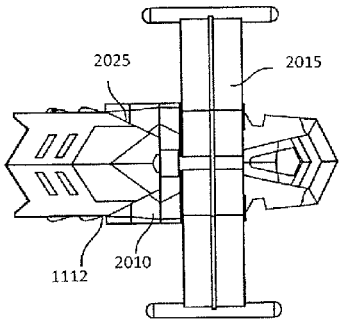
Figure 18C:
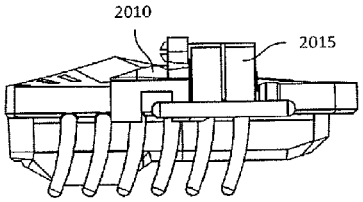
Figure 18D:
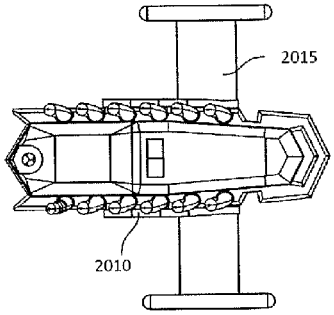
Figure 18E:
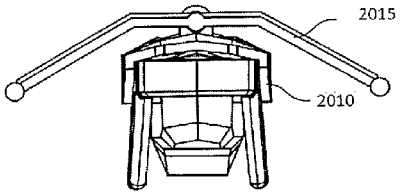
Figure 18F:
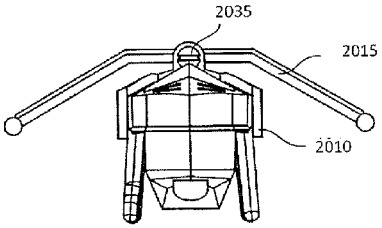

FIGS. 18A through 18F illustrate a vehicle 2000 that includes a device 1100 fitted with a rocking wing body attachment 2005. FIG. 18A is a perspective view of the vehicle 2000, FIG. 18B is a top view of the vehicle 2000, FIG. 18C is a side view of the vehicle 2000, FIG. 18D is a bottom view of the vehicle 2000, FIG. 18E is a front view of the vehicle 2000, and FIG. 18F is a back view of the vehicle 2000. The rocking wing body attachment 2005 includes a frame 2010 and a rocking wing appendage 2015.

The frame 2010 can include features adapted to secure the attachment 2005 to the device 1100. For example, the frame 2010 can include horizontal tabs 2030 (see, e.g., FIG. 19D) adapted to engage the device 1100 just under the body shoulder 1112 to prevent unwanted movement of the attachment 2005 in an upward direction (i.e., in a direction away from a support surface 1110 when the device 1100 is upright). In addition, the shape of the frame (at 2025 and 2155) can encourage mating between the frame 2010 and the body of the device 1100 at a particular location along the length of the body. Essentially, the frame shape and horizontal tabs 2030 can allow the attachment 2005 to snap into place on the device 1100 and to be removed from the device 1100 (e.g., using an amount of force greater than the device 1100 experiences as a result of vibration during operation). The tabs 2030, the frame 2010, and/or the body of the device 1100 can be sufficiently flexible to deflect and/or deform, thereby allowing the attachment 2005 to be fitted onto the device 1100 and removed from the device 1100 by a user. As noted above, in some embodiments the frame can be connected (integrally or otherwise) to the device body instead of being a separate and/or removable component.

The rocking wing appendage 2015 is rotatably coupled to the frame 2010 of the rocking wing body attachment 2005 by an axle 2035 (e.g., a pin or screw) that defines an axis of rotation for the rocking wing appendage 2015.

Figure 19A:
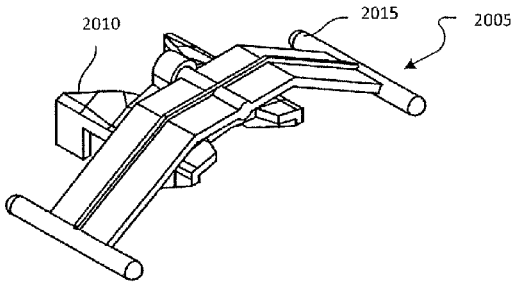
FIGS. 19A through 19F illustrate the rocking wing body attachment of FIGS. 18A-18F separate from the device of FIG. 1.
Figure 19B:
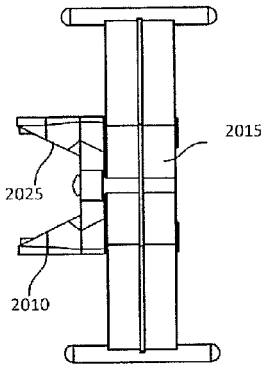
Figure 19C:
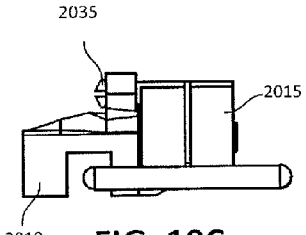
Figure 19D:
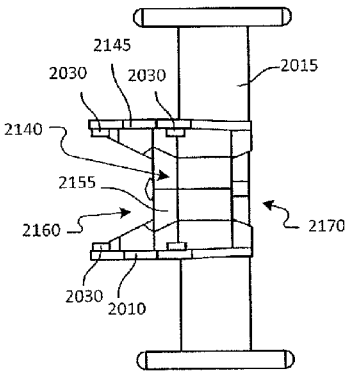
Figure 19E:
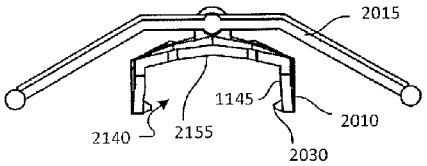
Figure 19F:
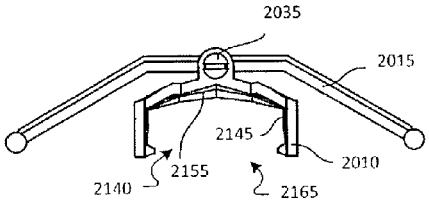

FIGS. 19A through 19F illustrate the rocking wing body attachment 2005 of FIGS. 19A-19F separate from the device 1100. FIG. 19A is a perspective view of the rocking wing body attachment 2005, FIG. 19B is a top view of the rocking wing body attachment 2005, FIG. 19C is a side view of the rocking wing body attachment 2005, FIG. 19D is a bottom view of the rocking wing body attachment 2005, FIG. 19E is a front view of the rocking wing body attachment 2005, and FIG. 19F is a back view of the rocking wing body attachment 2005. FIGS. 19A-19F illustrate many of the same features as shown in FIGS. 18A-18F. In addition, FIGS. 19D-19F illustrate additional details of a concave portion 2140 of the rocking wing body attachment 2005 that fits onto the device 1100. In this case, for example, the concave portion 2140 is designed to substantially mate with a middle body portion of the device 1100.

As shown in FIGS. 19D-19F, the concave portion 2140 is defined by sidewalls 2145 and a top wall 2155. The sidewalls

2145 of the concave portion 2140 terminate at the rear of the frame 2010 to define a rear opening 2160, at the bottom of the frame 2010 to define a bottom opening 2165, and at the front of the frame 2010 to define a front opening 2170. Using these openings, the device 1100 can be inserted into the attachment 2005 from the rear opening 2160, the bottom opening 2165, or the front opening 2170 (or a combination by inserting the device 1100 at an angle). The sidewalls 2145 and top wall 2155 are illustrated as having a shape that generally conforms to the shape of the corresponding portion of the device 1100. Thus, the internal dimensions may include surfaces that contact the corresponding portion of the device 1100 sufficiently to secure the attachment 11005 in place.

Figure 20A:
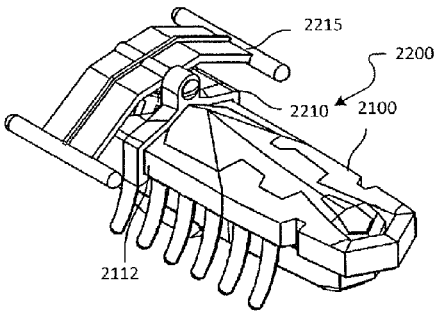
FIGS. 20A through 20F illustrate a vehicle that includes a device of FIG. 1 fitted with a rocking wing tail attachment.
Figure 20B:
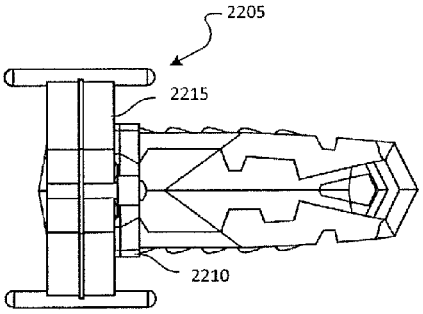
Figure 20C:
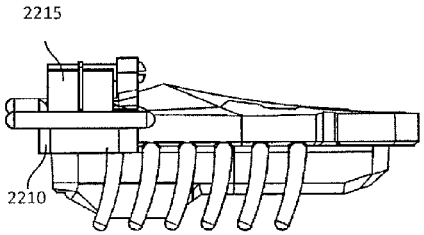
Figure 20D:
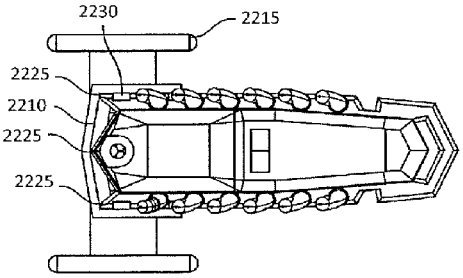
Figure 20E:
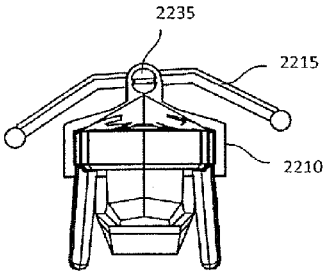
Figure 20F:
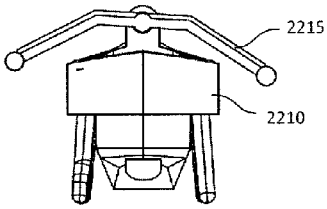

FIGS. 20A through 20F illustrate a vehicle 2200 that includes a device 1100 fitted with a rocking wing tail attachment 2205. FIG. 20A is a perspective view of the vehicle 2200, FIG. 20B is a top view of the vehicle 2200, FIG. 20C is a side view of the vehicle 2200, FIG. 20D is a bottom view of the vehicle 2200, FIG. 20E is a front view of the vehicle 2200, and FIG. 20F is a back view of the vehicle 2200. The rocking wing tail attachment 2205 includes a frame 2210 and a rocking wing appendage 2215.

The frame 2210 can include features adapted to secure the attachment 2205 to the device 1100. For example, the frame 2210 can include engage the tail end of the device 1100 at contact points 2225. The frame 2210 can also include horizontal tabs 2230 adapted to engage the device 1100 just under the body shoulders 1112 to prevent unwanted movement of the attachment 2205 in an upward direction (i.e., in a direction away from a support surface 1110 when the device 1100 is upright). Essentially, the contact points 2225 and horizontal tabs 2230 (along with the shape of the internal top wall 2355 shown in FIG. 21E) can allow the attachment 2205 to snap into place on the device 1100 and to be removed from the device 1100 (e.g., using an amount of force greater than the device 1100 experiences as a result of vibration during operation). The tabs 2230, the frame 2210, and/or the body of the device 1100 can be sufficiently flexible to deflect and/or deform, thereby allowing the attachment 2205 to be fitted onto the device 1100 and removed from the device 1100 by a user. The frame 2210 may be configured to have at least a somewhat different internal shape than the shape of the device body (e.g., the back portion of the frame 2210 need not conform to the shape of tail end of the device 1100, although, in some embodiments, frame 2210 can be configured to conform to the shape of the device tail). As noted above, in some embodiments the frame can be connected (integrally or otherwise) to the device body instead of being a separate and/or removable component.

The rocking wing appendage 2215 is rotatably coupled to the frame 2210 of the rocking wing tail attachment 2205 by a screw 2235 that serves as an axle and defines an axis of rotation for the rocking wing appendage 2215. Although the attachment 2205 is illustrated as using a screw 2235, other types of axles (e.g., a rod that projects from the frame that mates with a hollow cylinder of the appendage 2215) can also be used. Moreover, the axle can be fixedly attached to either the frame 2210 or the appendage 2215, or neither.

Figure 21A:
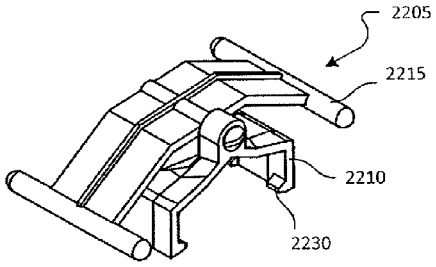
FIGS. 21A through 21F illustrate the rocking wing tail attachment of FIGS. 20A-20F separate from the device of FIG. 1.
Figure 21B:
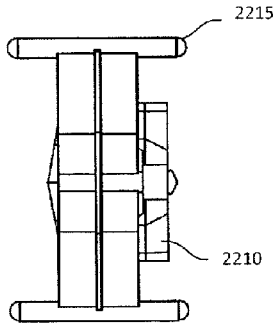
Figure 21C:
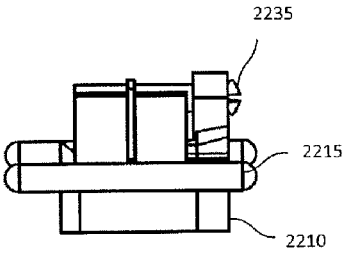
Figure 21D:
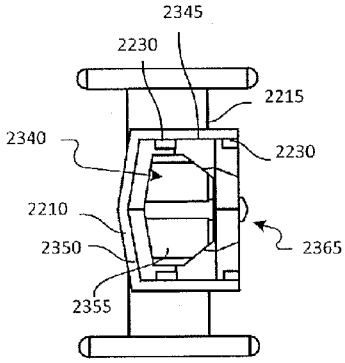
Figure 21E:
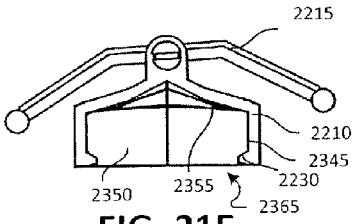
Figure 21F:
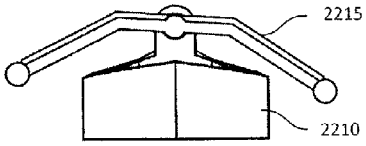

FIGS. 21A through 21F illustrate the rocking wing tail attachment 2205 of FIGS. 21A-21F separate from the device 1100. FIG. 21A is a perspective view of the rocking wing tail attachment 2205, FIG. 21B is a top view of the rocking wing tail attachment 2205, FIG. 21C is a side view of the rocking wing tail attachment 2205, FIG. 22D is a bottom view of the rocking wing tail attachment 2205, FIG. 22E is a front view of the rocking wing tail attachment 2205, and FIG. 22F is a back view of the rocking wing tail attachment 2205. FIGS. 21A-21F illustrate many of the same features as shown in FIGS. 19A-19F. In addition, FIGS. 21D and 21E illustrate additional details of a concave portion 2340 of the rocking wing tail attachment 2205 that fits onto the device 1100. In this case, for example, the concave portion 2340 is designed to substantially mate with a tail portion of the device 1100 of FIG. 1.

As shown in FIGS. 21D and 21E, the concave portion 2340 is defined by sidewalls 2345, a back wall 2350, and a top wall 2355. The sidewalls 2345 of the concave portion 2340 terminate at the front of the frame 2210 to define a front opening 2370 and at the bottom of the frame 2210 to define a bottom opening 2365. Using these openings, the device 1100 can be inserted into the attachment 2205 from the front opening 2370 or the bottom opening 2365 (or a combination). The sidewalls 2345 and top wall 2355 are illustrated as having a shape that generally conforms to the shape of the corresponding portion of the device 1100. The back wall 2350 is illustrated as have a shape that does not conform to the tail portion of the device 1100, although the back wall 2350 may be designed to contact the device at contact surfaces 2225 (see FIG. 20D). Thus, although the internal dimensions of the concave portion 2340 may not conform precisely to the shape of a corresponding portion of the device 1100, the internal dimensions may include surfaces that contact the corresponding portion of the device 1100 sufficiently to secure the attachment 2205 in place.

Figure 22A:
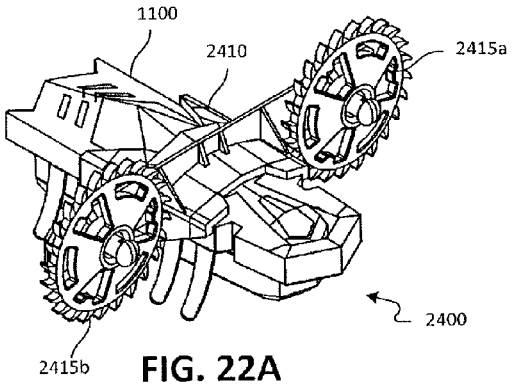
FIGS. 22A through 22F illustrate a vehicle that includes a device of FIG. 1 fitted with a dual side saw blades attachment.
Figure 22B:
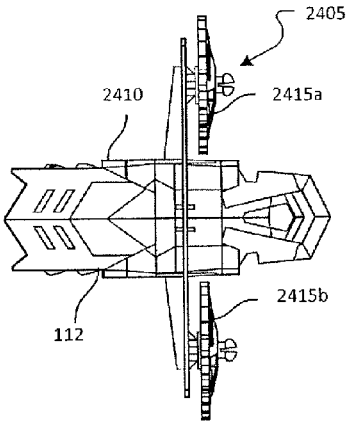
Figure 22C:
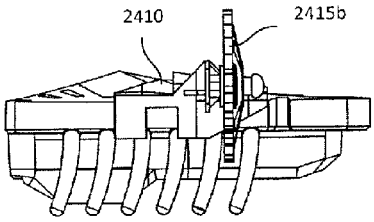
Figure 22D:
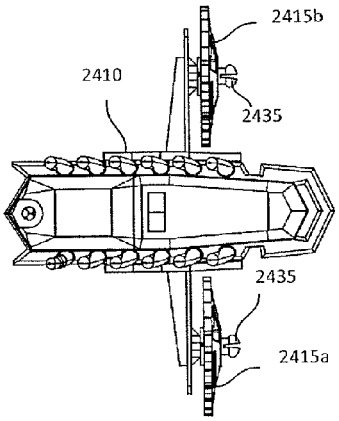
Figure 22E:
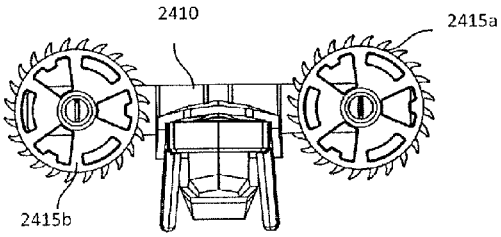
Figure 22F:
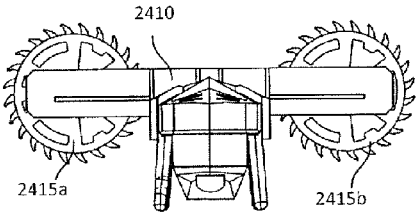

FIGS. 22A through 22F illustrate a vehicle 2400 that includes a device 1100 fitted with a dual side saw blades attachment 2405. FIG. 22A is a perspective view of the vehicle 2400, FIG. 22B is a top view of the vehicle 2400, FIG. 22C is a side view of the vehicle 2400, FIG. 22D is a bottom view of the vehicle 2400, FIG. 22E is a front view of the vehicle 2400, and FIG. 22F is a back view of the vehicle 2400. The dual side saw blades attachment 2405 includes a frame 2410 and saw blade appendages 2415.

The frame 2410 can include features adapted to secure the attachment 2405 to the device 1100. For example, the frame 2410 can include horizontal tabs 2430 (see, e.g., FIG. 23D) adapted to engage the device 1100 just under the body shoulder to prevent unwanted movement of the attachment 2405 in an upward direction (i.e., in a direction away from a support surface 1110 when the device 1100 is upright). In addition, the shape of the frame (at 2555) can encourage mating between the frame 2410 and the body of the device 1100 at a particular location along the length of the body. Essentially, the frame shape and horizontal tabs 2430 can allow the attachment 2405 to snap into place on the device 1100 and to be removed from the device 1100 (e.g., using an amount of force greater than the device 1100 experiences as a result of vibration during operation). The tabs 2430, the frame 2410, and/or the body of the device 1100 can be sufficiently flexible to deflect and/or deform, thereby allowing the attachment 2405 to be fitted onto the device 1100 and removed from the device 1100 by a user. As noted above, in some embodiments the frame can be connected (integrally or otherwise) to the device body instead of being a separate and/or removable component.

The saw blade appendages 2415 are rotatably coupled to the frame 2410 of the dual side saw blades attachment 2405 by axles 2435 (e.g., a pin or screw) that define respective axes of rotation for the saw blade appendages 2415.

Figure 23A:
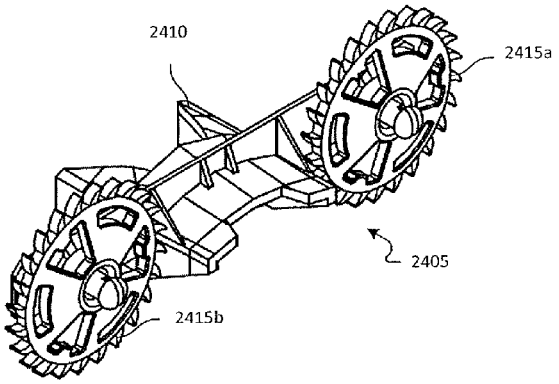
FIGS. 23A through 23F illustrate the dual side saw blades attachment of FIGS. 22A-22F separate from the device of FIG. 1.
Figure 23B:
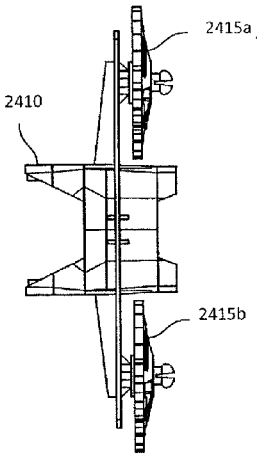
Figure 23C:
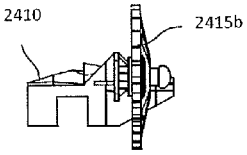
Figure 23D:
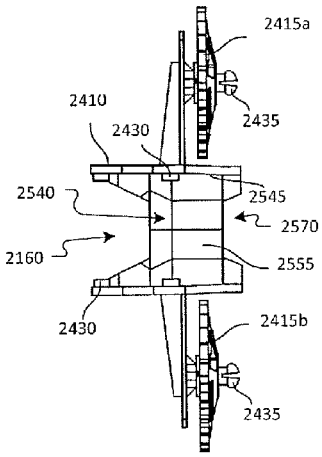
Figure 23E:
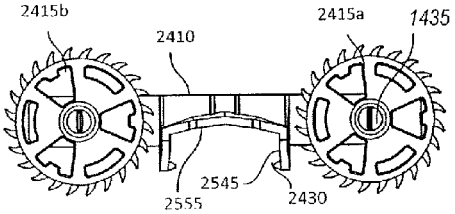
Figure 23F:
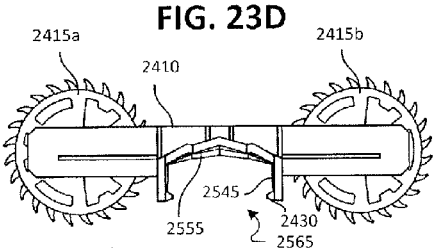

FIGS. 23A through 23F illustrate the dual side saw blades attachment 2405 of FIGS. 23A-23F separate from the device 1100. FIG. 23A is a perspective view of the dual side saw blades attachment 2405, FIG. 23B is a top view of the dual side saw blades attachment 2405, FIG. 23C is a side view of the dual side saw blades attachment 2405, FIG. 23D is a bottom view of the dual side saw blades attachment 2405, FIG. 23E is a front view of the dual side saw blades attachment 2405, and FIG. 23F is a back view of the dual side saw blades attachment 2405. FIGS. 23A-23F illustrate many of the same features as shown in FIGS. 23A-23F. In addition, FIGS. 23D-23F illustrate additional details of a concave portion 2540 of the dual side saw blades attachment 2405 that fits onto the device 1100. In this case, for example, the concave portion 2540 is designed to substantially mate with a middle body portion of the device 1100.

As shown in FIGS. 23D-23F, the concave portion 2540 is defined by sidewalls 2545 and a top wall 2555. The sidewalls 2545 of the concave portion 2540 terminate at the rear of the frame 2410 to define a rear opening 2560, at the bottom of the frame 2410 to define a bottom opening 2565, and at the front of the frame 2410 to define a front opening 2570. Using these openings, the device 1100 can be inserted into the attachment 2405 from the rear opening 2560, the bottom opening 2565, or the front opening 2570 (or a combination by inserting the device 1100 at an angle). The sidewalls 2545 and top wall 2555 are illustrated as having a shape that generally conforms to the shape of the corresponding portion of the device 1100. Thus, the internal dimensions may include surfaces that contact the corresponding portion of the device 1100 sufficiently to secure the attachment 2405 in place.

Figure 24A:
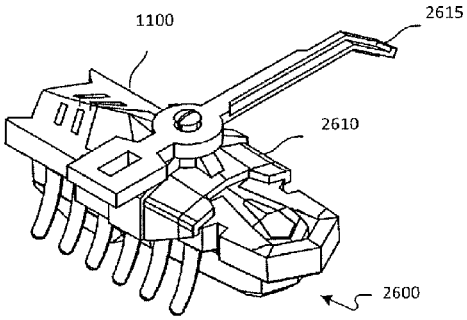
FIGS. 24A through 24F illustrate a vehicle that includes a device of FIG. 1 fitted with a spinning top blade body attachment.
Figure 24B:
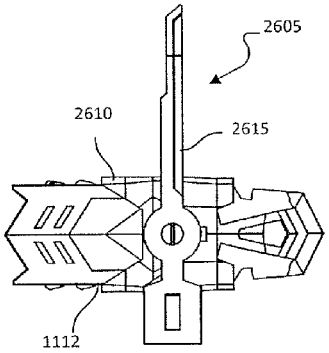
Figure 24C:
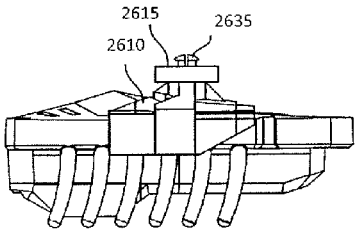
Figure 24D:
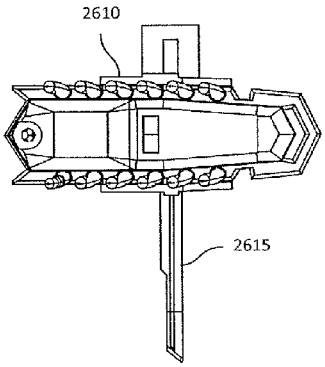
Figure 24E:
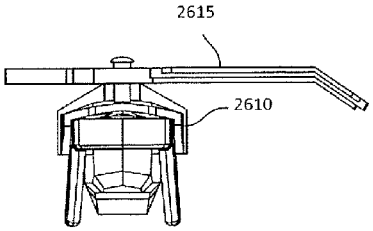
Figure 24F:
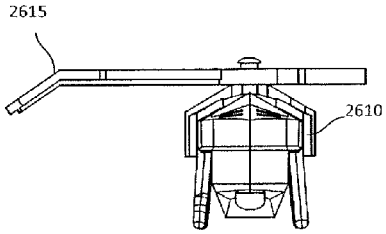

FIGS. 24A through 24F illustrate a vehicle 2600 that includes a device 1100 fitted with a spinning top blade body attachment 2605. FIG. 24A is a perspective view of the vehicle 2600, FIG. 24B is a top view of the vehicle 2600, FIG. 24C is a side view of the vehicle 2600, FIG. 24D is a bottom view of the vehicle 2600, FIG. 24E is a front view of the vehicle 2600, and FIG. 24F is a back view of the vehicle 2600. The spinning top blade body attachment 2605 includes a frame 2610 and a spinning blade appendage 2615.

The frame 2610 can include features adapted to secure the attachment 2605 to the device 1100. For example, the frame 2610 can include horizontal tabs 2630 (see, e.g., FIG. 25D) adapted to engage the device 1100 just under the body shoulder to prevent unwanted movement of the attachment 2605 in an upward direction (i.e., in a direction away from a support surface 1110 when the device 1100 is upright). In addition, the shape of the frame (at 2755) can encourage mating between the frame 2610 and the body of the device 1100 at a particular location along the length of the body. Essentially, the frame shape and horizontal tabs 2630 can allow the attachment 2605 to snap into place on the device 1100 and to be removed from the device 1100 (e.g., using an amount of force greater than the device 1100 experiences as a result of vibration during operation). The tabs 2630, the frame 2610, and/or the body of the device 1100 can be sufficiently flexible to deflect and/or deform, thereby allowing the attachment 2605 to be fitted onto the device 1100 and removed from the device 1100 by a user. As noted above, in some embodiments the frame can be connected (integrally or otherwise) to the device body instead of being a separate and/or removable component.

The spinning blade appendage 2615 is rotatably coupled to the frame 2610 of the spinning top blade body attachment 2605 by an axle 2635 (e.g., a pin or screw) that defines an axis of rotation for the spinning blade appendage 2615.

Figure 25A:
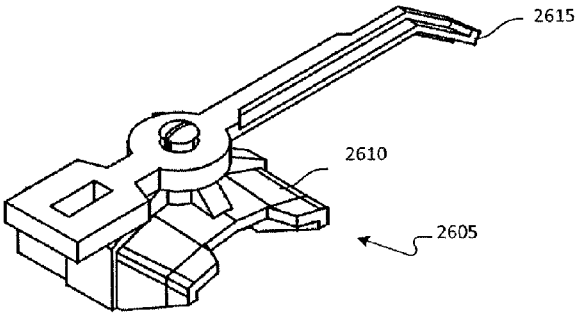
FIGS. 25A through 25F illustrate the spinning top blade body attachment of FIGS. 24A-24F separate from the device of FIG. 1.
Figure 25B:
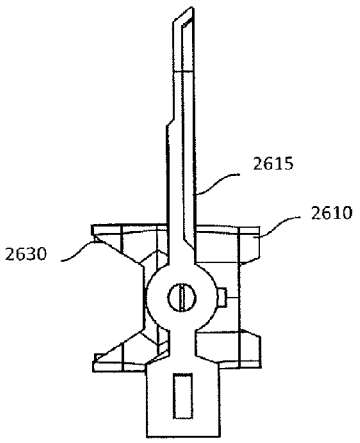
Figure 25C:
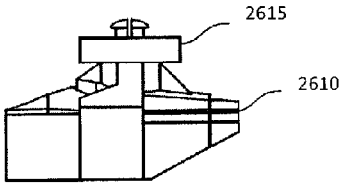
Figure 25D:
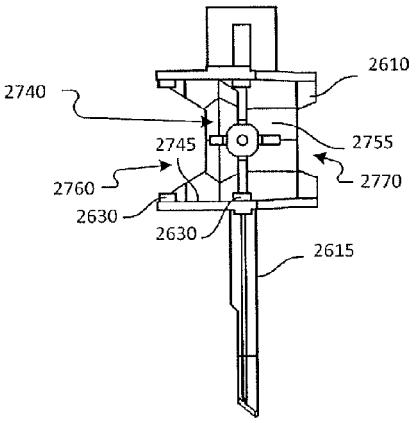
Figure 25E:
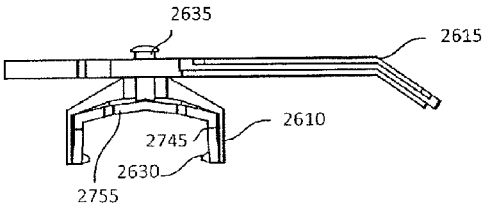
Figure 25F:
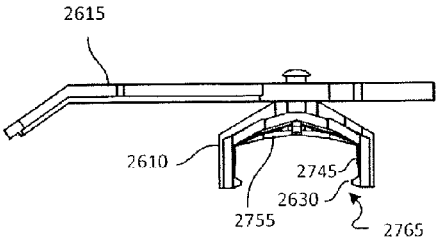

FIGS. 25A through 25F illustrate the spinning top blade body attachment 2605 of FIGS. 25A-25F separate from the device 1100. FIG. 25A is a perspective view of the spinning top blade body attachment 2605, FIG. 25B is a top view of the spinning top blade body attachment 2605, FIG. 25C is a side view of the spinning top blade body attachment 2605, FIG. 25D is a bottom view of the spinning top blade body attachment 2605, FIG. 25E is a front view of the spinning top blade body attachment 2605, and FIG. 25F is a back view of the spinning top blade body attachment 2605. FIGS. 25A-25F illustrate many of the same features as shown in FIGS. 24A-24F. In addition, FIGS. 25D-25F illustrate additional details of a concave portion 2740 of the spinning top blade body attachment 2605 that fits onto the device 1100. In this case, for example, the concave portion 2740 is designed to substantially mate with a middle body portion of the device 1100.

As shown in FIGS. 25D-25F, the concave portion 2740 is defined by sidewalls 2745 and a top wall 2755. The sidewalls 2745 of the concave portion 2740 terminate at the rear of the frame 2610 to define a rear opening 2760, at the bottom of the frame 2610 to define a bottom opening 2765, and at the front of the frame 2610 to define a front opening 2770. Using these openings, the device 1100 can be inserted into the attachment 2605 from the rear opening 2760, the bottom opening 2765, or the front opening 2770 (or a combination by inserting the device 1100 at an angle). The sidewalls 2745 and top wall 2755 are illustrated as having a shape that generally conforms to the shape of the corresponding portion of the device 1100. Thus, the internal dimensions may include surfaces that contact the corresponding portion of the device 1100 sufficiently to secure the attachment 2605 in place.

Figure 26A:
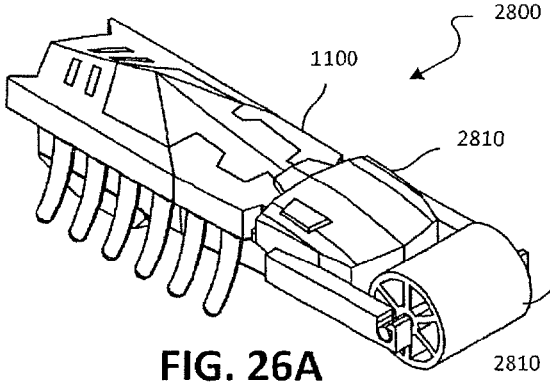
FIGS. 26A through 26F illustrate a vehicle that includes a device of FIG. 1 fitted with a front rotating drum attachment.
Figure 26B:
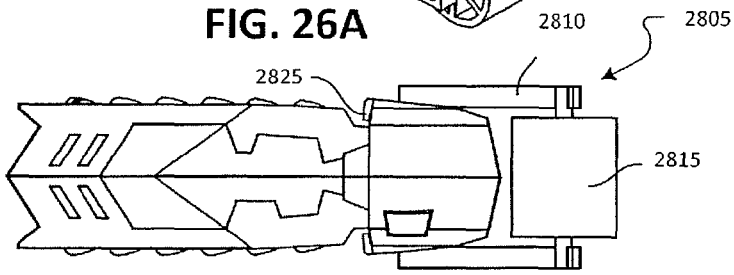
Figure 26C:
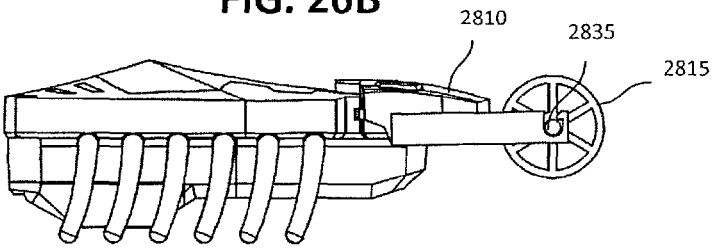
Figure 26D:
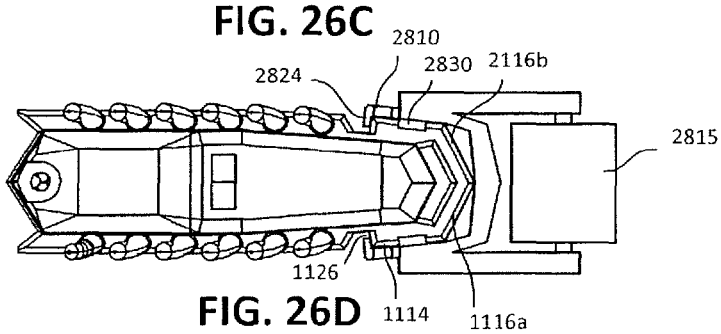
Figure 26E:
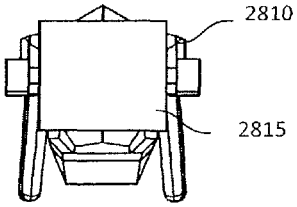
Figure 26F:
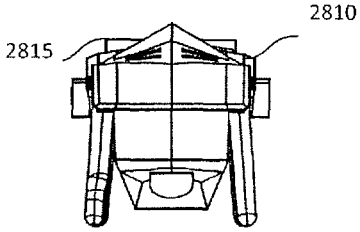

FIGS. 26A through 26F illustrate a vehicle 2800 that includes a device 1100 of fitted with a front rotating drum attachment 2805. FIG. 26A is a perspective view of the vehicle 2800, FIG. 26B is a top view of the vehicle 2800, FIG. 26C is a side view of the vehicle 2800, FIG. 26D is a bottom view of the vehicle 2800, FIG. 26E is a front view of the vehicle 2800, and FIG. 26F is a back view of the vehicle 2800. The front rotating drum attachment 2805 includes a frame 2810 and a rotating drum appendage 2815. The frame 2810 can include surface or three-dimensional ornamentation 2820. Such ornamentation 2820, in addition to providing aesthetic features, can provide an altered weight distribution of the vehicle 2800 relative to the device 1100 or relative to a vehicle similar to vehicle 2800 that does not include the ornamentation 2820. The altered weight distribution can counteract or otherwise alter motion tendencies induced by rotation of the appendage or can simply impact motion tendencies of the combined vehicle 2800 as the device 1100 vibrates.

The frame 2810 can include features adapted to secure the attachment 2805 to the device 1100. For example, the frame 2810 can include vertical tabs 2825 adapted to engage a surface of the notch 1126 that separates the head from the body of the device 1100 to prevent unwanted movement of the attachment 2805 in a forward direction (i.e., in a direction toward the nose of the device 1100). The frame 2810 can also include horizontal tabs 2830 adapted to engage the device 1100 just under the head side surface 1114 to prevent unwanted movement of the attachment 2805 in an upward direction (i.e., in a direction away from a support surface 1110 when the device 1100 is upright). Essentially, the vertical tabs 2825 and horizontal tabs 2830 can allow the attachment 2805 to snap into place on the device 1100 and to be removed from the device 1100 (e.g., using an amount of force greater than the device 1100 experiences as a result of vibration during operation). The tabs 2825 and 2830, the frame 2810, and/or the body of the device 1100 can be sufficiently flexible to deflect and/or deform, thereby allowing the attachment 2805 to be fitted onto the device 1100 and removed from the device 1100 by a user. The frame 2810 may be configured to have at least a somewhat different internal shape than the shape of the device body (e.g., the front portion of the frame 2810 need not conform to the shape of nose sides 1116*a*, 1116*b*, although, in some embodiments, frame 2810 can be configured to conform to the shape of the nose sides 1116*a*, 1116*b*). As noted above, in some embodiments the frame can be connected (integrally or otherwise) to the device body instead of being a separate and/or removable component.

The rotating drum appendage 2815 is rotatably coupled to the frame 2810 of the front rotating drum attachment 2805 by an axle 2835 that defines an axis of rotation for the rotating drum appendage 2815. Various types of axles can be used.

Figure 27A:
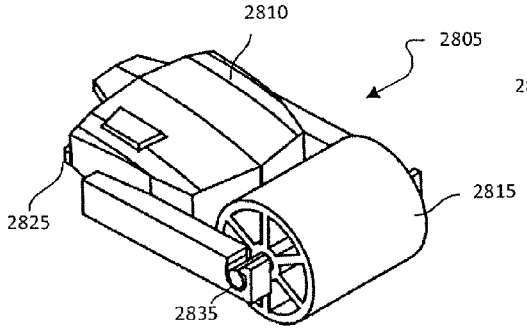
FIGS. 27A through 27F illustrate the front rotating drum attachment of FIGS. 26A-26F separate from the device of FIG. 1.
Figure 27B:
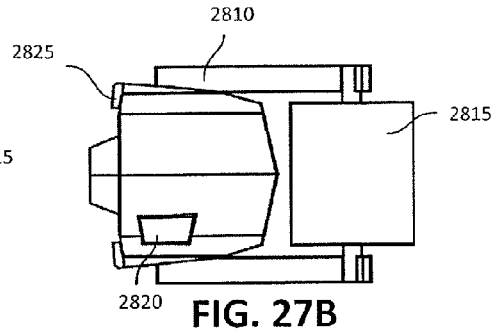
Figure 27C:
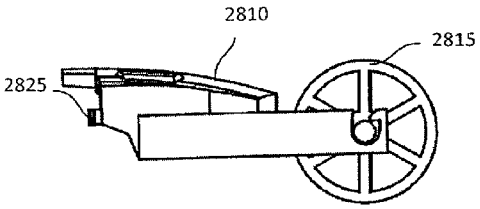
Figure 27D:
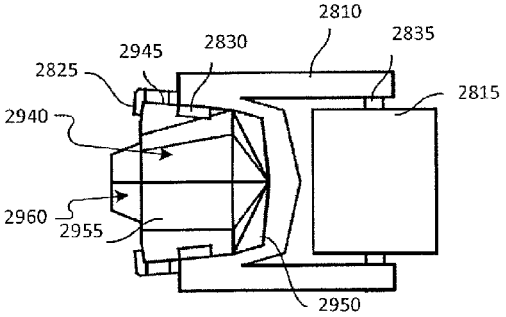
Figure 27E:
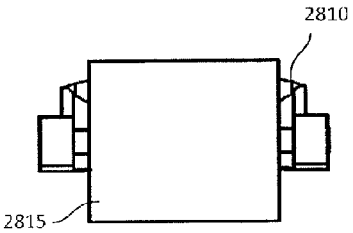
Figure 27F:
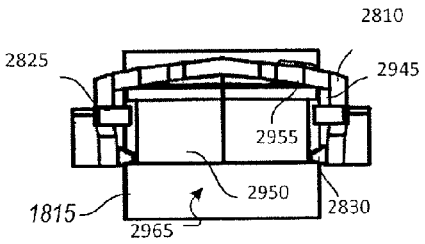

FIGS. 27A through 27F illustrate the front rotating drum attachment 2805 of FIGS. 26A-26F separate from the device 1100. FIG. 27A is a perspective view of the front rotating drum attachment 2805, FIG. 27B is a top view of the front rotating drum attachment 2805, FIG. 27C is a side view of the front rotating drum attachment 2805, FIG. 27D is a bottom view of the front rotating drum attachment 2805, FIG. 27E is a front view of the front rotating drum attachment 2805, and FIG. 27F is a back view of the front rotating drum attachment 2805. FIGS. 27A-27F illustrate many of the same features as shown in FIGS. 26A-26F. In addition, FIGS. 27D and 27F illustrate additional details of a concave portion 2940 of the front rotating drum attachment 2805 that fits onto the device 1100. In this case, for example, the concave portion 2940 is designed to substantially mate with a head portion of the device 1100.

As shown in FIGS. 27D and 27F, the concave portion 2940 is defined by sidewalls 2945, a front wall 2950, and a top wall 2955. The sidewalls 2945 of the concave portion 2940 terminate at the rear of the frame 2810 to define a rear opening 2960 and at the bottom of the frame 2810 to define a bottom opening 2965. Using these openings, the device 1100 can be inserted into the attachment 2805 from the rear opening 2960 or the bottom opening 2965 (or a combination). The sidewalls 2945 and top wall 2955 are illustrated as having a shape that generally conforms to the shape of the corresponding portion of the device 1100. The front wall 2950 is illustrated as have a shape that does not conform to the nose portion of the device 100, although the front wall 2950 may be designed to contact at least a portion of the nose to provide a surface that opposes the vertical tabs 2825. Thus, although the internal dimensions of the concave portion 2940 may not conform precisely to the shape of a corresponding portion of the device 1100, the internal dimensions may include surfaces that contact the corresponding portion of the device 1100 sufficiently to secure the attachment 2805 in place.

Figure 28A:
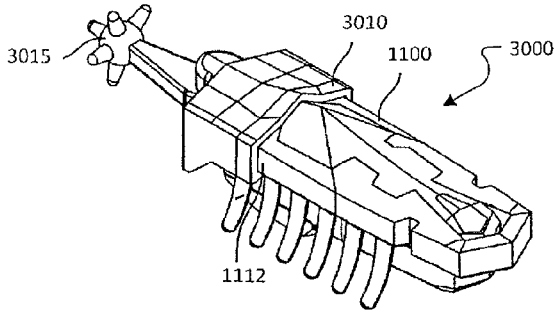
FIGS. 28A through 28F illustrate a vehicle that includes a device of FIG. 1 fitted with a side-to-side waving tail attachment.
Figure 28B:
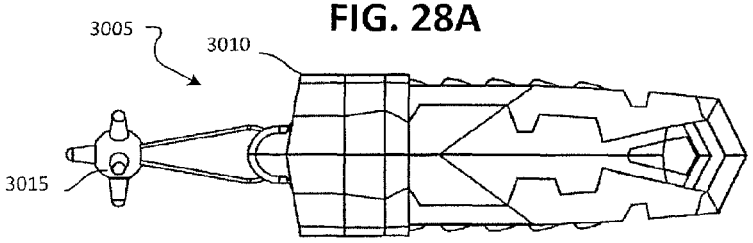
Figure 28C:
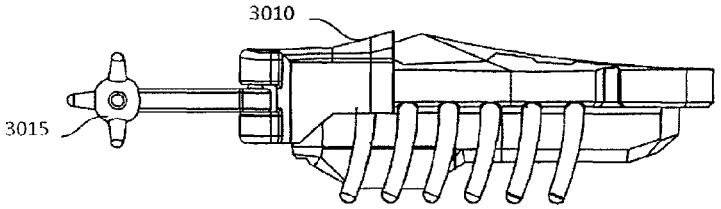
Figure 28D:
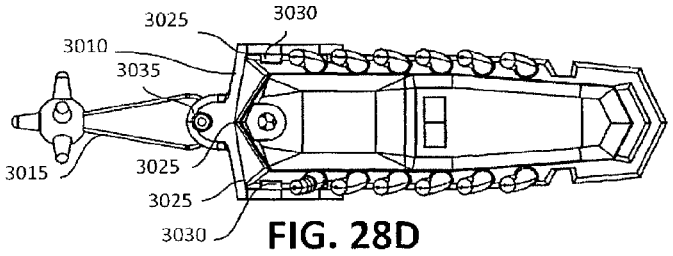
Figure 28E:
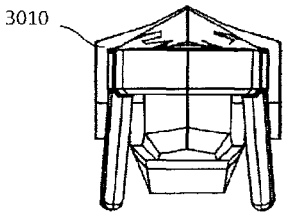
Figure 28F:
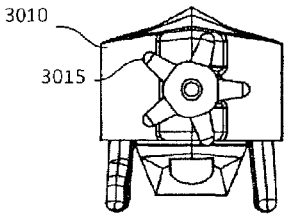

FIGS. 28A through 28F illustrate a vehicle 3000 that includes a device 1100 fitted with a side-to-side waving tail attachment 3005. FIG. 28A is a perspective view of the vehicle 3000, FIG. 28B is a top view of the vehicle 3000, FIG. 28C is a side view of the vehicle 3000, FIG. 28D is a bottom view of the vehicle 3000, FIG. 28E is a front view of the vehicle 3000, and FIG. 28F is a back view of the vehicle 3000. The side-to-side waving tail attachment 3005 includes a frame 3010 and a waving tail appendage 3015.

The frame 3010 can include features adapted to secure the attachment 3005 to the device 1100. For example, the frame 3010 can include engage the tail end of the device 1100 at contact points 3025. The frame 3010 can also include horizontal tabs 3030 adapted to engage the device 1100 just under the body shoulders to prevent unwanted movement of the attachment 3005 in an upward direction (i.e., in a direction away from a support surface when the device 1100 is upright). Essentially, the contact points 3025 and horizontal tabs 3030 (along with the shape of the internal top wall 3155 shown in FIG. 29E) can allow the attachment 3005 to snap into place on the device 1100 and to be removed from the device 1100 (e.g., using an amount of force greater than the device 1100 experiences as a result of vibration during operation). The tabs 3030, the frame 3010, and/or the body of the device 1100 can be sufficiently flexible to deflect and/or deform, thereby allowing the attachment 3005 to be fitted onto the device 1100 and removed from the device 1100 by a user. The frame 3010 may be configured to have at least a somewhat different internal shape than the shape of the device body (e.g., the back portion of the frame 3010 need not conform to the shape of tail end of the device 1100, although, in some embodiments, frame 3010 can be configured to conform to the shape of the device tail). As noted above, in some embodiments the frame can be connected (integrally or otherwise) to the device body instead of being a separate and/or removable component.

The waving tail appendage 3015 is rotatably coupled to the frame 3010 of the side-to-side waving tail attachment 3005 by a screw 3035 that serves as an axle and defines an axis of rotation for the waving tail appendage 3015. Although the attachment 3005 is illustrated as using a screw 3035, other types of axles (e.g., a rod that projects from the frame that mates with a hollow cylinder of the appendage 3015) can also be used. Moreover, the axle can be fixedly attached to either the frame 3010 or the appendage 3015, or neither.

Figure 29A:
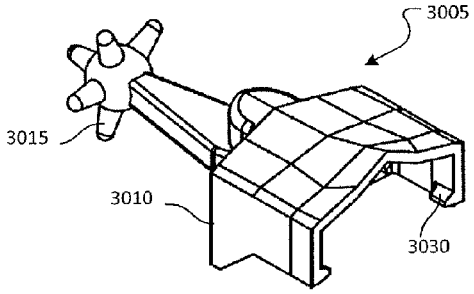
FIGS. 29A through 29F illustrate the side-to-side waving tail attachment of FIGS. 28A-28F separate from the device of FIG. 1.
Figure 29B:
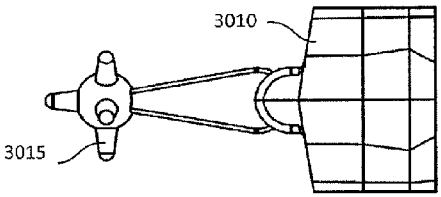
Figure 29C:
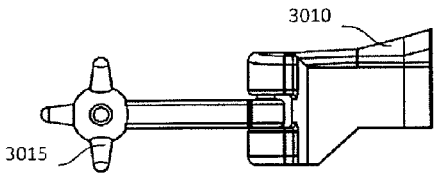
Figure 29D:
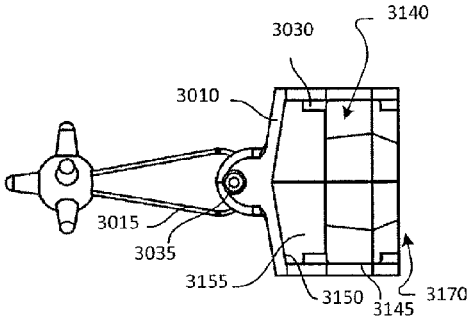
Figure 29E:
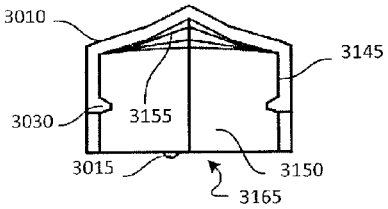
Figure 29F:
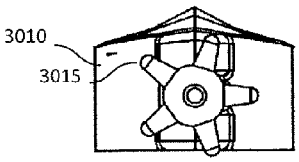

FIGS. 29A through 29F illustrate the side-to-side waving tail attachment 3005 of FIGS. 28A-28F separate from the device 1100. FIG. 29A is a perspective view of the side-to-side waving tail attachment 3005, FIG. 29B is a top view of the side-to-side waving tail attachment3, FIG. 29C is a side view of the side-to-side waving tail attachment 3005, FIG. 29D is a bottom view of the side-to-side waving tail attachment 3005, FIG. 29E is a front view of the side-to-side waving tail attachment 3005, and FIG. 29F is a back view of the side-to-side waving tail attachment 3005. FIGS. 29A-29F illustrate many of the same features as shown in FIGS. 28A-28F. In addition, FIGS. 29D and 29E illustrate additional details of a concave portion 3140 of the side-to-side waving tail attachment 3005 that fits onto the device 1100. In this case, for example, the concave portion 3140 is designed to substantially mate with a tail portion of the device 1100.

As shown in FIGS. 29D and 29E, the concave portion 3140 is defined by sidewalls 3145, a back wall 3150, and a top wall 3155. The sidewalls 3145 of the concave portion 3140 terminate at the front of the frame 3010 to define a front opening 3170 and at the bottom of the frame 3010 to define a bottom opening 3165. Using these openings, the device 1100 can be inserted into the attachment 3005 from the front opening 3170 or the bottom opening 3165 (or a combination). The sidewalls 3145 and top wall 3155 are illustrated as having a shape that generally conforms to the shape of the corresponding portion of the device 1100. The back wall 3150 is illustrated as have a shape that does not conform to the tail portion of the device 1100, although the back wall 3150 may be designed to contact the device at contact surfaces 3025 (see FIG. 28D). Thus, although the internal dimensions of the concave portion 2340 may not conform precisely to the shape of a corresponding portion of the device 1100, the internal dimensions may include surfaces that contact the corresponding portion of the device 1100 sufficiently to secure the attachment 3005 in place.

Figure 30A:
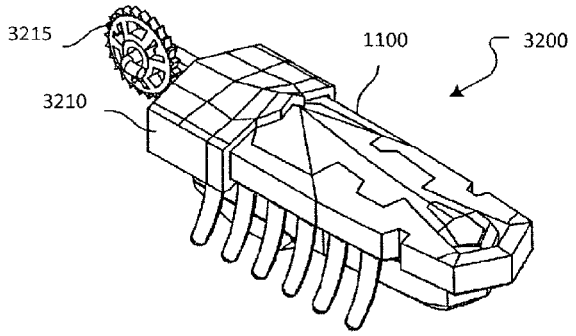
FIGS. 30A through 30F illustrate a vehicle that includes a device of FIG. 1 fitted with a rear sideways spinning blade attachment.
Figure 30B:
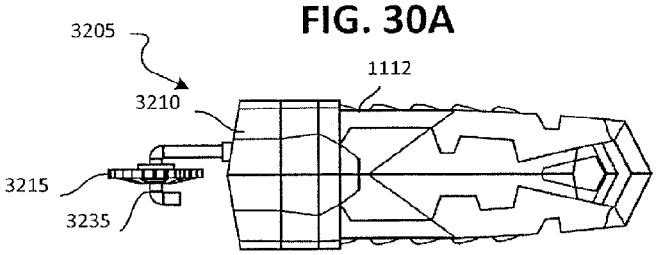
Figure 30C:
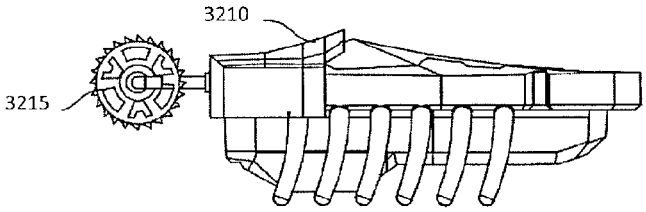
Figure 30D:
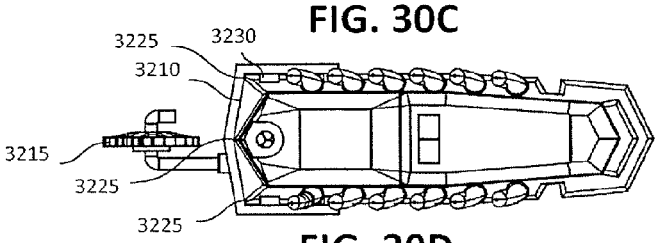
Figure 30E:
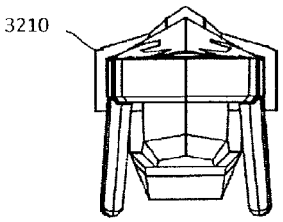
Figure 30F:
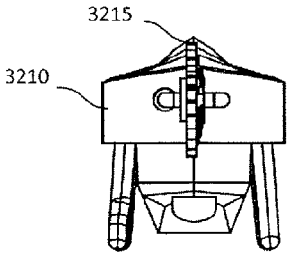

FIGS. 30A through 30F illustrate a vehicle 3200 that includes a device 1100 fitted with a rear sideways spinning blade attachment 3205. FIG. 30A is a perspective view of the vehicle 3200, FIG. 30B is a top view of the vehicle 3200, FIG. 30C is a side view of the vehicle 3200, FIG. 30D is a bottom view of the vehicle 3200, FIG. 30E is a front view of the vehicle 3200, and FIG. 30F is a back view of the vehicle 3200.

The rear sideways spinning blade attachment 3205 includes a frame 3210 and a spinning blade appendage 3215.

The frame 3210 can include features adapted to secure the attachment 3205 to the device 1100. For example, the frame 3210 can include engage the tail end of the device 1100 at contact points 3225. The frame 3210 can also include horizontal tabs 3230 adapted to engage the device 1100 just under the body shoulders to prevent unwanted movement of the attachment 3205 in an upward direction (i.e., in a direction away from a support surface 1110 when the device 1100 is upright). Essentially, the contact points 3225 and horizontal tabs 3230 (along with the shape of the internal top wall 3355 shown in FIG. 31E) can allow the attachment 3205 to snap into place on the device 1100 and to be removed from the device 1100 (e.g., using an amount of force greater than the device 1100 experiences as a result of vibration during operation). The tabs 3230, the frame 3210, and/or the body of the device 1100 can be sufficiently flexible to deflect and/or deform, thereby allowing the attachment 3205 to be fitted onto the device 1100 and removed from the device 1100 by a user. The frame 3210 may be configured to have at least a somewhat different internal shape than the shape of the device body (e.g., the back portion of the frame 3210 need not conform to the shape of tail end of the device 1100, although, in some embodiments, frame 3210 can be configured to conform to the shape of the device tail). As noted above, in some embodiments the frame can be connected (integrally or otherwise) to the device body instead of being a separate and/or removable component.

The spinning blade appendage 3215 is rotatably coupled to the frame 3210 of the rear sideways spinning blade attachment 3205 by an axle 3235 that defines an axis of rotation for the spinning blade appendage 3215. Other types of axles can also be used. Moreover, the axle can be fixedly attached to either the frame 3210 or the appendage 3215, or neither.

Figure 31A:
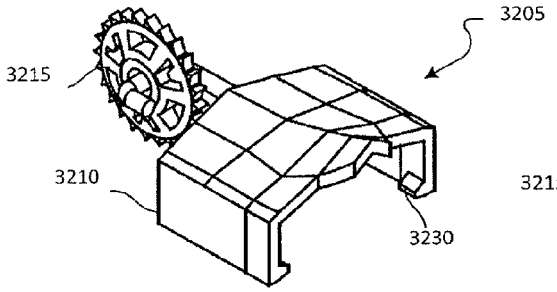
FIGS. 31A through 31F illustrate the rear sideways spinning blade attachment of FIGS. 30A-30F separate from the device of FIG. 1.
Figure 31B:
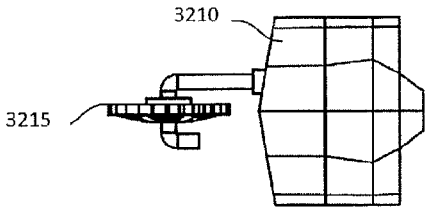
Figure 31C:
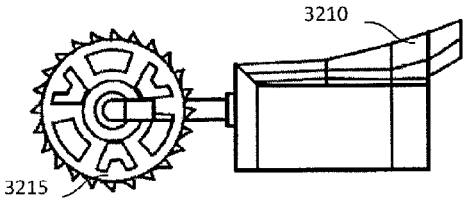
Figure 31D:
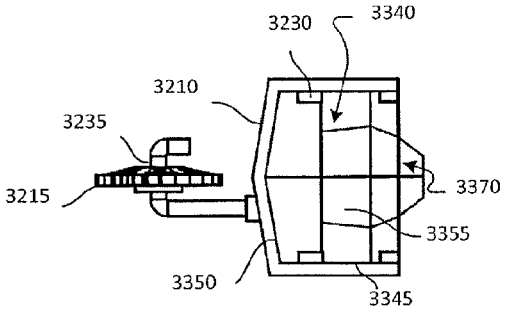
Figure 31E:
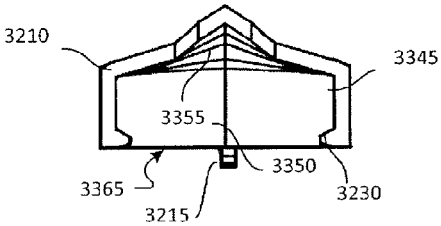
Figure 31F:
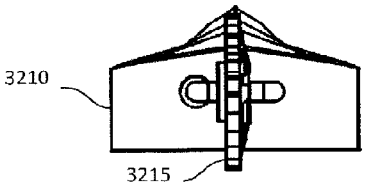

FIGS. 31A through 31F illustrate the rear sideways spinning blade attachment 3205 of FIG. 30A-30F separate from the device 1100. FIG. 31A is a perspective view of the rear sideways spinning blade attachment 3205, FIG. 31B is a top view of the rear sideways spinning blade attachment 3205, FIG. 31C is a side view of the rear sideways spinning blade attachment 3205, FIG. 31D is a bottom view of the rear sideways spinning blade attachment 3205, FIG. 31E is a front view of the rear sideways spinning blade attachment 2205, and FIG. 23F is a back view of the rear sideways spinning blade attachment 3205. FIGS. 31A-31F illustrate many of the same features as shown in FIGS. 30A-30F. In addition, FIGS. 31D and 31E illustrate additional details of a concave portion 3340 of the rear sideways spinning blade attachment 3205 that fits onto the device 1100. In this case, for example, the concave portion 3340 is designed to substantially mate with a tail portion of the device 1100.

As shown in FIGS. 31D and 31E, the concave portion 3340 is defined by sidewalls 3345, a back wall 3350, and a top wall 3355. The sidewalls 3345 of the concave portion 3340 terminate at the front of the frame 3210 to define a front opening 3370 and at the bottom of the frame 3210 to define a bottom opening 3365. Using these openings, the device 1100 can be inserted into the attachment 3205 from the front opening 3370 or the bottom opening 3365 (or a combination). The sidewalls 3345 and top wall 3355 are illustrated as having a shape that generally conforms to the shape of the corresponding portion of the device 1100. The back wall 3350 is illustrated as have a shape that does not conform to the tail portion of the device 1100, although the back wall 3350 may be designed to contact the device at contact surfaces 3225 (see FIG. 31D). Thus, although the internal dimensions of the concave portion 3340 may not conform precisely to the shape of a corresponding portion of the device 1100, the internal dimensions may include surfaces that contact the corresponding portion of the device 1100 sufficiently to secure the attachment 3205 in place.

Attachments, such as those described above, can also be used in combination on a single device 1100. For example, head, body, and/or rear attachments can be attached to a device 1100 concurrently. The attachments can include both moving and non-moving appendages. In some cases, the attachments can overlap one another. For example, the frame of one attachment may overlap the frame of another attachment. In some embodiments, as discussed above, the attachments can be more permanently connected to the body of the device 1100 (e.g., integrally molded as one piece, co-molded as one piece, or otherwise connected together).

Figure 32A:
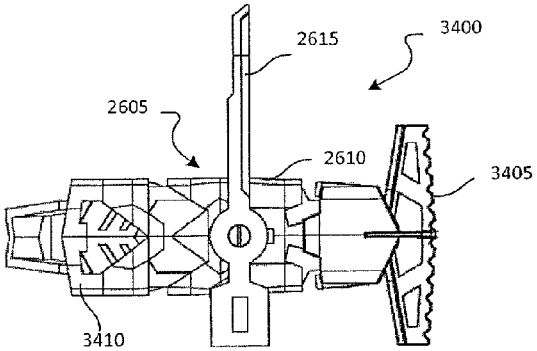
FIGS. 32A through 32D illustrate a vehicle that includes a device of FIG. 1 fitted with both moving and non-moving parts.
Figure 32B:
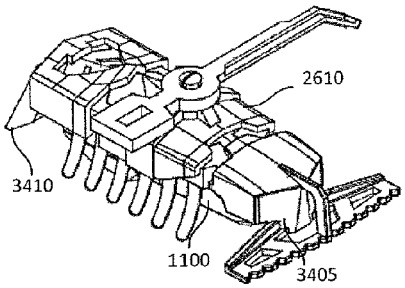
Figure 32C:
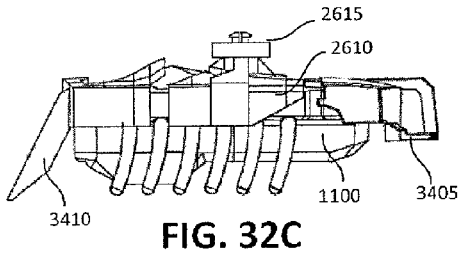
Figure 32D:
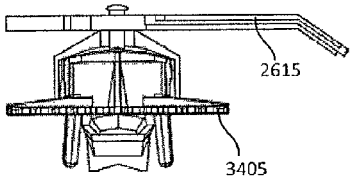

FIGS. 32A through 32D illustrate a vehicle 3400 that includes a device 1100 fitted with both moving and non-moving parts, including a front sweeper attachment 3405, a rear dragging attachment 3410, and a spinning top blade body attachment 2605 (see FIGS. 24A-24F) that includes a frame 2610 and a spinning blade appendage 2615. FIG. 32A is a top view of the vehicle 3400, FIG. 32B is a perspective view of the vehicle 3400, FIG. 32C is a side view of the vehicle 3400, and FIG. 32D is a front view of the vehicle 3400. In this case, the front sweeper attachment 3405 and the rear dragging attachment 3410 attach in a manner similar to some of the attachments described above but do not include moving parts.

Figure 33A:
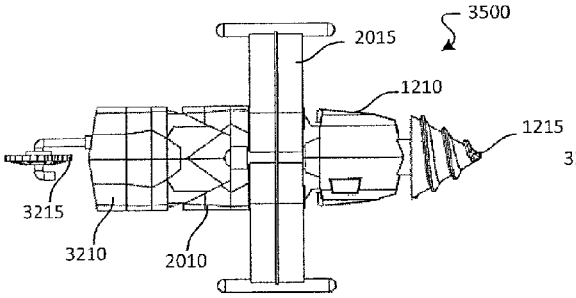
FIGS. 33A through 33D illustrate a vehicle that includes a device of FIG. 1 fitted with multiple moving parts.
Figure 33B:
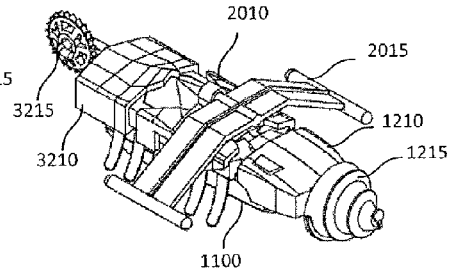
Figure 33C:
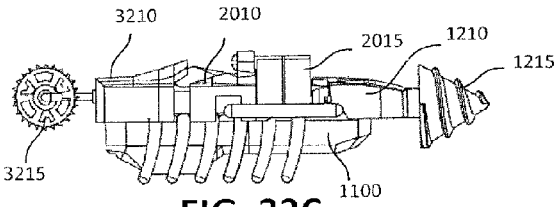
Figure 33D:
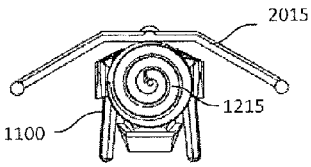

FIGS. 33A through 33D illustrate a vehicle 3500 that includes a device 1100 fitted with multiple moving parts, including a spinning drill head attachment 1205 that includes a frame 1210 and a drill bit appendage 1215 (see FIGS. 10A-10F), rocking wing body attachment 2005 includes a frame 2010 and a rocking wing appendage 2015 (see FIGS. 18A-18F), and a rear sideways spinning blade attachment 3205 includes a frame 3210 and a spinning blade appendage 3215 (see FIGS. 30A-30F). FIG. 33A is a top view of the vehicle 3500, FIG. 33B is a perspective view of the vehicle 3500, FIG. 33C is a side view of the vehicle 3500, and FIG. 33D is a front view of the vehicle 3500.

Figure 34A:
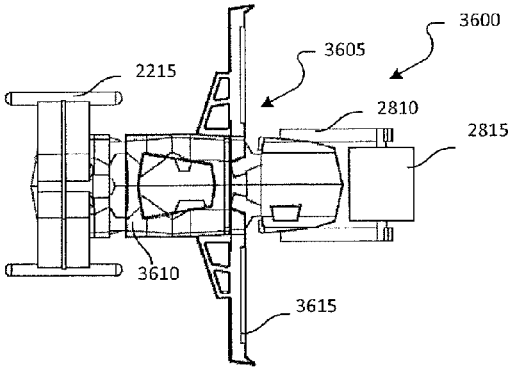
FIGS. 34A through 34D illustrate a vehicle that includes a device of FIG. 1 fitted with both moving and non-moving parts.
Figure 34B:
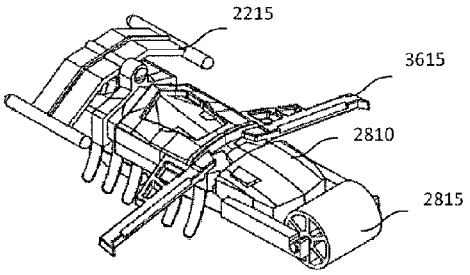
Figure 34C:
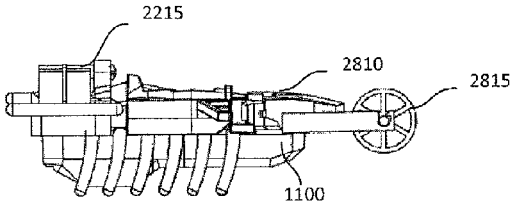
Figure 34D:
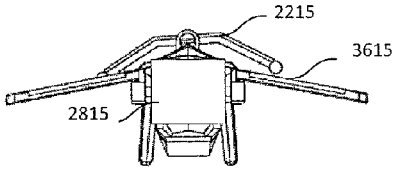

FIGS. 34A through 34D illustrate a vehicle 3600 that includes a device 1100 fitted with both moving and non-moving parts, including a rocking wing tail attachment 2205 includes a frame 2210 and a rocking wing appendage 2215 (see FIGS. 20A-20F), a front rotating drum attachment 2805 includes a frame 2810 and a rotating drum appendage 2815 (see FIGS. 26A-26F), and a body sweeper attachment 3605 that includes a frame 3610 and a lateral sweeper appendage 3615. FIG. 34A is a top view of the vehicle 3600, FIG. 34B is a perspective view of the vehicle 3600, FIG. 34C is a side view of the vehicle 3600, and FIG. 34D is a front view of the vehicle 3600.

Figure 35A:
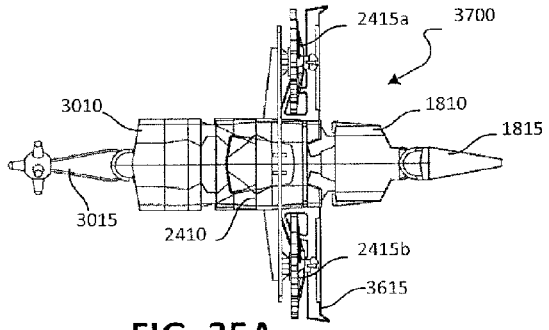
FIGS. 35A through 35D illustrate a vehicle that includes a device of FIG. 1 fitted with both moving and non-moving parts.
Figure 35B:
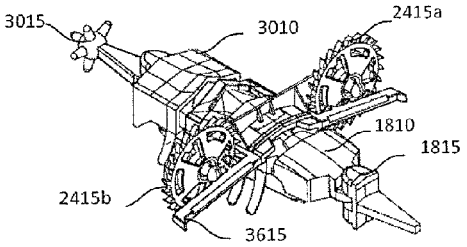
Figure 35C:
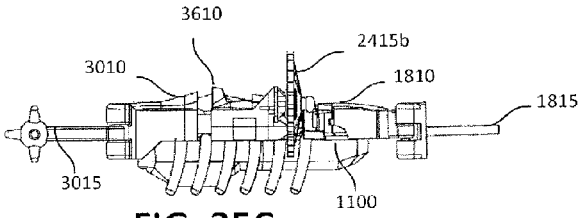
Figure 35D:
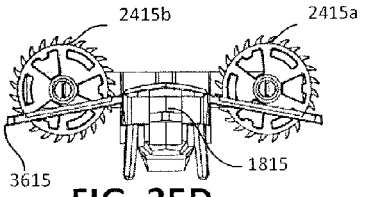

FIGS. 35A through 35D illustrate a vehicle 3700 that includes a device 1100 fitted with both moving and non-moving parts, including a front waving side-to-side blade attachment 1805 includes a frame 1810 and a waving blade appendage 1815 (see FIGS. 16A-16F), dual side saw blades attachment 2405 includes a frame 2410 and saw blade appendages 2415 (see FIGS. 22A-22F), a side-to-side waving tail attachment 3005 includes a frame 3010 and a waving tail appendage 3015 (see FIGS. 28A-28F), and a body sweeper attachment 3605 that includes a frame 3610 and a lateral sweeper appendage 3615. FIG. 35A is a top view of the vehicle 3700, FIG. 35B is a perspective view of the vehicle 3700, FIG. 35C is a side view of the vehicle 3700, and FIG. 35D is a front view of the vehicle 3700. In the illustrated embodiment, the frame 2410 of the dual side saw blades attachment 2405 is fitted on the device 1100 over the frame 3610 of the lateral sweeper appendage 3615.

Figure 36:
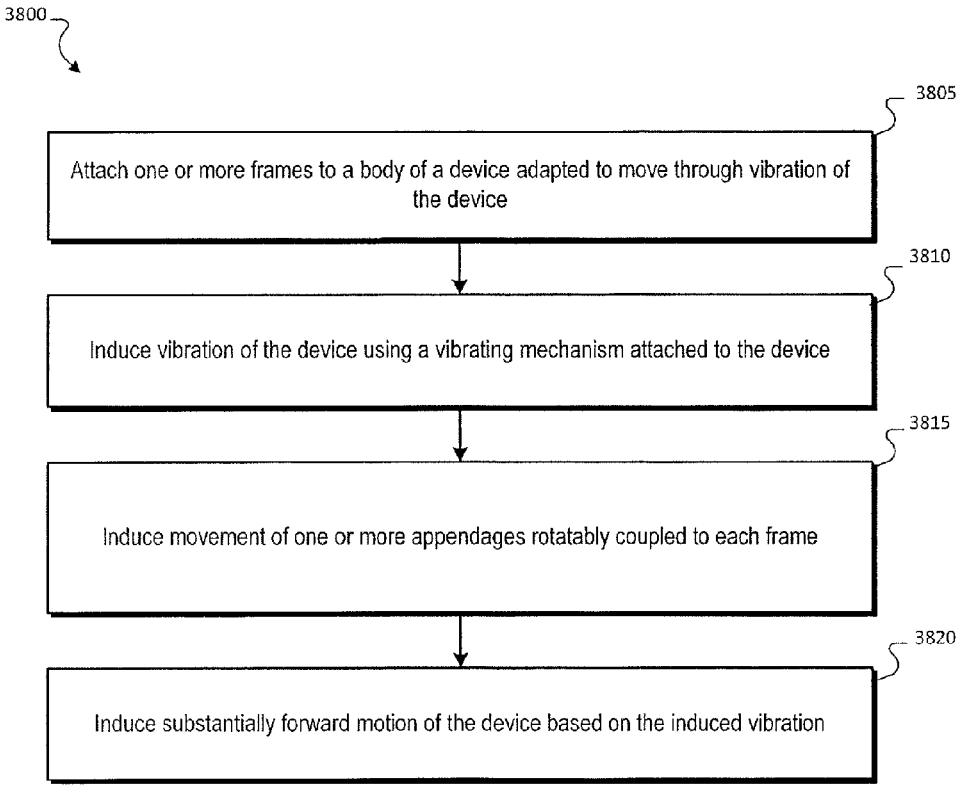
FIG. 36 is a flow diagram of a process for using a device and one or more attachments.

FIG. 36 is a flow diagram of a process 3800 for using a device and one or more attachments, such as the device 1100 and any of the attachments described above. The process 3800 includes attaching a frame to a body of a device that is designed and configured to move based on vibration of the device at 3805. The frame can be attached to the body of the device through an engagement between an interior concave portion shaped to substantially conform to an exterior portion of the body of the device. The attachment can be accomplished by engaging the body of the device with a plurality of tabs attached to the frame and one or more surfaces of the frame opposing the plurality of tabs (e.g., front wall 1350 opposing vertical tabs 1225 and top wall 1355 opposing horizontal tabs 1230 of FIGS. 11D and 11F). The tabs, body of the device, and/or the frame can be configured or constructed to allow disengaging the frame from the device (e.g., by disengaging the tabs from the body of the device). In some embodiments, however, the frame can be integrally formed with the body of the device or the appendage can be rotatably connected directly to the body of the device. In some cases, more than one frame can be attached to the device. Vibration of the device is induced using a vibrating mechanism attached to the device at 3810. For example, the vibrating mechanism can include a rotational motor coupled to the body of the device and adapted to rotate an eccentric load.

Movement of an appendage rotatably coupled to the frame is induced at 3815. For example, the movement of the appendage can include rotation about an axis of rotation. The axis of rotation can be defined by an axle that rotatably couples the appendage to the frame. The movement can result from vibration of the device and/or other forces that are induced by the vibrating mechanism when the frame is attached to the body of the device. Each frame can include one or more appendages, and each appendage can be rotatably or fixedly coupled to the corresponding frame. In some cases, a coupling between an appendage and the corresponding frame can allow other types of movement in addition to or other than rotation. Substantially forward motion of the device (e.g., across a support surface) can be induced at 2820 based on the induced vibration. The axis of rotation for a particular rotating appendage can be situated at least substantially parallel to a direction of forward motion of the device or situated at least substantially perpendicular to a direction of forward motion of the device. The appendage (e.g., drill bit appendage 1215 of FIGS. 10A-10F and 11A-11F) can repeatedly and substantially continuously rotate in a particular direction based on forces induced from the vibration of the device when the frame is attached to the body of the device. Alternatively, the appendage (e.g., waving blade appendage 1815 of FIGS. 16A-16F and 17A-17F) can rotate back and forth as the device vibrates when the frame is attached to the body of the device.

While this specification contains many specific implementation details, these should not be construed as limitations on the scope of any inventions or of what may be claimed, but rather as descriptions of features specific to particular embodiments of particular inventions. Certain features that are described in this specification in the context of separate embodiments can also be implemented in combination in a single embodiment. Conversely, various features that are described in the context of a single embodiment can also be implemented in multiple embodiments separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination. Other alternative embodiments can also be implemented. For example, some implementations of the device 100 can omit the use of rubber. Some implementations of the device 100 can include components (e.g., made of plastic) that include glow-in-the-dark qualities so that the device 100 can be seen in a darkened room as it moves across the surface 110 (e.g., a kitchen floor). Some implementations of the device 100 can include a light (e.g., an LED bulb) that blinks intermittently as the device 100 travels across the surface 110.

Thus, particular embodiments of the subject matter have been described. Other embodiments are within the scope of the following claims.

We claim:

1. An apparatus comprising:

a body;

a rotational motor coupled to the body;

an eccentric load, wherein the rotational motor is adapted to rotate the eccentric load;

a plurality of legs each having a leg base and a leg tip at a distal end relative to the leg base and wherein at least one leg, of the plurality of legs, has an average axial cross-section of at least five percent of a length of the at least one leg between the leg base and the leg tip, and wherein the legs are coupled to the body and include at least one driving leg constructed from a flexible material and configured to cause the apparatus to move in a direction generally defined by an offset between the leg base and the leg tip as the rotational motor rotates the eccentric load;

a frame adapted to releasably attach to a portion of the body; and an appendage rotatably coupled to the frame about an axis of rotation, the appendage configured to freely rotate about the ands when the frame is attached to the body as the rotational motor rotates the eccentric load to induce a vibrational motion of the apparatus.

2. The apparatus of claim 1, wherein the frame includes a plurality of tabs adapted for releasably attaching the frame to the body and the frame further includes a surface opposing the plurality of tabs, the surface and the plurality of tabs adapted to engage a portion of the body.

3. The apparatus of claim 1, wherein the frame includes an interior concave portion shaped to substantially conform to an exterior portion of the body.

4. The apparatus of claim 1, wherein the axis of rotation is defined by an axle that rotatably couples the appendage to the frame.

5. The apparatus of claim 1, wherein the axis of rotation is situated at least substantially parallel to a direction of movement of the apparatus as vibrational motion causes the apparatus to move.

6. The apparatus of claim 1, wherein the axis of rotation is situated at least substantially perpendicular to a direction of movement of the apparatus.

7. The apparatus of claim 1, further comprising a plurality of appendages rotatably coupled to the frame, wherein each appendage is adapted to rotate about a respective axis of rotation when the frame is attached to the body and the vibrational motion is activated.

8. The apparatus of claim 7, wherein each appendage is configured to resemble one of a saw blade, a swinging blade, a rocking wing, a steamroller drum, or a drill bit.

9. A mechanical toy comprising:

a body;

a vibration drive situated within the body, wherein the vibration drive includes an eccentric load and a rotational motor adapted to rotate the eccentric load;

at least one leg attached to a portion of the body, the at least one leg has a leg base and a leg tip at a distal end relative to the leg base, the leg tip being adapted to contact a supporting surface, and wherein an average axial cross-section of at least five percent of a length of the at least one leg between the leg base and the leg tip, and wherein the at least one leg being made from a material with a resilient characteristic configured to cause at least a portion of the mechanical toy to repeatedly hop as the rotational motor rotates the eccentric load, and wherein repeated hopping causes the mechanical toy to move in a direction generally defined by an offset between the leg base and the leg tip as the rotational motor rotates the eccentric load;

a frame adapted to releasably attach to a portion of the body; and an appendage rotatingly coupled to the frame about an axis of rotation, the appendage configured to freely rotate about the axis when the frame is attached to the body as the rotational motor rotates the eccentric load to induce a vibrational motion of the apparatus.

10. The apparatus of claim 9, wherein the frame includes a plurality of tabs adapted for releasably attaching the frame to the body and the frame further includes a surface opposing the plurality of tabs, the surface and the plurality of tabs adapted to engage a portion of the body.

11. The apparatus of claim 9, wherein the frame includes an interior concave portion shaped to substantially conform to an exterior portion of the body.

12. The apparatus of claim 11, wherein the axis of rotation is defined by an axle that rotatably couples the appendage to the frame.

13. The apparatus of claim 9, wherein the axis of rotation is situated at least substantially parallel to a direction of movement of the apparatus as vibrational motion causes the apparatus to move.

14. The apparatus of claim 9, wherein the axis of rotation is situated at least substantially perpendicular to a direction of movement of the apparatus.

15. The apparatus of claim 9, further comprising a plurality of appendages rotatably coupled to the frame, wherein each appendage is adapted to rotate about a respective axis of rotation when the frame is attached to the body and the vibrational motion is activated.

16. The apparatus of claim 9, wherein the appendage is configured to resemble one of a saw blade, a swinging blade, a rocking wing, a steamroller drum, or a drill bit.

17. The apparatus of claim 9, wherein the legs are arranged in two rows, with the leg base of the legs in each row coupled to the body substantially along a lateral edge of the body, the body includes a housing, the rotational motor is situated within the housing, and at least a portion of the housing is situated between the two rows of legs.

* * * * *